US007185636B2

(12) United States Patent
Usui et al.

(10) Patent No.: US 7,185,636 B2
(45) Date of Patent: Mar. 6, 2007

(54) FUEL DELIVERY PIPE

(75) Inventors: Masayoshi Usui, Numazu (JP); Eiji Watanabe, Shizuoka (JP); Hikari Tsuchiya, Gotenba (JP); Yoshiyuki Serizawa, Mishima (JP); Kazuteru Mizuno, Numazu (JP); Koichi Hayashi, Mishima (JP); Tetsuo Ogata, Shizuoka (JP)

(73) Assignee: USUI Kokusai Sangyo Kaisha, Ltd., Sunto-Gun (JP)

( * ) Notice: Subject to any disclaimer, the term of this patent is extended or adjusted under 35 U.S.C. 154(b) by 0 days.

(21) Appl. No.: 10/523,651

(22) PCT Filed: Oct. 8, 2003

(86) PCT No.: PCT/JP03/12889

§ 371 (c)(1),
(2), (4) Date: Mar. 29, 2005

(87) PCT Pub. No.: WO2004/033894

PCT Pub. Date: Apr. 22, 2004

(65) Prior Publication Data

US 2005/0257774 A1 Nov. 24, 2005

(30) Foreign Application Priority Data

Oct. 11, 2002 (JP) ..... 2002-298165
Feb. 27, 2003 (JP) ..... 2003-51323
May 16, 2003 (JP) ..... 2003-138178

(51) Int. Cl.
*F02M 37/04* (2006.01)

(52) U.S. Cl. ..... 123/467; 123/456

(58) Field of Classification Search ..... 123/467, 123/470, 468, 469, 456, 514, 447; 138/30, 138/28

See application file for complete search history.

(56) References Cited

U.S. PATENT DOCUMENTS 1,069,370 A * 8/1913 Johnson ..... 362/173
4,649,884 A * 3/1987 Tuckey ..... 123/457
4,660,524 A * 4/1987 Bertsch et al. ..... 123/468
5,056,489 A * 10/1991 Lorraine ..... 123/468
5,477,829 A * 12/1995 Hassinger et al. ..... 123/467
6,189,510 B1 * 2/2001 Jaeger et al. ..... 123/468

(Continued)

FOREIGN PATENT DOCUMENTS

GB 2 346 931 8/2000

(Continued)

*Primary Examiner*—Carl S. Miller
(74) *Attorney, Agent, or Firm*—Jordan and Hamburg LLP

(57) ABSTRACT

A fuel delivery pipe capable of reducing a pressure pulsation at the time of a fuel injection due to injection nozzles, preventing vibrations and noises at an underfloor pipe arrangement, and turning down a radiate sound from the fuel delivery pipe, wherein a flexible absorbing wall surface 10 formed on a wall surface of a fuel delivery body 1 is loosened due to internal pressure changes to render internal volume of the fuel delivery body 1 increasable, $\alpha_L/\sqrt{V}$ determined by sonic speed $\alpha_L$ of fuel flowing through the fuel delivery body 1 and the internal volume V of the fuel delivery body 1 is set as $20\times10^3(m^{-0.5}\cdot sec^{-1})\leqq\alpha_L/\sqrt{V}\leqq85\times10^3(m^{-0.5}\cdot sec^{-})$ while a ratio $\alpha_L/\alpha_H$ of equivalent sonic speed $\alpha_H$ in a high frequency area to the sonic speed $\alpha_L$ of the fuel is set as $\alpha_L/\alpha_H\leqq0.7$, and the cross section shape in a perpendicular direction to an axis of the fuel delivery body 1 is formed in a substantially double side concaved shape, a substantially flask shape, a substantially trapezoid shape, a substantially key shape, and a substantially goggles shape.

11 Claims, 48 Drawing Sheets

U.S. PATENT DOCUMENTS

| | | | | |
|---|---|---|---|---|
| 6,354,273 | B1 | 3/2002 | Imura et al. | |
| 6,371,083 | B1 * | 4/2002 | Rossi et al. | 123/456 |
| 6,640,783 | B2 * | 11/2003 | Braun et al. | 123/467 |
| 6,892,704 | B2 * | 5/2005 | Tsuchiya et al. | 123/456 |

FOREIGN PATENT DOCUMENTS

| | | |
|---|---|---|
| JP | 60-240867 | 11/1985 |
| JP | 8-326622 | 12/1996 |
| JP | 10-331743 | 12/1998 |
| JP | 11-2164 | 1/1999 |
| JP | 11-37380 | 2/1999 |
| JP | 2000-320422 | 11/2000 |
| JP | 2000-320423 | 11/2000 |
| JP | 2000-329030 | 11/2000 |
| JP | 2000-329031 | 11/2000 |

* cited by examiner

FUEL DELIVERY PIPE

TECHNICAL FIELD

This invention relates to a fuel delivery pipe for supplying fuel supplied from a fuel pressure pump of an engine for automobile of an electronic fuel injection type via a fuel injector, or an injection nozzle, for directly injecting each inside of intake passages and cylinders of the engine, which having an object to reduce pressure pulsations and radiant sound caused by the fuel injection. Furthermore, this invention relates to a cross-sectional structure of the fuel delivery pipe having a fuel passage, to an external structure of the fuel pipe, and to a structure, or a mechanism, for reducing the pressure pulsation and the radiant sound of the fuel delivery pipe.

BACKGROUND ART

Conventionally, a fuel delivery pipe having a plurality of injection nozzles to supply fuel, e.g., gasoline to a plurality of cylinders of an engine has been known. This fuel delivery pipe injects sequentially the fuel introduced from a fuel tank into a plurality of intake pipes or the cylinders of the engine via a plurality of the injection nozzles to mix the fuel with air, thereby burning the air-fuel mixture to generate an engine output power.

Though this fuel delivery pipe is, as described above, for injecting the fuel supplied through an underfloor pipe arrangement from the fuel tank into the intake pipes or the cylinders via the injection nozzles, a fuel delivery pipe as a return type have existed, which belongs to a type having a circuit for returning the surplus fuel to the fuel tank by a pressure regulator in a case of where the fuel is overly supplied into an interior of the fuel delivery pipe. To the contrary to the fuel delivery pipe as the return type, there has been known a fuel delivery pipe as a returnless type having no circuit for returning the supplied fuel to the fuel tank.

Those of the type to return the fuel extra supplied into the fuel delivery pipe to the fuel tank, can always keep the amount of the fuel in the fuel delivery pipe constant, thereby having an advantage such that the pressure pulsation in association with the fuel injection hardly occurs. The fuel supplied to the fuel delivery pipe arranged near the engine cylinder heated at high temperature, however, may be rendered at a high temperature, and the heated surplus fuel is returned to the fuel tank thereby increasing the temperature of gasoline inside the fuel tank. Because it is undesirable that the gasoline vaporizes due to the temperature increase and has negative effects on environment, the fuel delivery pipe as the returnless type has been proposed, which does not return the surplus fuel to the fuel tank.

With this fuel delivery pipe of the returnless type, where the fuel is injected from the injection nozzle into the intake pipes or the cylinders, since there is no pipe for returning the surplus fuel to the fuel tank, pressure fluctuation of the fuel inside the fuel delivery pipe becomes large and causes large pressure waves, so that the pressure pulsation occurs greatly in comparison with the fuel delivery pipe of the return type.

This invention uses the fuel delivery pipe of the returnless pipe having a tendency to easily cause the pressure pulsation. With the conventional arts, if the internal pressure of the fuel delivery pipe is decreased due to the fuel injection from the injection nozzle into the intake pipe or the cylinder of the engine, the pressure wave generated by this rapidly decreased pressure and by the halt of the fuel injection causes the pressure pulsation inside the fuel delivery pipe.

After propagated from the fuel delivery pipe and connecting pipes connected to the fuel delivery pipe to the proximity of the fuel tank, the pressure pulsation is returned as reversed from a pressure-regulating valve assembled inside the fuel tank and is further propagated up to the fuel delivery pipe via the connecting pipe. Plural injection nozzles are formed at the fuel delivery pipe and perform injections sequentially to cause the pressure pulsation.

Consequently, the pressure pulsation is propagated as noises in the passenger compartment via clips fastening the under floor pipe arrangement, thereby giving uncomfortable feeing to the driver or passengers.

Conventionally, as a means for suppressing such an adverse effect caused by such a pressure pulsation, a pulsation damper containing a rubber diaphragm is arranged at the fuel delivery pipe of the returnless type for absorbing generated pressure pulsation energy, or the underfloor pipe arrangement arranged under the floor as extending from the fuel delivery pipe to the proximity of the fuel tank is secured under the floor by means of the clips for absorbing vibration, thereby absorbing vibration generated at the underfloor pipe arrangement connecting to the fuel delivery pipe or extending to the tank. These means are comparatively effective enough to suppress the adverse effects caused by occurrences of the pressure pulsation.

However, the pulsation dampers and the vibration absorbing clips are expensive and increase the number of components to result in higher costs while raising a new problem on ensuring an installation space. Therefore, for the purpose of reducing the pressure pulsation without using the pulsation dampers or the clips for absorbing vibration, a fuel delivery pipe having a pulsation absorptive function capable of absorbing the pressure pulsation, have been proposed.

As such a fuel delivery pipes having the pulsation absorptive function, inventions as described in Japanese Patent Application Publication Nos. JA-2000-329030, JA-2000-320422, JA-2000-329031, JA-11-37380, and JA-11-2164 have been known. With these fuel delivery pipes having the absorptive function for the pressure pulsation, a flexible absorbing surface is formed on the outer wall of the fuel delivery pipe, deforming by receiving the occurring pressure in association with the fuel injection, to absorb and reduce the pressure pulsation, thereby to prevent abnormal noise caused by the vibration of the fuel delivery pipe or other components from occurring.

The above described conventional arts, however, have the absorption effects for the pressure pulsation but raise problems such that noises in a high frequency area of more than several kHz are generated outside upon a speaker effect exerted by the absorbing surface.

With the fuel delivery pipe as described in the Japanese Patent Application Publication No. 2000-329030, the inventors of the present invention, and others have proposed making the fuel delivery pipe absorb the pulsation by making an outer wall of the fuel delivery body the flexible absorbing surface. FIG. 46 shows an example where the fuel delivery pipe is made to absorb the pulsation by making a whole of a box shaped cross section of the fuel delivery body 81 of the fuel delivery pipe the flexible absorbing surface. Plural sockets 82 are secured to a bottom surface of the fuel delivery body 81, so the fuel is supplied from a fuel passage 83 into the interior of the injection nozzle, not shown, via a fuel inlet opening 84 of the socket 82. As vertical and horizontal dimensions of the fuel delivery body 81 having the thickness of 1.2 mm made of a carbon steel member, height H and width W can be set to around 32 mm and 20 mm respectively.

The inventors of the present invention, and others assume a situation in which the pressure of ten atmospheres exerts on the interior of the fuel delivery body 81, and make an FEM (Finite Element Matrix) analysis under the condition that a bracket (in reference to FIG. 1) for securing the fuel delivery body 81 and the socket 82 are secured to a bottom surface, thereby calculating an increasing rate of an internal volume while displaying in FIG. 47 the changing situation of the cross section shape with enlarging a variation thereof.

As shown in FIG. 47, a left side wall 85 and a right side wall 86 of an inner wall surface of the fuel delivery body 81 are curved as expanded in a horizontal direction, e.g., from a dashed line to a solid line by receiving an internal pressure, but in terms of an upper wall 87 and a lower wall 88, each of the walls ends up curved as shrunk inwardly, and it was turned out that the increasing rate of the internal volume remains at around 0.55%.

Subsequently, as a result of making the same analysis with transforming the cross section shape in a perpendicular direction to an axis of the fuel delivery body 81, from the box shape into, e.g., a double side concaved shape, a hand drum shape, a flask shape, a reverted flask shape, a trapezoid shape, and a reverted trapezoid shape (in reference to FIG. 1, FIG. 2, FIG. 4 to FIG. 30, and FIG. 37 to FIG. 42), it was found that the increasing rate of the internal volume greatly increases to between 1.1% and 1.8%. It is thought that because lefts and rights of these shapes are originally curved surfaces, curved surfaces are deformed, by receiving the pressure, in a direction to decrease a curvature, and therefore, bending is absorbed in the left and right directions while the upper and the lower surfaces hardly deforms, so that an amount of the internal volume becomes inceased.

Though the FEM analysis is a numerical analysis with use of a computer, a reliability thereof is considerably high because modifications are always made thereto with feedbacks based on a result of reproduced experiments with use of real things.

"A fuel feeding pipe of a fuel injector device for internal combustion engine" according to Japanese Patent Application Publication No. JA-60-240867 discloses that at least one of wall surfaces of a fuel delivery body is elastically structured to attenuate the pulsation of the fuel whereas the cross section of the fuel delivery body is in a triangular shape. The above conventional invention, however, can obtain the attenuation effect of the pressure pulsation but cannot obtain a reduction effect of the noise in the high frequency area.

DISCLOSURE OF THE INVENTION

To solve aforementioned problems, it is an object of the invention to obtain a fuel delivery pipe capable of reducing a pressure pulsation at the time of a fuel injection due to injection nozzles, preventing vibrations and noises at an underfloor pipe arrangement, and turning down a radiate sound from the fuel delivery pipe. It is another object of this invention to reduce costs by producing products having a great reduction effect of the pressure pulsations as well as the radiate noises without use of any expensive parts, e.g., pulsation dampers or clips for absorbing the vibration. It is yet another object of this invention to form the fuel delivery body without enlarging any dimension of outer diameters thereof as to be installed in a limited space, e.g., an interior of an engine room. It is further another object to provide a structure of the fuel delivery pipe exerting the attenuation effect of the pressure pulsation, capable of reducing the radiate sound, in which the outer diameter thereof does not need to be enlarged.

To solve aforementioned problems, the first invention is a fuel delivery pipe, in which a fuel inlet pipe connected to a fuel delivery body of a returnless type having an injection nozzle or nozzles but not having any return circuit connecting to a fuel tank is coupled to the fuel tank through an underfloor pipe arrangement, characterized in that: a cross section shape in a perpendicular direction to an axis of the fuel delivery pipe, is formed in a substantially rectangular shape; two wall surfaces at long sides of the substantially rectangular shape are respectively bent inwardly as formed in a double side concave shape; a socket for connecting each injection nozzle is secured to either of two wall surfaces in a flat shape at short sides or either of two wall surfaces at long sides; and a flexible absorbing wall surface is furnished by said two long side wall surfaces to absorb pulsation by deformation upon receiving pressure in association with fuel injection.

Flat portions may be respectively formed around centers of the above two long side wall surfaces.

The second invention is a fuel delivery pipe, in which a fuel inlet pipe connected to a fuel delivery body of a returnless type having an injection nozzle but not having return circuit connecting to a fuel tank is coupled to the fuel tank through an underfloor pipe arrangement, characterized in that: a cross section shape in a perpendicular direction to an axis of the fuel delivery pipe, is formed in a substantially flask shape, wherein a substantially rectangular shape is mounted on a top side of a trapezoid; a socket for connecting each injection nozzle, is secured to either a bottom surface or an upper surface, or either of two side surfaces of the substantially flask shaped cross section; and a flexible absorbing wall surface is furnished by two side surfaces of the substantially flask shaped cross section to absorb pulsation by deformation upon receiving pressure in association with fuel injection.

The third invention is a fuel delivery pipe, in which a fuel inlet pipe connected to a fuel delivery body of a returnless type having an injection nozzle but not having return circuit connecting to a fuel tank is coupled to the fuel tank through an underfloor pipe arrangement, characterized in that: a cross section shape in a perpendicular direction to an axis of the fuel delivery pipe, is formed in a shape of a substantial flask with a doom roof, in which a substantially rectangular shape is mounted on a top side of a trapezoid while a top portion of the substantially rectangular shape is bent in an arc shape; a socket for connecting each injection nozzle, is secured to a bottom surface or either of two side surfaces of the substantially flask shaped cross section; and a flexible absorbing wall surface is furnished by two side surfaces of the substantially flask shaped cross section to absorb pulsation by deformation upon receiving pressure in association with fuel injection.

The fourth invention is a fuel delivery pipe, in which a fuel inlet pipe connected to a fuel delivery body of a returnless type having an injection nozzle but not having return circuit connecting to a fuel tank is coupled to the fuel tank through an underfloor pipe arrangement, characterized in that: a cross section shape in a perpendicular direction to an axis of the fuel delivery pipe, is formed in a reverted flask shape, in which a reverted trapezoid is mounted on a top side of a substantially rectangular shape; a socket for connecting each injection nozzle, is secured to a bottom surface of the reverted flask shaped cross section; and a flexible absorbing wall surface is furnished by two side surfaces of the reverted flask shaped cross section to absorb pulsation by deformation upon receiving pressure in association with fuel injection.

The fifth invention is a fuel delivery pipe, in which a fuel inlet pipe connected to a fuel delivery body of a returnless type having an injection nozzle but not having return circuit connecting to a fuel tank is coupled to the fuel tank through an underfloor pipe arrangement, characterized in that: a cross section shape in a perpendicular direction to an axis of the fuel delivery pipe, is formed in a substantially trapezoid shape, in which two hypotenuses of the substantially trapezoid shaped cross section are respectively bent inwardly; a socket for connecting each injection nozzle, is secured to either a bottom surface or an upper surface, or either of two hypotenuses of the substantially trapezoid shaped cross section; and a flexible absorbing wall surface is furnished by two hypotenuses of the substantially trapezoid shaped cross section to absorb pulsation by deformation upon receiving pressure in association with fuel injection.

The sixth invention is a fuel delivery pipe, in which a fuel inlet pipe connected to a fuel delivery body of a returnless type having an injection nozzle but not having return circuit connecting to a fuel tank is coupled to the fuel tank through an underfloor pipe arrangement, characterized in that: a cross section shape in a perpendicular direction to an axis of the fuel delivery pipe, is formed in a shape of a substantial trapezoid with a doom roof, in which a substantially trapezoid shape is formed and a top portion thereof is bent in an arc shape while two hypotenuses of the substantially trapezoid shape are respectively bent inwardly; a socket for connecting each injection nozzle, is secured to a bottom surface or either of two hypotenuses of the substantially trapezoid shaped cross section; and a flexible absorbing wall surface furnished by two hypotenuses of the substantially trapezoid shaped cross section to absorb pulsation by deformation upon receiving pressure in association with fuel injection.

The seventh invention is a fuel delivery pipe, in which a fuel inlet pipe connected to a fuel delivery body of a returnless type having an injection nozzle but not having return circuit connecting to a fuel tank is coupled to the fuel tank through an underfloor pipe arrangement, characterized in that: a cross section shape in a perpendicular direction to an axis of the fuel delivery pipe, is formed in a reverted trapezoid shape, in which two hypotenuses of the reverted trapezoid shape are respectively bent inwardly; a socket for connecting each injection nozzle, is secured to a bottom surface of the reverted trapezoid shaped cross section; and a flexible absorbing wall surface is furnished by two hypotenuses of the reverted trapezoid shaped cross section to absorb pulsation by deformation upon receiving pressure in association with fuel injection.

The eighth invention is a fuel delivery pipe, in which a fuel inlet pipe connected to a fuel delivery body of a returnless type having an injection nozzle but not having return circuit connecting to a fuel tank is coupled to the fuel tank through an underfloor pipe arrangement, characterized in that: a cross section shape in a perpendicular direction to an axis of the fuel delivery pipe, is formed in a substantially key shape, in which a substantially rectangular shape having a narrower width is mounded on a top side of another substantially rectangular shape; a socket for connecting each injection nozzle, is secured to either a bottom surface or an upper surface, or either of two side surfaces of the substantially key shaped cross section; and a flexible absorbing wall surface is furnished by two side surfaces of the substantially key shaped cross section to absorb pulsation by deformation upon receiving pressure in association with fuel injection.

The ninth invention is a fuel delivery pipe, in which a fuel inlet pipe connected to a fuel delivery body of a returnless type having an injection nozzle but not having return circuit connecting to a fuel tank is coupled to the fuel tank through an underfloor pipe arrangement, characterized in that: a cross section shape in a perpendicular direction to an axis of the fuel delivery pipe, is formed in a shape of a substantially key with a dome roof, in which a substantially rectangular shape having a narrower width is mounded on a top side of another substantially rectangular shape while the top portion of the substantially rectangular shape having the narrower width is bent in an arc shape; a socket for connecting each injection nozzle, is secured to a bottom surface or either of two side surfaces of the substantially key shaped cross section; and a flexible absorbing wall surface is furnished by two side surfaces of the substantially key shaped cross section to absorb pulsation by deformation upon receiving pressure in association with fuel injection.

The tenth invention is a fuel delivery pipe, in which a fuel inlet pipe connected to a fuel delivery body of a returnless type having an injection nozzle but not having return circuit connecting to a fuel tank is coupled to the fuel tank through an underfloor pipe arrangement, characterized in that: a cross section shape in a perpendicular direction to an axis of the fuel delivery pipe, is formed in a substantially goggles shape, in which a substantially center portion of either of two long side wall surfaces of a substantially rectangular shape is inwardly bent as a concaved shape; a socket for connecting each injection nozzle, is secured to the other substantially flat shaped long side wall surface or either of two flat shaped short side wall surfaces; and a flexible absorbing wall surface is furnished by at least one long side wall surface having the substantially center portion bent as a concaved shape to absorb pulsation by deformation upon receiving pressure in association with fuel injection.

Two long side wall surfaces may be parallel.

Either of two long side wall surfaces may be formed as outwardly protruded.

At least one of four corners of the cross section shape of the fuel delivery body may be formed in the arc shape.

The eleventh invention is a fuel delivery pipe, in which a fuel inlet pipe is connected to a fuel delivery body of a returnless type having an injection nozzle and no return circuit to a fuel tank, and the fuel inlet pipe is coupled to the fuel tank through an underfloor pipe arrangement, characterized in that: a flexible absorbing wall surface is formed on a wall surface of the fuel delivery body, in which the absorbing wall is loosened due to internal pressure changes to render internal volume of the fuel delivery body increasable while $\alpha_L/\sqrt{V}$ determined by sonic speed $\alpha_L$ of fuel flowing through the fuel delivery body and the internal volume V of the fuel delivery body is set as $20\times10^3$ $(m^{-0.5}\cdot sec^{-1})\leqq\alpha_L/\sqrt{V}\leqq85\times10^3(m^{-0.5}\cdot sec^{-1})$; and a ratio $\alpha_L/\alpha_H$ of equivalent sonic speed $\alpha_H$ in a high frequency area of the fuel flowing through an interior of the fuel delivery body to the sonic speed $\alpha_L$ of the fuel is set as $\alpha_L/\alpha_H\leqq0.7$.

$\alpha_L/\sqrt{V}$ may be equal to $35\times10^3(m^{-0.5}\cdot sec^{-1})$ $\alpha_L/\sqrt{V}\leqq85\times10^3(m^{-0.5}\cdot sec^{-1})$ while $\alpha_L/\alpha_H$ may be equal to $\alpha_L/\alpha_H\leqq0.7$.

$\alpha_L/\sqrt{V}$ may be equal to $20\times10^3(m^{-0.5}\cdot sec^{-1})\leqq\alpha_L/\sqrt{V}\leqq85\times10^3(m^{-0.5}\cdot sec^{-1})$ while $\alpha_L/\alpha_H$ may be equal to $0.35\leqq\alpha_L/\alpha_H\leqq0.7$.

The absorbing wall surface can be formed to increase the internal volume of the fuel delivery body by forming at least one portion of the fuel delivery body surfaces as inwardly bent to render the bent portion relaxing outwardly to the change of the internal pressure.

Since this invention is thus structured, with the fuel delivery pipe as described in the first invention to the tenth invention, a volume changing rate in a case of a reception of the same pressure as before increases sharply, and the absorption effect for the pulsation by the flexible absorbing wall surface is enhanced, so that transmission, propagation, and radiation of the abnormal noises, e.g., the radiant sound are adequately suppressed. Since it is almost unnecessary to enlarge the outside dimension of the fuel delivery body, the fuel delivery body can be installed in the limited space inside the engine room even where made to replace existing fuel delivery pipes, so the fuel delivery pipe can maintain interchangeability as a component.

As a theoretical basis for a pulsation absorption by the absorbing wall surface, it is understood that when a shock wave occurring at the time of opening and closing of the injection nozzle flows into or, because of a momentary backward flow, flows out of a fuel inlet opening of the socket, shocks or pulsations are absorbed by a flexion of the flexible absorbing wall surface, and that a thin member having a comparatively low spring constant loosens and deforms to change the internal volume, thereby absorbing fluctuations in the pressure of the fuel.

Each of the first invention to tenth invention demonstrates the same advantageous effects by adopting various types of cross section shapes as described below:

(1) the cross section shape in a perpendicular direction to an axis of the fuel delivery body is a substantially rectangular shape, in which two wall surfaces at long sides of the rectangular shape are respectively bent inwardly as formed in a double side concave shape;

(2) the substantially hand dram shape, in which flat portions are respectively formed around centers of two long side wall surfaces of the cross section in the double side concaved shape;

(3) the cross section shape in the perpendicular direction to the axis of the fuel delivery body is a substantially flask shape, in which the substantially rectangular shape is mounted on a top side of a trapezoid;

(4) the cross section shape in the perpendicular direction to the axis of the fuel delivery body is a substantially flask shape, in which a substantially rectangular shape is mounted on the top side of the trapezoid while a top portion of the substantially rectangular shape is bent in the arc shape as formed in a shape of the substantial flask with a doom roof;

(5) the cross section shape in the perpendicular direction to the axis of the fuel delivery body is a reverted flask shape, in which the reverted trapezoid is mounted on a top side of the substantially rectangular shape;

(6) the cross section shape in the perpendicular direction to the axis of the fuel delivery body is a substantially trapezoid shape;

(7) the cross section shape in the perpendicular direction to the axis of the fuel delivery body is a substantially trapezoid shape, in which a top portion of a shape of the trapezoid is bent in the arc shape as formed in a substantial trapezoid with the doom roof;

(8) the cross section shape in the perpendicular direction to the axis of the fuel delivery body is the reverted trapezoid shape, in which two hypotenuses of the reverted trapezoid shape are respectively bent inwardly;

(9) the cross section shape in the perpendicular direction to the axis of the fuel delivery body is the substantially key shape, in which the substantially rectangular shape having the narrower width is mounded on a top side of another substantially rectangular shape;

(10) the cross section shape in the perpendicular direction to the axis of the fuel delivery body is the substantially key shape, in which the top portion of the substantially rectangular shape having the narrower width is bent in the arc shape as formed in the substantially key with the dome roof; and

(11) the cross section shape in the perpendicular direction to the axis of the fuel delivery body is the substantially rectangular shape, in which a substantially center portion of either of two long side wall surfaces is inwardly bent in a concaved shape as formed in a substantially goggles shape.

It is to be noted that each of the cross section shapes does not need to be exactly in a horizontally symmetric shape. The socket to be connected to the fuel delivery body may be arranged at any position of an upper surface, a bottom surface, and two side surfaces of the wall surface while the fuel delivery body is used in a state where the wall surface connected to the socket is exposed a lower side.

Furthermore, the fuel delivery bodies having the predetermined cross section shapes as described the above can be formed in use of well-known fabrication methods as described below with following materials for forming each cross section shape, (A) a seamless pipe (except for seams at the time of manufacturing a annular pipe) fabricated from the annular pipe;

(B) a pipe formed by combining two channel members with welding a seam between the two channel members; and (C) a pipe in which a member partly overlapped on one another by pressing work.

With the first to tenth inventions, a plate thickness, an aspect ratio, or material or strength of constructing members of an outer wall portion and the absorbing wall surface of the fuel delivery body can be determined through experiments or analyses so that the vibration or pulsation is to be at the lowest level particularly during the period of an engine idling.

The fuel delivery pipe according to the first to tenth inventions can maintain the interchangeability with conventional fuel delivery pipes by maintaining an installation dimension of brackets.

The eleventh invention relates to a structure (mechanism) for reducing the pressure pulsation and the radiant sound, and where the pressure pulsation occurs in association with the fuel injection via the injection nozzles, value of a pressure fluctuation relates closely to sonic speed $\alpha_L$ of fuel flowing through the interior of the fuel delivery pipe and to internal volume of the fuel delivery body, and the relation thereof is set as a proportional expression described as following Numerical Expression 1.

$$P \propto \frac{\alpha L}{\sqrt{V}} \qquad \text{[Numerical Expression 1]}$$

P: the value of pressure fluctuation, $\alpha_L$: the sonic speed of fuel inside the fuel delivery pipe, V: the internal volume of the fuel delivery body Therefore, by reducing the sonic speed $\alpha_L$ of fuel flowing through the interior of the fuel delivery pipe, the pulsation fluctuation P can be reduced. With respect to the sonic speed $\alpha_L$, the following numerical expression is satisfied based on the law of momentum and an equation of continuity. Furthermore, the following numerical expression is satisfied based on the definition of the volume elasticity.

$$\alpha_L = \sqrt{\frac{\frac{1}{\rho}}{\frac{1}{Kf} + \frac{1}{Kr}}} \quad \text{[Numeral Expression 2]}$$

ρ: density of the fuel, $K_f$: the volume elasticity of the fuel, $K_r$: the volume elasticity inside the duel delivery pipe.

$$Kr = \frac{\Delta p}{\frac{\Delta V}{V}} \quad \text{[Numeral Expression 3]}$$

Δp: a variation of the internal pressure inside the fuel delivery body, ΔV: a volume variation for an elasticity of the fuel delivery body at the time of adding the internal pressure Based on the numerical analysis, e.g., FEM, with use of the above numeral Expressions, the sonic speed $\alpha_L$ of the fuel flowing through the fuel delivery body can be sought. The sonic speed $\alpha_L$ of the fuel can be reduced just by reducing $K_r$, i.e., the volume elasticity inside the fuel delivery body, and Kr can be reduced just by increasing the internal volume of the fuel delivery body at the time of adding the internal pressure. Herein, with the fuel delivery pipe according to this invention, having the flexible absorbing wall surface, the flexible absorbing wall surface loosens outwardly due to the change of the internal pressure thereby to increase the internal volume, so that the fuel delivery pipe according to this invention has the great absorption effect for the pressure pulsation and can suppress the transmission and the propagation of the pulsations and the noises to the underfloor pipe arrangement.

On the other hand, it is possible to calculate equivalent sonic speed $\alpha_H$ in a high frequency area of several kHz or more considered as a problem on clicking noises occurring when a spool of the injection nozzle is seated on a valve seat and other radiant sounds, by seeking a mode and frequency of an air column vibration inside the fuel delivery body. That is, the mode of the air column vibration applies to a condition of the air column with both ends thereof being blocked, so the relation as the following Numerical Expression is satisfied.

$$f = \frac{n\alpha H}{2l} \quad \text{[Numerical Expression 4]}$$

f: the frequency, n: mode order of the air column vibration, 1: air column length of the fuel delivery pipe Based on the above Numerical Expression 4, the following Numerical Expression 5 can determine the equivalent sonic speed $\alpha_H$ in the high frequency area.

$$\alpha_H = \frac{2fl}{n} \quad \text{[Numerical Expression 5]}$$

When calculated with use of the above Numerical Expressions, the equivalent sonic speed $\alpha_H$ in the high frequency of the conventional fuel delivery pipe is approximately same as the sonic speed $\alpha_L$ of said fuel, and where $\alpha_L$ is reduced to reduce the pressure pulsation, $\alpha_H$ also reduces, thereby raising a problem such that the radiant sound becomes larger. With the fuel delivery pipe according to this invention, however, the absorbing wall surface forms, because of the pulsation in the high frequency considered as the problem with respect to the radiant sound, into a mode shape having a number of loops and nodes, or an not-readily bent shape, so that the absorbing wall surface in the high frequency is less loosened. The equivalent sonic speed $\alpha_H$ in the high frequency, therefore, does not reduce even where the sonic speed $\alpha_L$ is reduced, so that occurrences of the loud radiant sound are suppressed effectively.

As the result of the numeral analyses and the experiments made by the inventor of the present invention, and others, the fuel delivery pipe having great effects, both the absorption effect for the pressure pulsation and the prevention effect for the radiant sound is obtainable with the structure such that $\alpha_L/\sqrt{V}$ determined by sonic speed $\alpha_L$ of fuel and the internal volume V of the fuel delivery body is set as $20\times10^3$ $(m^{-0.5}sec^{-1}) \leqq \alpha_L/\sqrt{V} \leqq 85\times10^3 (m^{-0.5}sec^{-1})$ as well as such that a ratio $\alpha_L/\alpha_H$ of equivalent sonic speed $\alpha_H$ in the high frequency area to the sonic speed $\alpha_L$ of the fuel is set as $\alpha_L/\alpha_H \leqq 0.7$.

To keep within the above range, i.e., to render $\alpha_L/\sqrt{V} < 20\times10^3 (m^{-0.5}\cdot sec^{-1})$ satisfied, it is necessary to reduce $\alpha_L$ or to increase V. The internal volume V needs to be increased in order to increase $\alpha_L$, and furthermore, a thickness of the wall surface needs to be thinly formed to increase the internal volume V, so that the fuel delivery pipe for the pulsation at the time of the fuel injection is made less durable. Furthermore, it is necessary to increase a width, a height, and a length of the formation of the fuel delivery body in order to increase the internal volume V, so the internal volume V becomes bulky, the pipe looses compactness on vehicle layout. Conversely, where $\alpha_L/\sqrt{V} \leqq 85\times10^3 (m^{-0.5}\cdot sec^{-1})$ is satisfied, the increasing rate of the internal volume V due to the internal pressure decreases to result in rendering the products poorly absorptive for the pulsation, so that the underfloor pipe arrangement may be vibrated.

Furthermore, on condition that $\alpha_L/\alpha_H > 0.7$ is satisfied, where the sonic speed $\alpha_L$ of the fuel is reduced to enhance a pulsation absorptiveness, the equivalent sonic speed $\alpha_H$ in the high frequency area is also reduced in proportion to the sonic speed $\alpha_L$, resulting in the radiant sound louder, so the product has a poor suppression effect for the radiant sound, thereby causing clicking noised.

With the fuel delivery pipe according to this invention, like the above, it becomes possible not only to have the great absorption effect for the pressure pulsation due to the fuel injection via the injection nozzles to prevent effectively the vibration or the noise from occurring at the underfloor pipe arrangement, but also to suppress sound radiation in the high frequency area, e.g., clicking noises occurring when the spool of the injection nozzle is seated on the valve seat or the like. It is therefore unnecessary to use the expensive components, e.g., the pulsation dampers or the clips for absorbing the vibration, thereby being able to reduce of the production costs, and it is also possible to obtain the not-bulky product suppressing enlargement of the outside dimension thereof and having great layout property allowing installation in the limited space, e.g., the engine room, and the product can be replaced with the existing fuel delivery pipes, thereby being able to maintain the interchangeability as the component.

Where $\alpha_L/\sqrt{V}$ is set as $35\times10^3(m^{-0.5}\cdot sec^{-1})\leqq\alpha_L/\sqrt{V}\leqq85\times10^3(m^{-0.5}\cdot sec^{-1})$ while $\alpha_L/\alpha_H$ is set as $\alpha_L/\alpha_H>0.7$, the fuel delivery pipe is suitable for use in, e.g., compact automobiles mounted with a comparatively small engine (660–1000 cc class) with four cylinders or the like, though the reduction effect for the pressure pulsation may be comparatively low.

Where $\alpha_L/\sqrt{V}$ is set as $20\times10^3(m^{-0.5}\cdot sec^{-1})\leqq\alpha_L/\sqrt{V}$ $35\times10^3(m^{-0.5}\cdot sec^{-1})$ while $\alpha_L/\alpha_H$ is set as $0.35\leqq\alpha_L/\alpha_H\leqq0.7$, the prevention effect for the radiant sound or the pressure pulsation absorptiveness of the fuel delivery pipe is particularly superior, so the fuel delivery pipe is suitable for use in, e.g., automobiles mounted with a large size engine (1300–2500 cc class) with four to six or more cylinders, requiring the great reduction effect for the pressure pulsation.

It is physically impossible that the value of the equivalent sonic speed $\alpha_H$ in the high frequency area becomes faster than the original sonic speed of the fuel inside the fuel delivery pipe, so the sonic speed $\alpha_L$ of the fuel needs to be reduced in order to reduce the sonic speed $\alpha_L/\alpha_H$, which, as described above, means that wall thickness is made thin in order to enlarge the amount of deformation to lead to deterioration of the durability. It is therefore desirable to set $\alpha_L/\alpha_H$ to 0.35 or higher since the value of $\alpha_L$ is limited to avoid breakdown of the fuel delivery body due to the internal pressure in use.

The absorbing wall surface may be formed in any shape capable of enlarging the internal volume of the fuel delivery body by loosening upon receiving the internal pressure, but where at least one portion of the wall surface of the fuel delivery body is made to be bent inwardly, i.e., more desirably, made to curved gently with a comparatively large radius of curvature to form the absorbing wall surface, it becomes possible to make the internal volume of the fuel delivery body increase since the curved portion loosened outwardly to a change of the internal pressure. As an effect of the absorbing wall surface like the above, in a case of the absorbing wall surface not having the wall surface curved inwardly, where the absorbing wall surface is outwardly loosened, a portion of non-absorbing wall surface, conversely, may shrink inwardly, so it is difficult to increase greatly the internal volume. However, where the wall surface is made to be curved inwardly to form the absorbing wall surface, the curved portion loosens outwardly to be in a liner shape, thereby lengthening a distance between end points of the absorbing wall surfaces, so that the non-absorbing wall surface continuous to the above absorbing wall surface does not shrink inwardly but, conversely, expands outwardly, and so that the increasing rate of the internal volume of the fuel delivery body can be greatly improved.

BEST MODE FOR CARRYING OUT THE INVENTION

Figure 1:
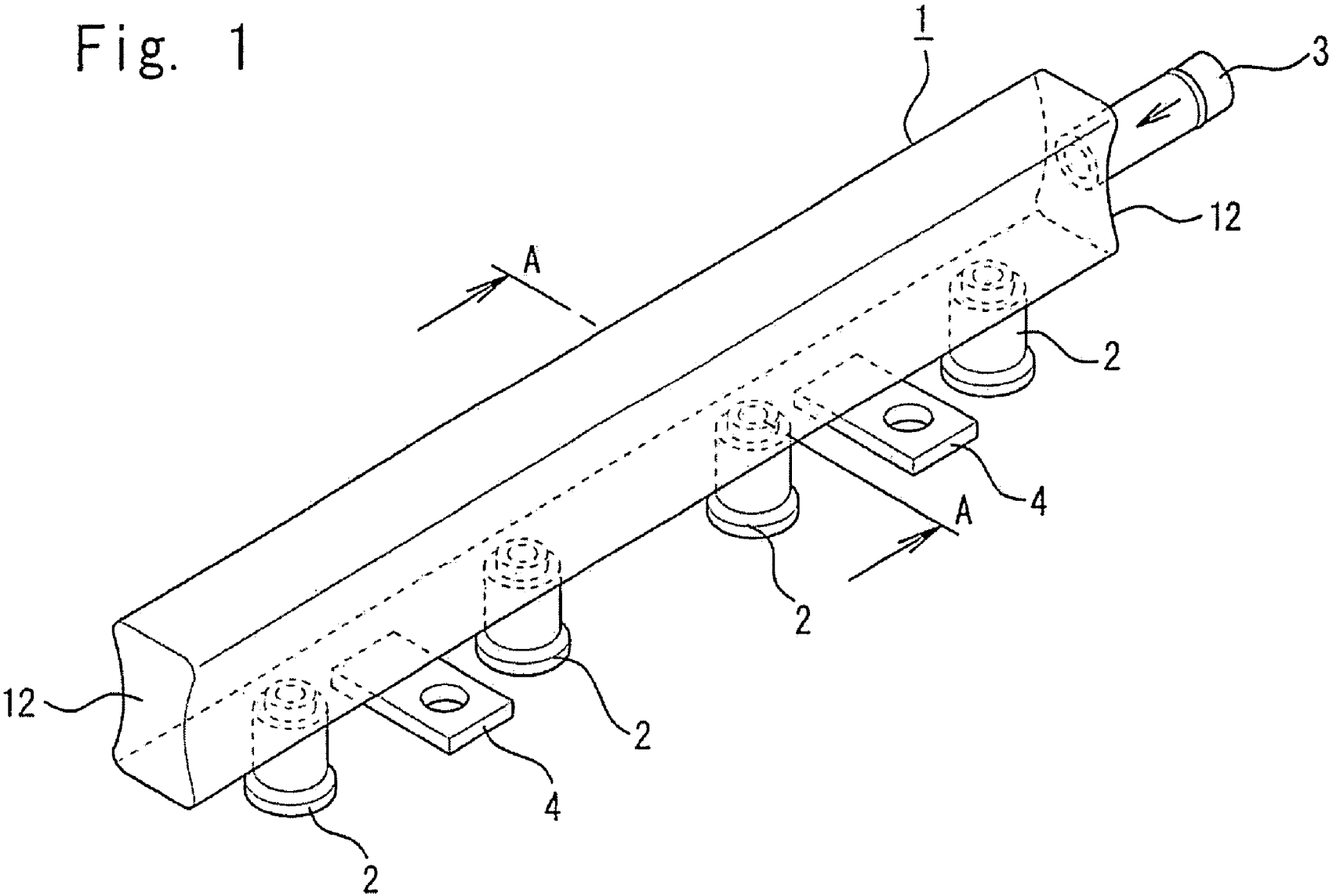
FIG. 1 is a perspective view showing a fuel delivery pipe according to the first embodiment of this invention.

Hereinafter, embodiments according to this invention will be described in detail with reference to the drawings. The following table 1 shows sonic speed $\alpha_L$(m/s), cross-sectional area A ($mm^2$), internal volume V ($mm^3$), $\alpha_L/\sqrt{V}(m^{-0.5}\cdot sec^{-1})$, equivalent sonic speed $\alpha_H$(m/s) in a high frequency area, $\alpha_L/\alpha_H$, and thickness (mm) of a fuel delivery body according to the first embodiment to the twenty-fifth embodiment of this invention. For the sake of comparison, Table 1 shows data of a rectangular shaped fuel delivery body (the first conventional example) not having an absorbing wall surface and flat shaped fuel delivery bodies (the second conventional example to the sixth conventional example) having an absorbing wall surface, respectively.

TABLE 1

| type | $\alpha_L$ (m/s) | A ($mm^2$) | V ($mm^3$) | $\alpha_L/\sqrt{V}$ ($10\ m^{-0.5}\cdot s^{-1}$), | $\alpha_H$ (m/s) | $\alpha_L/\alpha_H$ | thickness |
|---|---|---|---|---|---|---|---|
| 1st conventional example W16 × H16 × L325 | 916 | 184 | 59426 | 119 | 902 | 1.02 | 1.2 |
| 2nd conventional example W28 × H10.2 × L325 | 415 | 191 | 61540 | 53 | 407 | 1.02 | 1.2 |
| 3rd conventional example W34 × H10.2 × L325 | 302 | 236 | 76251 | 35 | 306 | 0.99 | 1.2 |
| 4th conventional example W34 × H10.2 × L175 | 362 | 236 | 40796 | 57 | 357 | 1.01 | 1.2 |
| 5th conventional example W28 × H10.2 × L175 | 491 | 200 | 34476 | 84 | 357 | 1.01 | 1.2 |
| 6th conventional example W32.7 × H10.2 × L325 | 261 | 247 | 79682 | 29 | 267 | 1.01 | 1 |
| 1st embodiment double side concaved shape placed vertically L325 | 287 | 468 | 150879 | 23 | 663 | 0.43 | 1.2 |
| 2nd embodiment double side concaved shape placed horizontally L325 | 298 | 468 | 150879 | 24 | 587 | 0.51 | 1.2 |
| 3rd embodiment large flask shape placed horizontally L325 | 276 | 289 | 93097 | 29 | 620 | 0.45 | 1.2 |
| 4th embodiment small key shape placed horizontally L325 | 252 | 205 | 66155 | 31 | 446 | 0.57 | 1.2 |
| 5th embodiment double side concaved shape L340 | 320 | 221 | 74647 | 37 | 610 | 0.52 | 1.2 |
| 6th embodiment double side concaved shape L340 | 308 | 136 | 46041 | 45 | 568 | 0.54 | 1 |
| 7th embodiment double side concaved shape L340 | 362 | 229 | 77408 | 41 | 650 | 0.56 | 1.2 |
| 8th embodiment double side concaved shape L340 | 486 | 228 | 76938 | 55 | 699 | 0.7 | 1.2 |

TABLE 1-continued

| type | $\alpha_L$ (m/s) | A ($mm^2$) | V ($mm^3$) | $\alpha_L/\sqrt{V}$ ($10\ m^{-0.5} \cdot s^{-1}$), | $\alpha_H$ (m/s) | $\alpha_L/\alpha_H$ | thickness |
|---|---|---|---|---|---|---|---|
| 9th embodiment double side concaved shape L340 | 277 | 177 | 59701 | 36 | 586 | 0.47 | 1 |
| 10th embodiment double side concaved shape L340 | 284 | 238 | 80201 | 32 | 757 | 0.37 | 1 |
| 11th embodiment double side concaved shape L340 | 209 | 159 | 53515 | 29 | 486 | 0.43 | 1 |
| 12th embodiment goggles shape L340 | 280 | 194 | 65419 | 35 | 555 | 0.5 | 1 |
| 13th embodiment goggles shape L340 | 263 | 234 | 78993 | 30 | 513 | 0.51 | 1.2 |
| 14th embodiment goggles shape L340 | 262 | 221 | 74642 | 30 | 519 | 0.5 | 1.2 |
| 15th embodiment goggles shape L340 | 249 | 218 | 73523 | 29 | 483 | 0.52 | 1 |
| 16th embodiment goggles shape L340 | 267 | 218 | 73463 | 31 | 464 | 0.58 | 1.2 |
| 17th embodiment goggles shape L340 | 211 | 250 | 84567 | 23 | 469 | 0.45 | 1 |
| 18th embodiment key shape L340 | 274 | 199 | 67099 | 33 | 517 | 0.53 | 1.2 |
| 19th embodiment key shape L340 | 269 | 205 | 69067 | 32 | 514 | 0.52 | 1.2 |
| 20th embodiment key shape L340 | 243 | 188 | 63631 | 30 | 452 | 0.54 | 1.2 |
| 21st embodiment key shape L340 | 284 | 198 | 66826 | 35 | 488 | 0.58 | 1 |
| 22nd embodiment double side concaved shape L340 | 276 | 188 | 63562 | 35 | 566 | 0.49 | 1.2 |
| 23rd embodiment flask shape L340 | 316 | 237 | 80015 | 35 | 527 | 0.6 | 1.2 |
| 24th embodiment flask shape L340 | 336 | 201 | 67734 | 41 | 573 | 0.59 | 1.2 |
| 25th embodiment flask shape L340 | 284 | 293 | 99024 | 29 | 633 | 0.45 | 1.2 |

W = width,
H = height,
L = length

Figure 48:
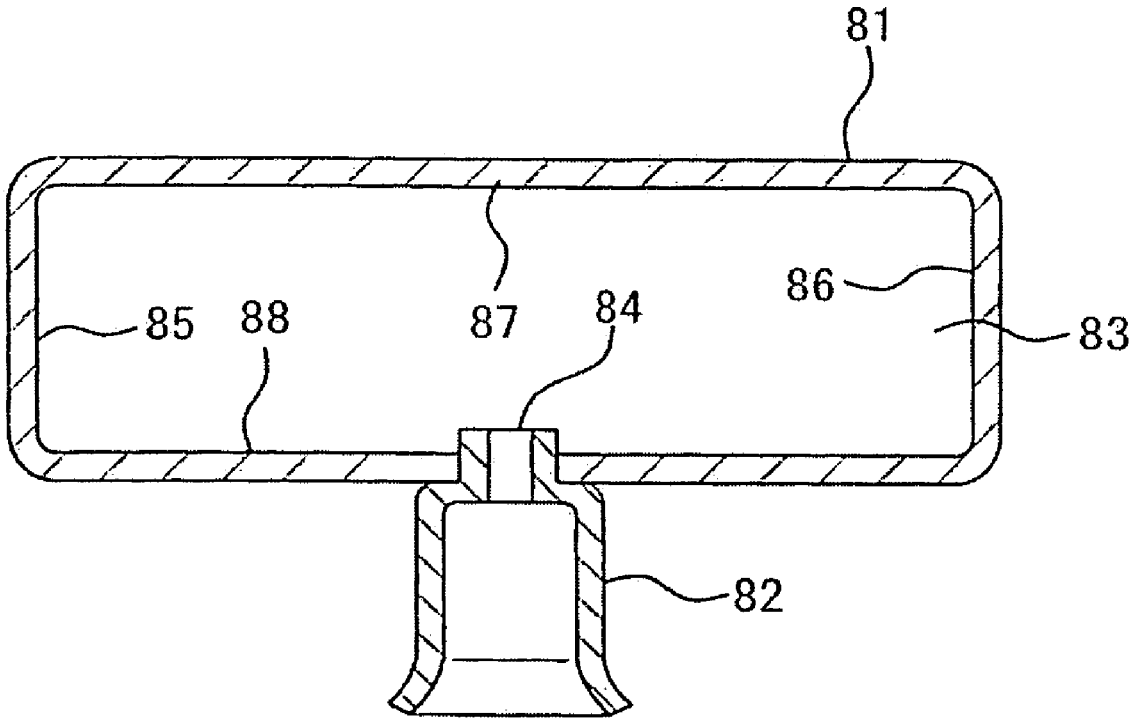
FIG. 48 is a cross-sectional view of a fuel delivery pipe in the flat shape according to the second conventional example to the sixth conventional example used in an experiment.

With the aforementioned fuel delivery body of the first conventional example, as shown in Table 1, a cross section thereof is defined as being in a substantially square shape with a width of 16 mm and a height of 16 mm while a thickness and a pipe length thereof are respectively set as 1.2 mm and 325 mm. Furthermore, as shown in FIG. 48, in the second conventional example to the sixth conventional example, the cross section of the fuel delivery body 81 is defined as in a flatly rectangular shape. In the second conventional example, the cross section the fuel delivery body is defined as being in the flatly rectangular shape with a width of 28 mm and a height of 10.2 mm while a thickness and a pipe length thereof are respectively defined as 1.2 mm and 325 mm. In the third conventional example, the cross section of the fuel delivery body is defined as being in the flatly rectangular shape with a width of 34 mm and a height of 10.2 mm while a thickness and a pipe length thereof are respectively defined as 1.2 mm and 325 mm. In the fourth conventional example, the cross section of the fuel delivery body is defined as being in the flatly rectangular shape with a width of 34 mm and a height of 10.2 mm while a thickness and a pipe length thereof are respectively defined as 1.2 mm and 175 mm. In the fifth conventional example, the cross section of the fuel delivery body is defined as being in the flatly rectangular shape with a width of 28 mm and a height of 10.2 mm while a thickness and a pipe length thereof are respectively defined as 1.2 mm and 175 mm. In the sixth conventional example, the cross section of the fuel delivery body is defined as being in the flatly rectangular shape with a width of 32.7 mm and a height of 10.2 mm while a thickness and a pipe length thereof are respectively defined as 1.0 mm and 325 mm.

Furthermore, with the fuel delivery body in each of the embodiments, a cross section thereof is formed in a particular shape by means of a roll forming process using pipes made of carbon steel, stainless steel, or the like having a circle shaped cross section.

Figure 2:
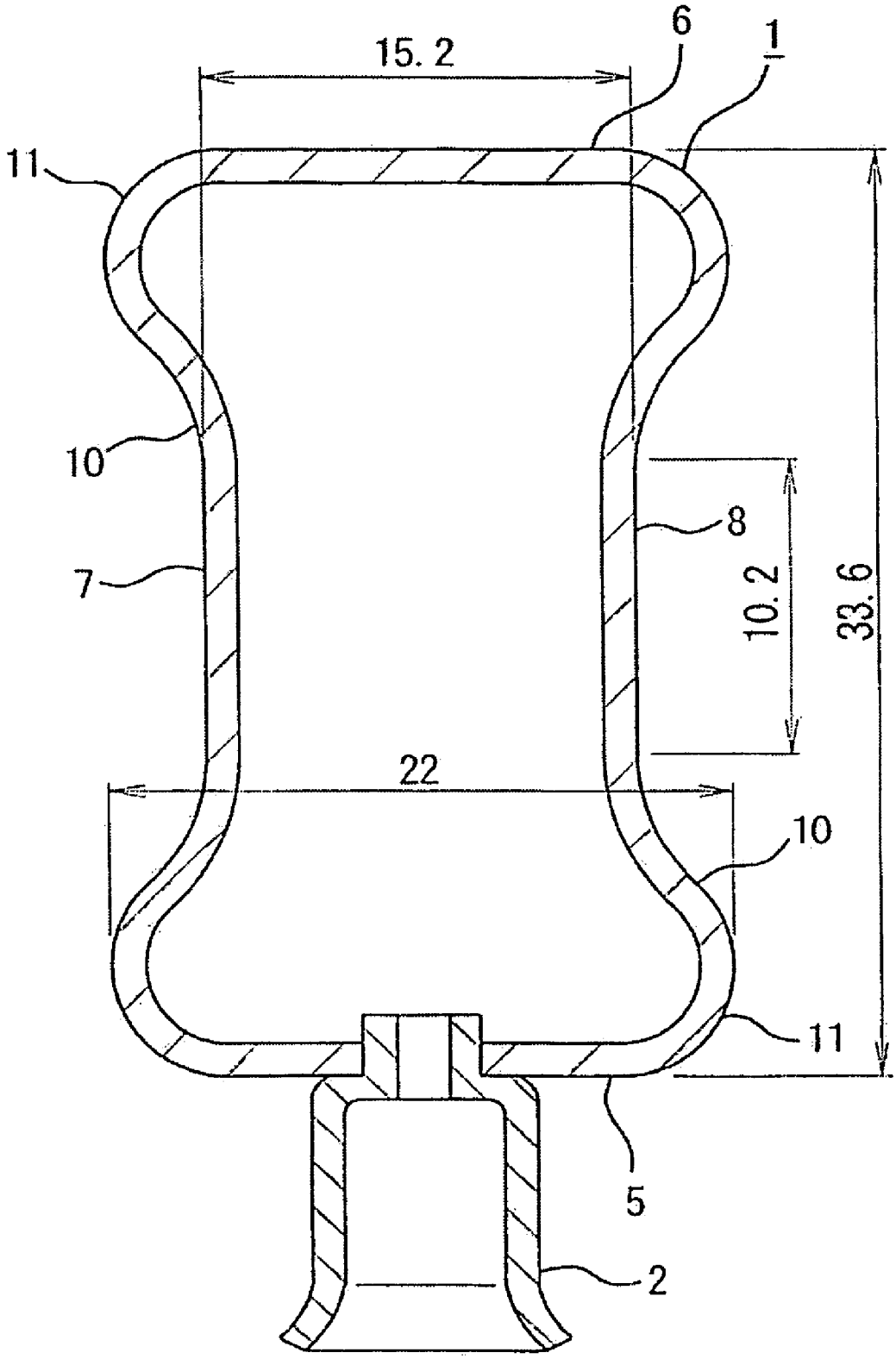
FIG. 2 is a cross-sectional view along a line A—A of FIG. 1.
Figure 3:
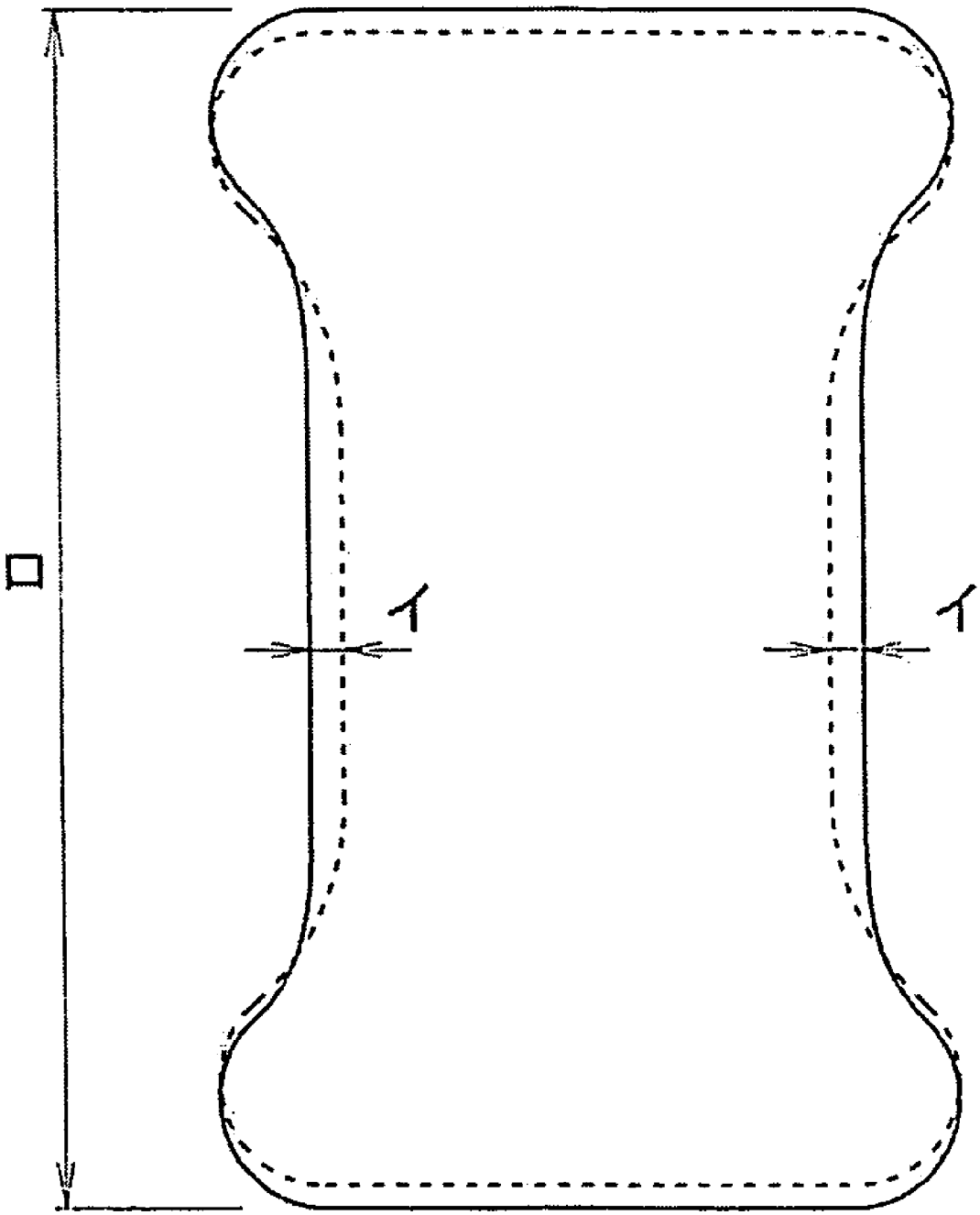
FIG. 3 is a conceptual diagram showing a state where an absorbing wall surface of the fuel delivery body according to the first embodiment yields to a internal pressure to change the internal volume of the fuel delivery body.

Subsequently, where the first embodiment shown in FIG. 1, FIG. 2, and FIG. 3 is described in detail, numeral 1 is a fuel delivery body, where sockets 2 capable of connecting injection nozzles, not shown, are formed on one surface of the fuel delivery body. For example, four sockets 2 are formed with predetermined intervals and angles in a case of a four-cylinder engine. Furthermore, the fuel delivery body 1 has each of ends sealed with an end cap 12, and one end is connected as secured, by means of brazing or welding, to a fuel inlet pipe 3 connected to a fuel tank, not shown, through an underfloor pipe arrangement, not shown. A return pipe for a return to the fuel tank can be formed to the other end or side surfaces of the fuel delivery body 1 but is not formed to the fuel delivery pipe of a returnless type.

Furthermore, fuel in the fuel tank is transferred through the underfloor pipe arrangement to the fuel inlet pipe 3 and then, as an arrow indicates in FIG. 1, flows from the fuel inlet pipe 3 to the fuel delivery body 1, thereby being injected directly into air intake duct or cylinders through the injection nozzle connected to the socket 2. With the fuel delivery pipe 1, a thick and firm bracket 4 for connecting the fuel delivery body 1 securely to an engine body is formed on a side at which the sockets 2 are formed.

The fuel delivery body 1 according to the first embodiment, as shown in FIG. 2, has the cross section in a substantially double side concaved shape, having two flat wall surfaces at short sides and two inwardly bent wall surfaces at long sides. A bottom surface as one side of the flat wall surfaces at the short sides is defined as a lower wall 5 and equipped with the socket 2. The upper surface as the other side of the flat wall surfaces at the short sides, facing the lower wall 5 is defined as an upper wall 6. With a left side wall 7 and a right side wall 8 as wall surfaces at the long sides, coupling the upper wall 6 to the lower wall 5, as shown in FIG. 2, coupling portions of the upper wall 6 and lower wall 5 are formed in an arc shape while the cross section is formed in a substantially double side concaved shape like a hand drum shape, in which a pair of flexible absorbing wall surfaces 10 are formed as bent inwardly to form a trapezoid shape comprising a flat straight side and a pair of hypotenuses. The inwardly bent absorbing wall surface 10 yields outwardly to deform because of a change of internal pressure at the time of a fuel injection via the injection nozzles, thereby being able to increase internal volume of the fuel delivery body 1.

The above described fuel delivery body 1 in a double concaved shape according to the first embodiment is composed of the upper wall 6, the lower wall 5, the left side wall 7, and the right side wall 8, in which the left side wall 7 and the right side wall 8 are couple to the upper wall 6 and the lower wall 5 through an arc shaped curve portions 11. Furthermore, as shown in FIG. 2, the left side wall 7 and the right side wall 8 are inwardly bent to shape a trapezoid shape, thereby being set as the absorbing wall surfaces 10 with a height of 33.6 mm made to face each other with a maximum outer diameter of 22 mm, wherein a length of substantially straight sides of the absorbing wall surface 10 is set to 10.2 mm and an outer diameter between the straight portions of the left side wall 7 and the right side wall 8 is set to 15.2 mm. Furthermore, as shown in Table 1, a thickness is set to 1.2 mm and cross sectional area A inside the fuel delivery body 1 is set to 468 $mm^2$ while the fuel delivery body 1 is formed with a pipe length of 325 mm, whereas the internal volume V is set to 150879 $mm^3$, and the sockets 2 for the injection nozzles are formed, as shown in FIG. 2, to the lower wall 5.

Figure 4:
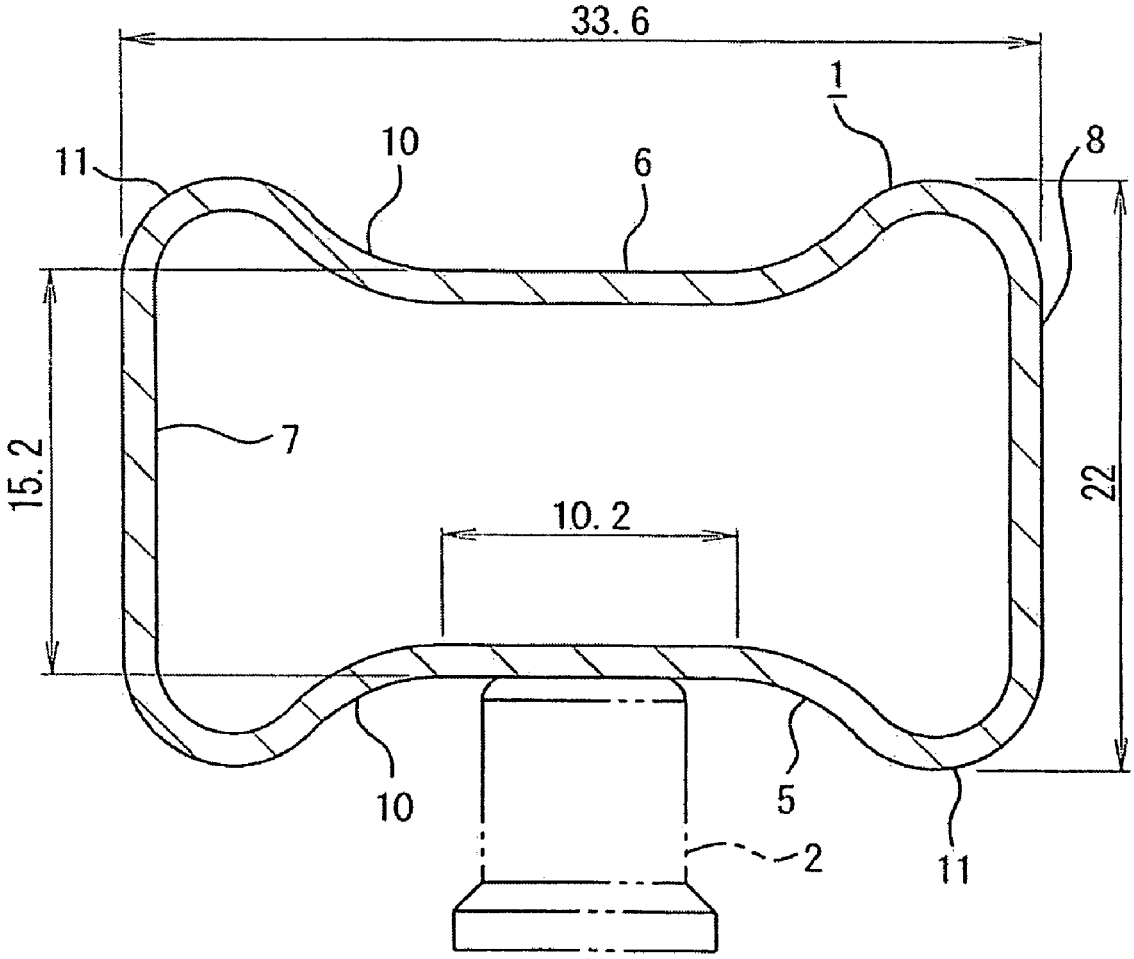
FIG. 4 is an essential cross-sectional view of a fuel delivery body according to the second embodiment, and a cross section shape is in a double side concaved shape.

In the second embodiment shown in FIG. 4, the fuel delivery body 1 is defined as a horizontally long shape, wherein the formation width between the upper wall 6 and the lower wall 5 is set to 33.6 mm, and the height of the left side wall 7 and the right side wall 8 coupled to the upper wall 6 and the lower wall 5 through the arc shape curve portions 11 is set to 22 mm. The upper wall 6 and the lower wall 5, furthermore, are respectively bent inwardly to shape the trapezoid shape, thereby forming a pair of the absorbing wall surfaces 10. A length of the substantially straight sides of a pair of the absorbing wall surfaces 10 is set to 10.2 mm, and the outer diameter between the straight portions of the upper wall 6 and the lower wall 5 is set to 15.2 mm. As shown in the table 1, a thickness is set to 1.2 mm and a cross sectional area A inside the fuel delivery body 1 is set to 468 mm while the fuel delivery body 1 is formed with a pipe length of 325 mm, whereas the internal volume V is set to 150879 $mm^3$, and the socket 2 for the injection nozzle is formed to the lower wall 5 as a chain double-dashed line indicates in FIG. 4.

Figure 5:
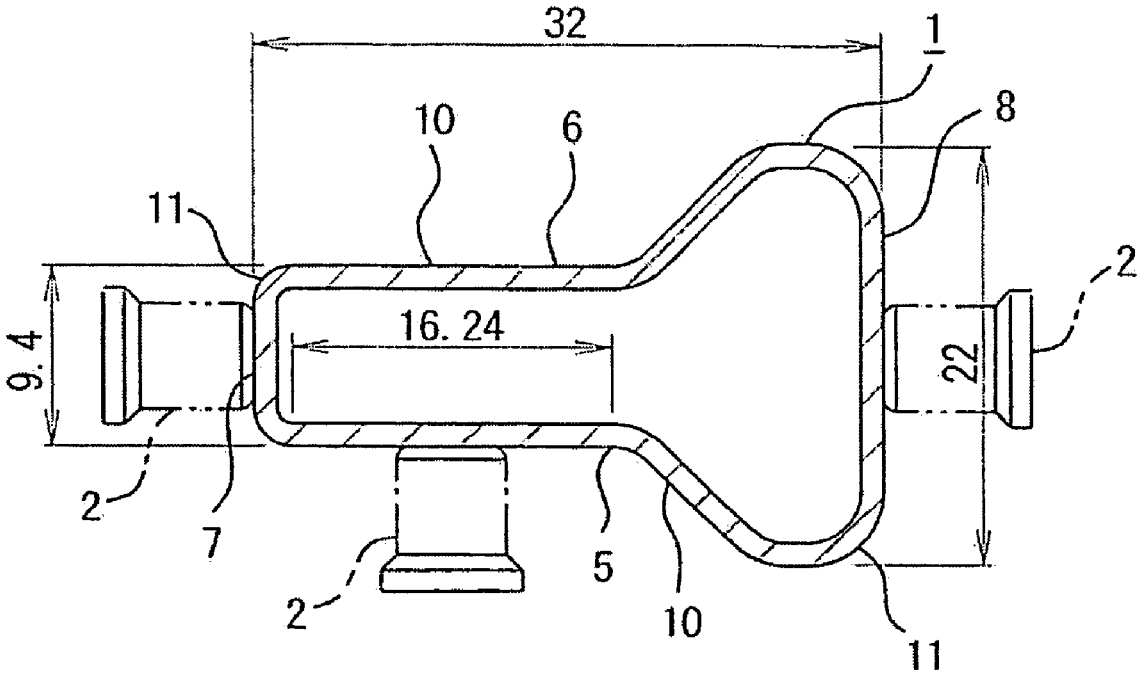
FIG. 5 is an essential cross-sectional view of a fuel delivery body in a flask shape according to the third embodiment.

The fuel delivery body 1 according to another embodiment, the third embodiment, as shown in FIG. 5, is in the flask shape, wherein a substantially rectangular shape is mounted on a top side of the trapezoid, and the upper wall 6 and the lower wall 5 are formed as bent inwardly to form the absorbing wall surfaces 10 while the left side wall 7 and the right side wall 8 are the substantially straight sides, whereas the cross section shape of the fuel delivery body 1 is formed in a horizontally long flask shape. Furthermore, the heights of the left side wall 7 and the right side wall 8 are respectively set to 9.4 mm and 22 mm, and the outer diameter between the left side wall 7 and the right side wall 8 is set to 32 mm. The left side wall 7 and the right side wall 8 are formed as coupled through the arc shape curve portions 11 to the upper wall 6 and the lower wall 5 respectively composed of the substantially straight side and the hypotenuse. With the upper wall 6 and the lower wall 5, a length of the substantially straight sides at a side of the left side wall 7 is set to 16.24 mm. Furthermore, as shown in the table 1, a thickness is set to 1.2 mm to set a cross sectional area A inside the fuel delivery body 1 to 289 $mm^2$ while the fuel delivery body 1 is formed with a pipe length of 325 mm, whereas the internal volume V is set to 93097 $mm^3$, and the sockets 2 for the injection nozzles are formed at the side of the substantially straight side of the lower wall 5 as a chain-dashed line indicates in FIG. 5.

Figure 6:
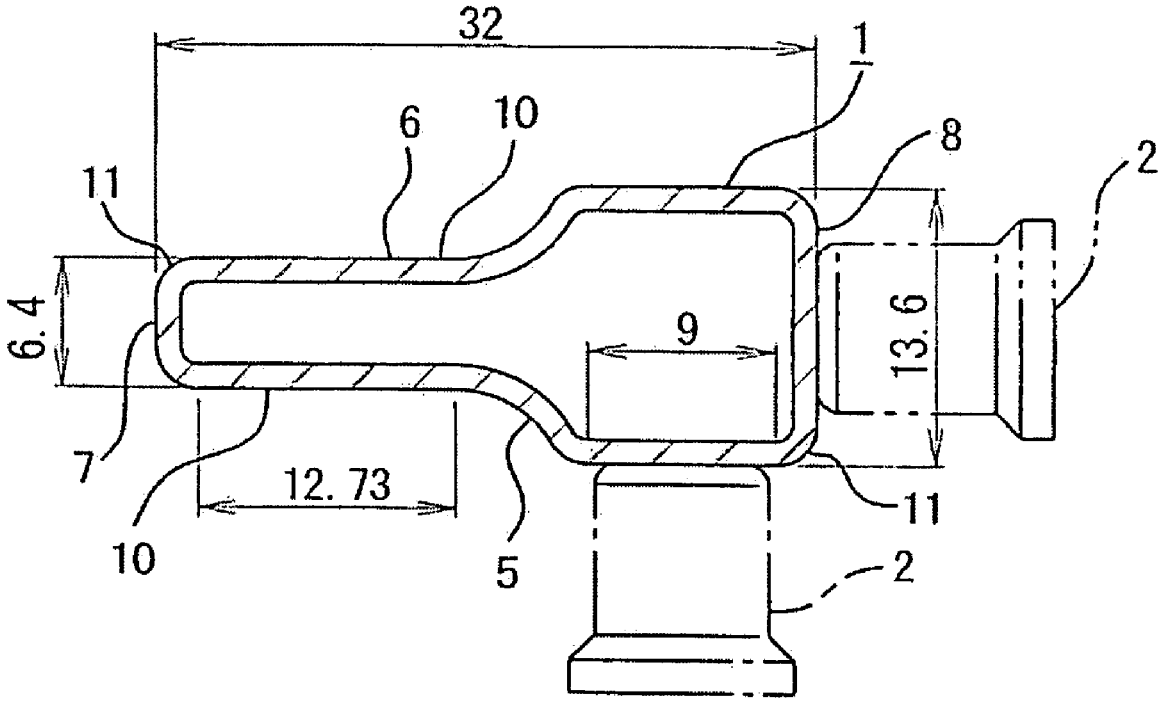
FIG. 6 is an essential cross-sectional view of a fuel delivery body in a key shape according to the fourth embodiment.
Figure 7:
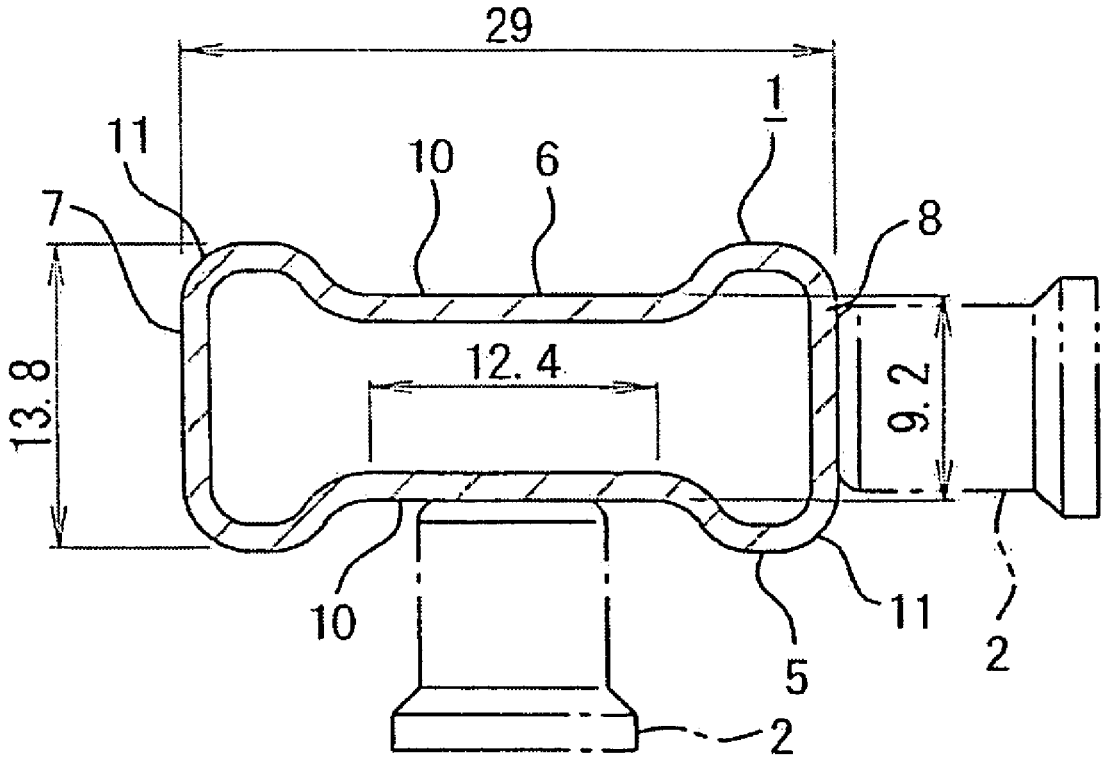
FIG. 7 to FIG. 13 are essential cross-sectional views of a fuel delivery body in the double side concaved shape according to the fifth embodiment to the eleventh embodiment.
Figure 8:
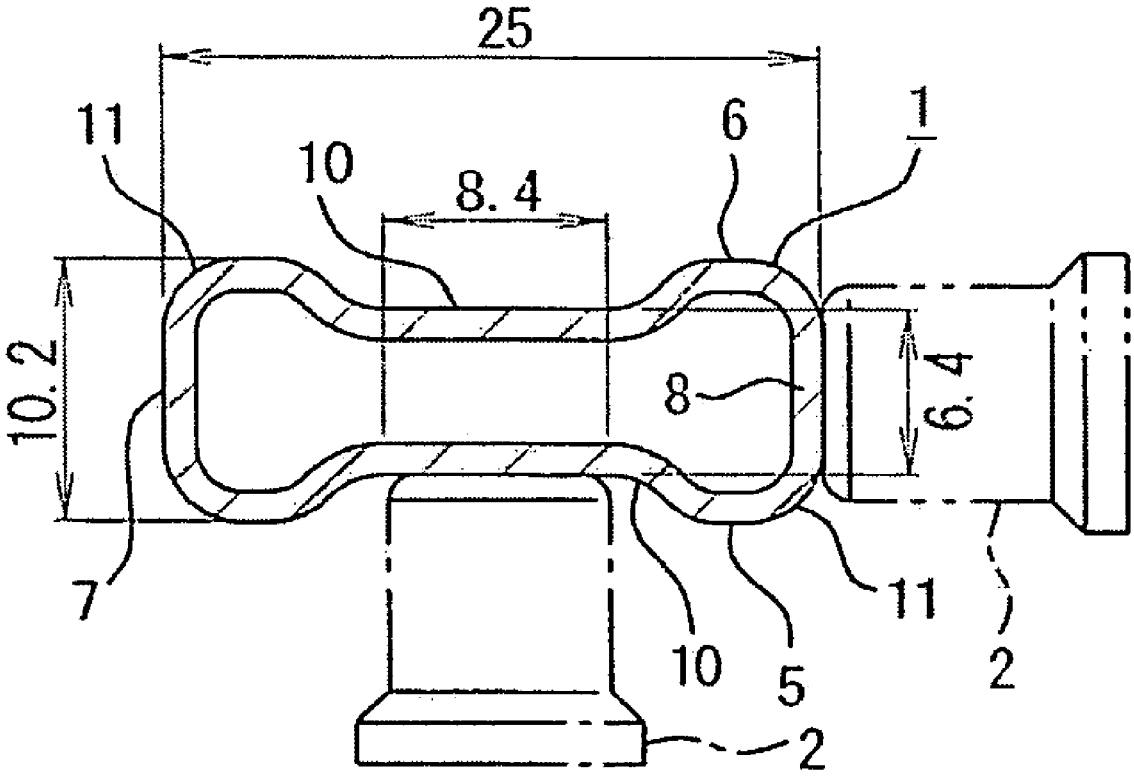
Figure 9:
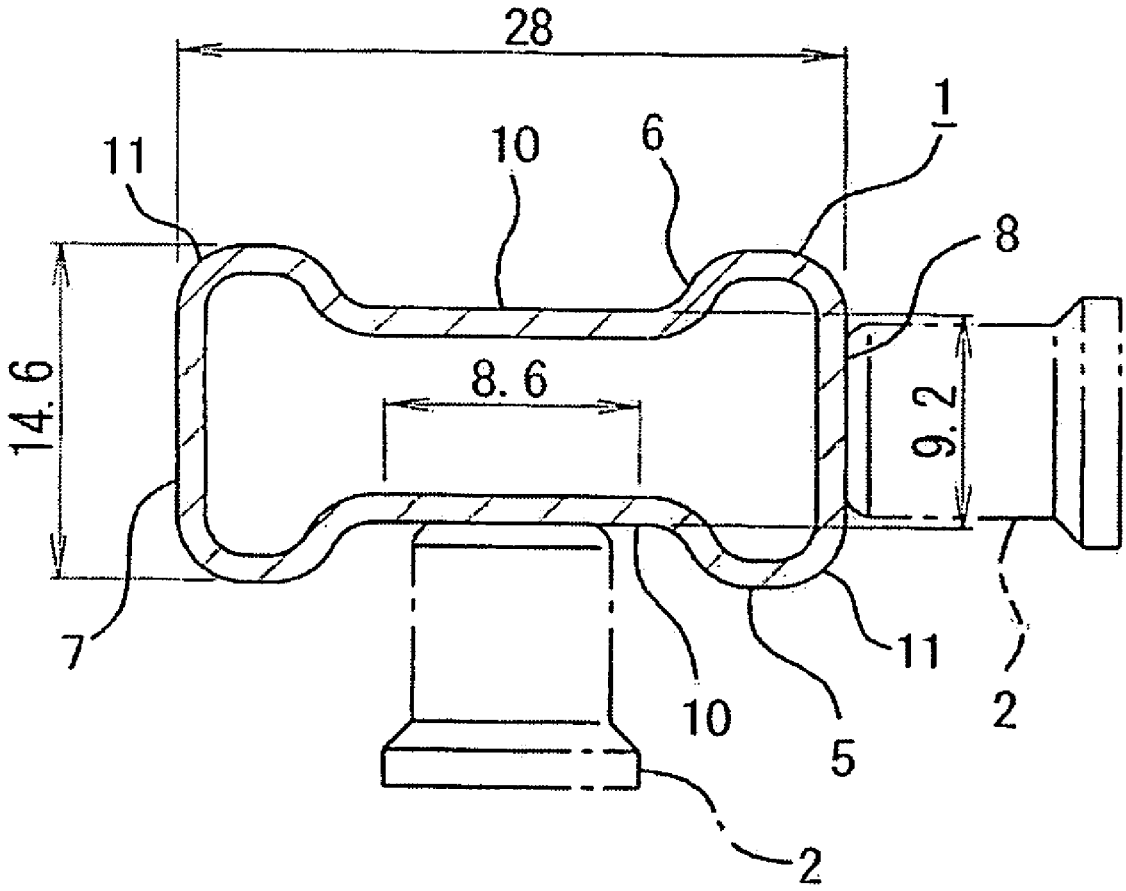
Figure 10:
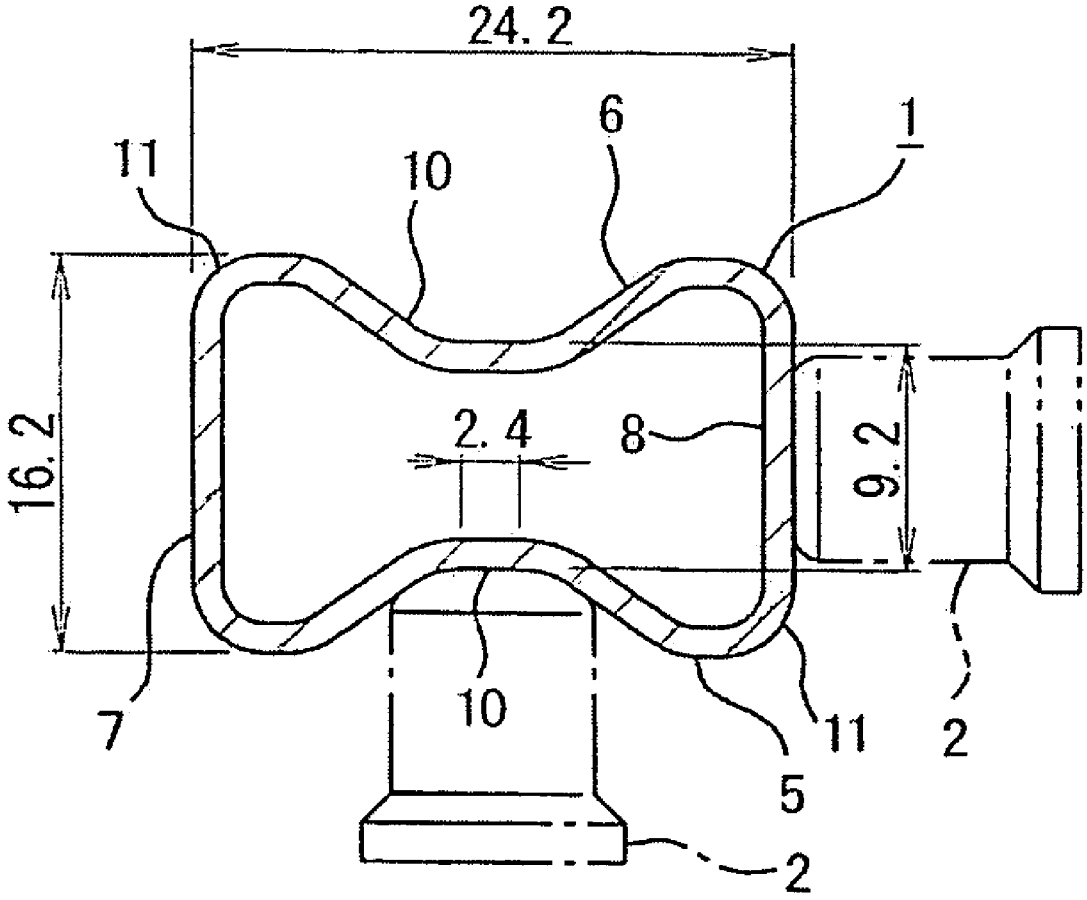

The fuel delivery body 1 according to another embodiment, the fourth embodiment, as shown in FIG. 6, is in a key shape, wherein two rectangular shapes of large and small sizes are combined, and the upper wall 6 and the lower wall 5 are formed as bent inwardly to be form absorbing wall surfaces 10 while the left side wall 7 and the right side wall 8 are substantially straight sides, whereas the cross section shape of the fuel delivery body 1 is formed as arranged in a horizontally long key shape. Furthermore, the heights of the left side wall 7 and the right side wall 8 are respectively set to 6.4 mm and 13.6 mm, and the formation width between the upper wall 6 and the lower wall 5 is set to 32 mm. The upper wall 6 and the lower wall 5 are formed by coupling, through hypotenuses, the substantially straight sides with a length of 12.73 formed at the side of the left side wall 7 to the substantially straight sides with a length of 9 mm formed at the side of the right side wall 8, and both end portions of each of the left side wall 7 and the right side wall 8 are couple to the upper wall 6 and the lower wall 5 through the arc shape curve portions 11. As shown in the table 1, a thickness is set to 1.2 mm to set a cross sectional area A inside the fuel delivery body 1 to 205 mm while the fuel delivery body 1 is formed with a pipe length of 325 mm, whereas the internal volume V is set to 66155 $mm^3$, and the sockets 2 for the injection nozzles are formed at the upper wall 5, i.e., at the substantially straight side with a length of 9 mm at the side of the right side wall 8. Though the table 1 shows data in a case of the fuel delivery bodies 1 arranged as shaped in a horizontally long flask shape as the third embodiment and in a horizontal long key shape as the fourth embodiment, it is also possible to use the fuel delivery body 1 arranged as shaped in a vertically long flask shape or key shape, in which, as the chain double-dashed lines in FIG. 4 and FIG. 5 indicate, the sockets 2 are formed to either the left side wall 7 or to the right side wall 8 and the wall having the sockets 2 is exposed to an lower side. With the third embodiment as shown in FIG. 5, it is to be noted that where the socket 2 are formed to the left side wall 7, the fuel delivery body 1 becomes to be in a reverted flask shape.

Figure 11:
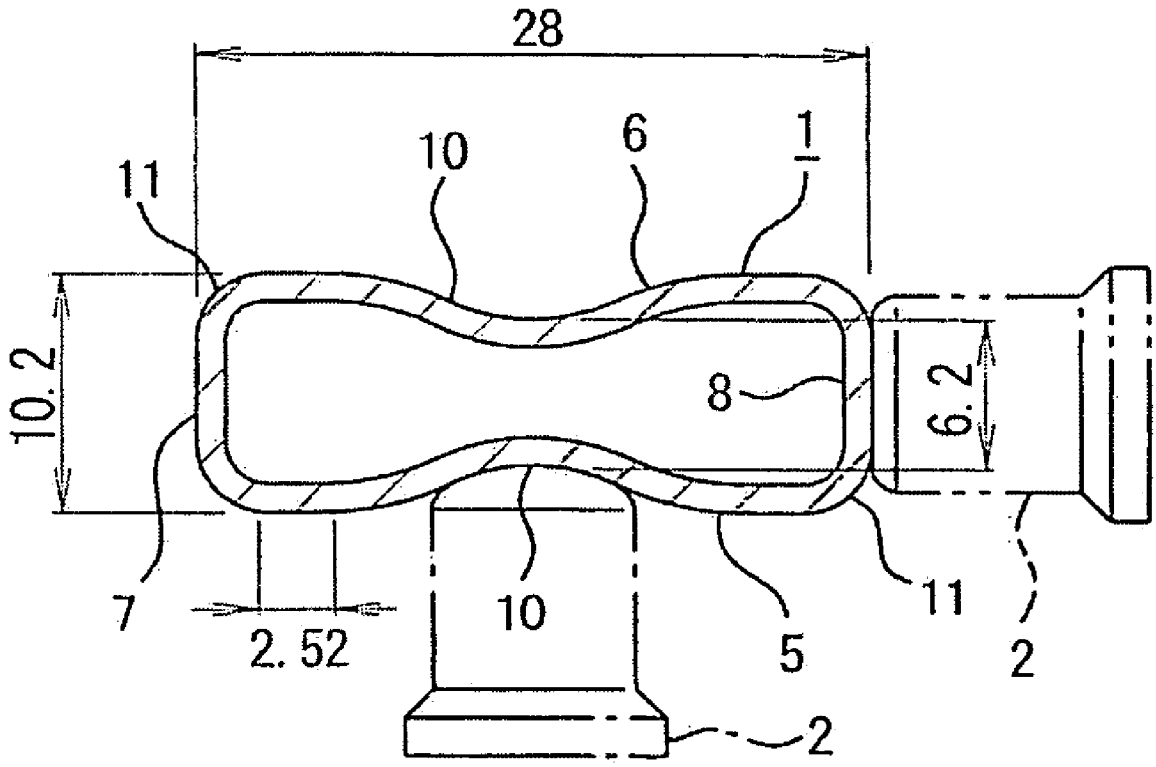
Figure 12:
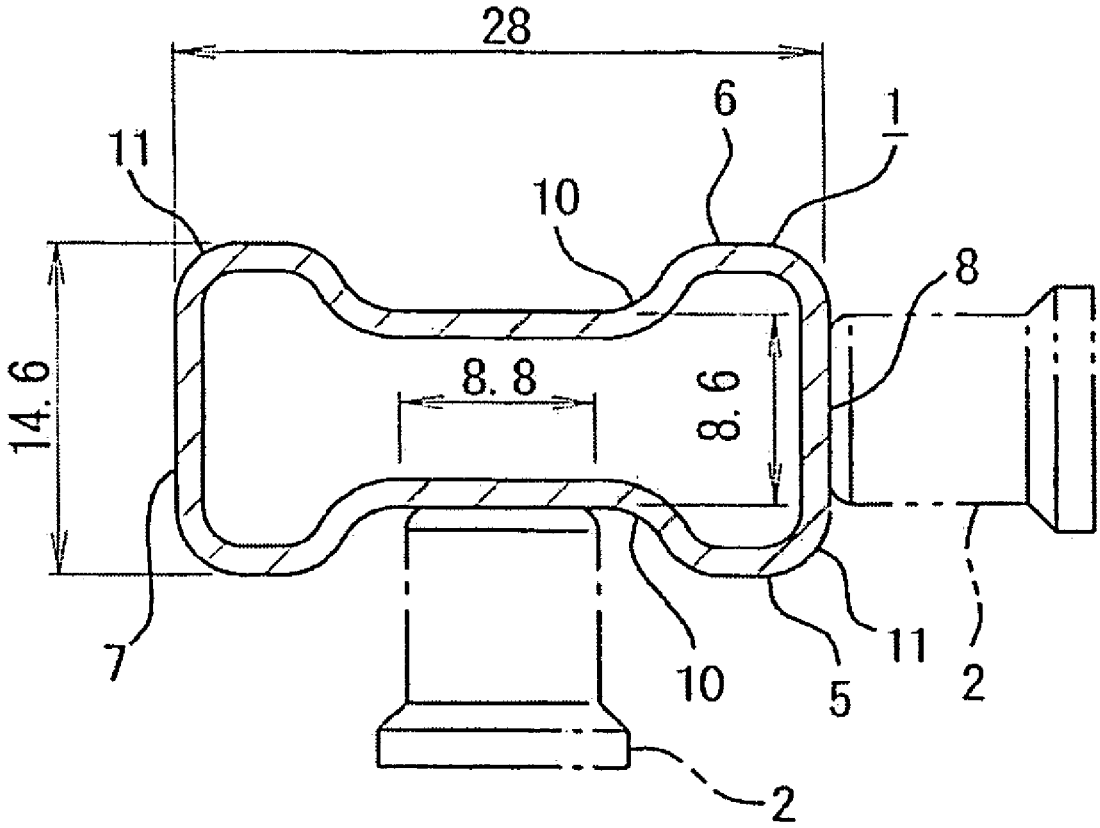
Figure 13:
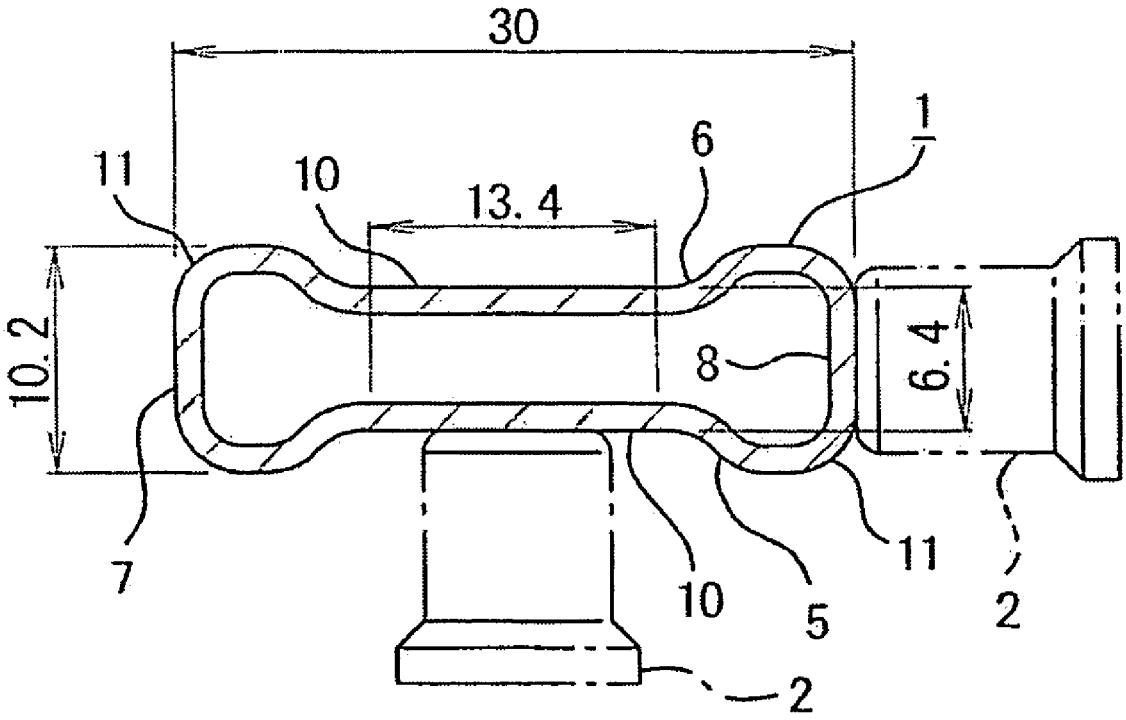
Figure 14:
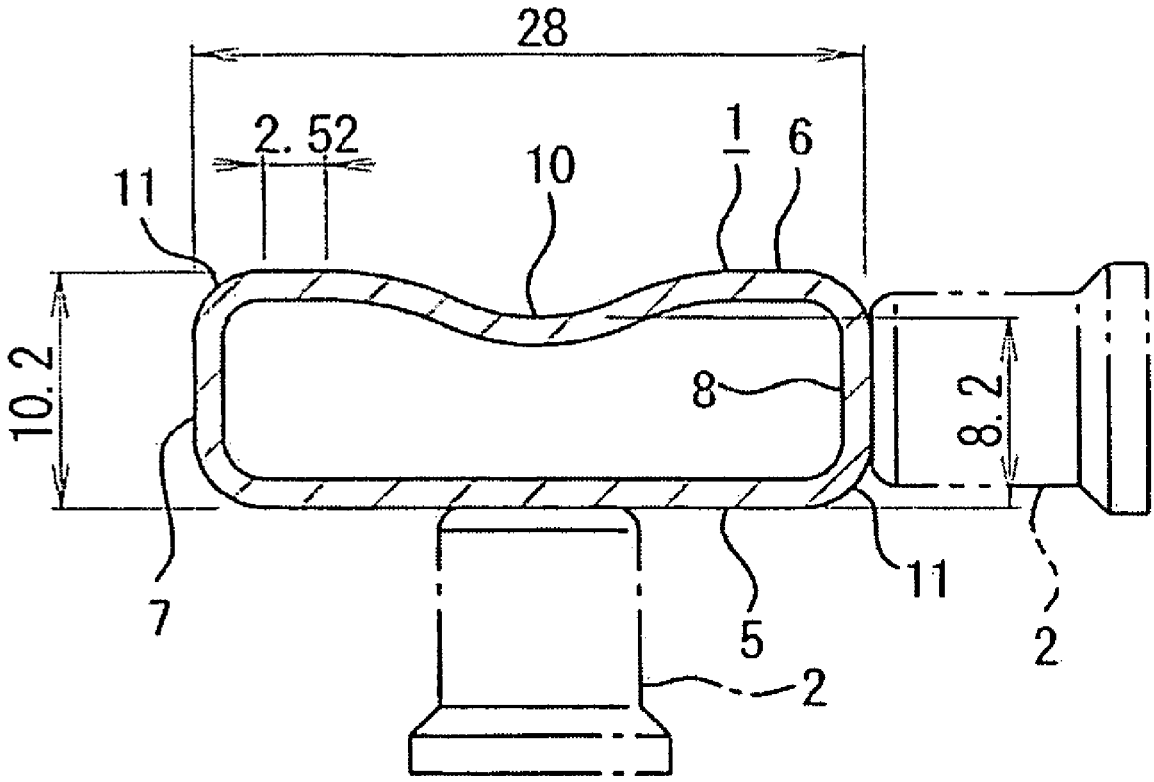
FIG. 14 to FIG. 19 are essential cross-sectional views of a fuel delivery body in a goggles shape according to the twelfth embodiment to the seventeenth embodiment.
Figure 15:
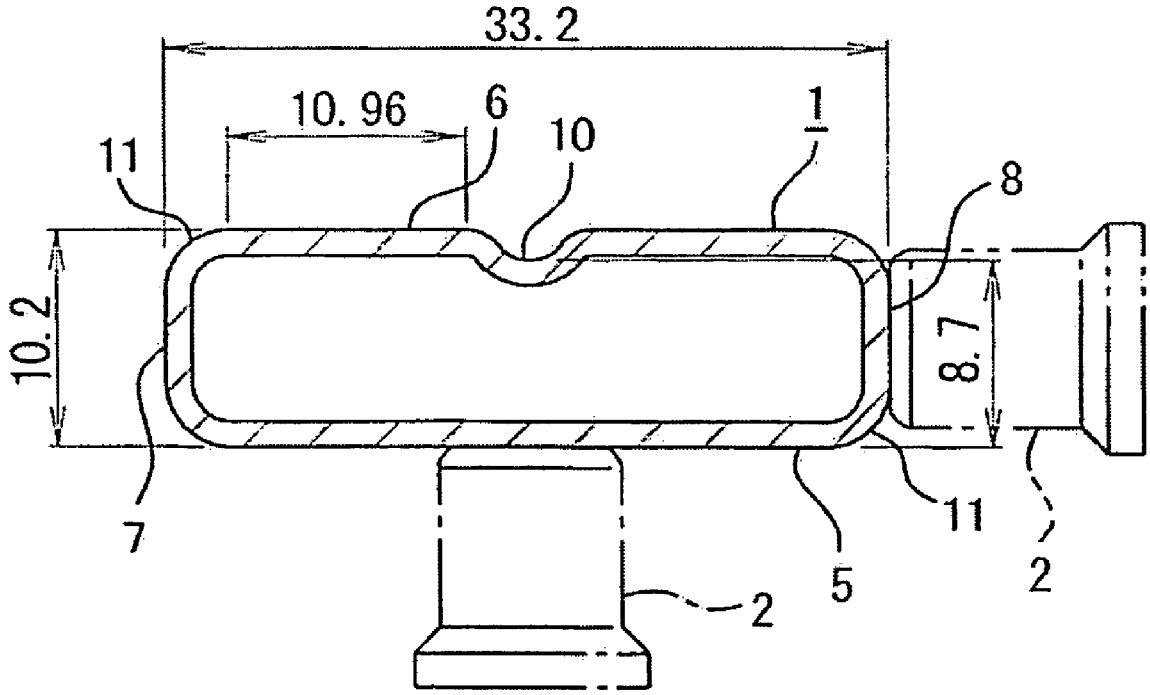
Figure 16:
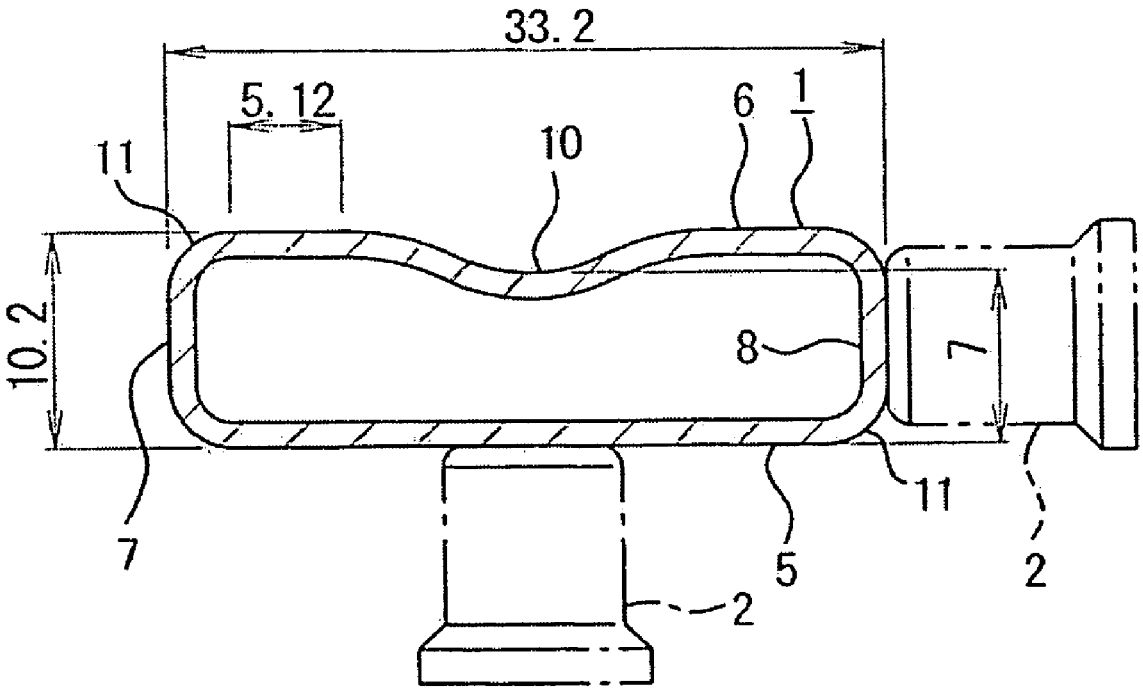
Figure 17:
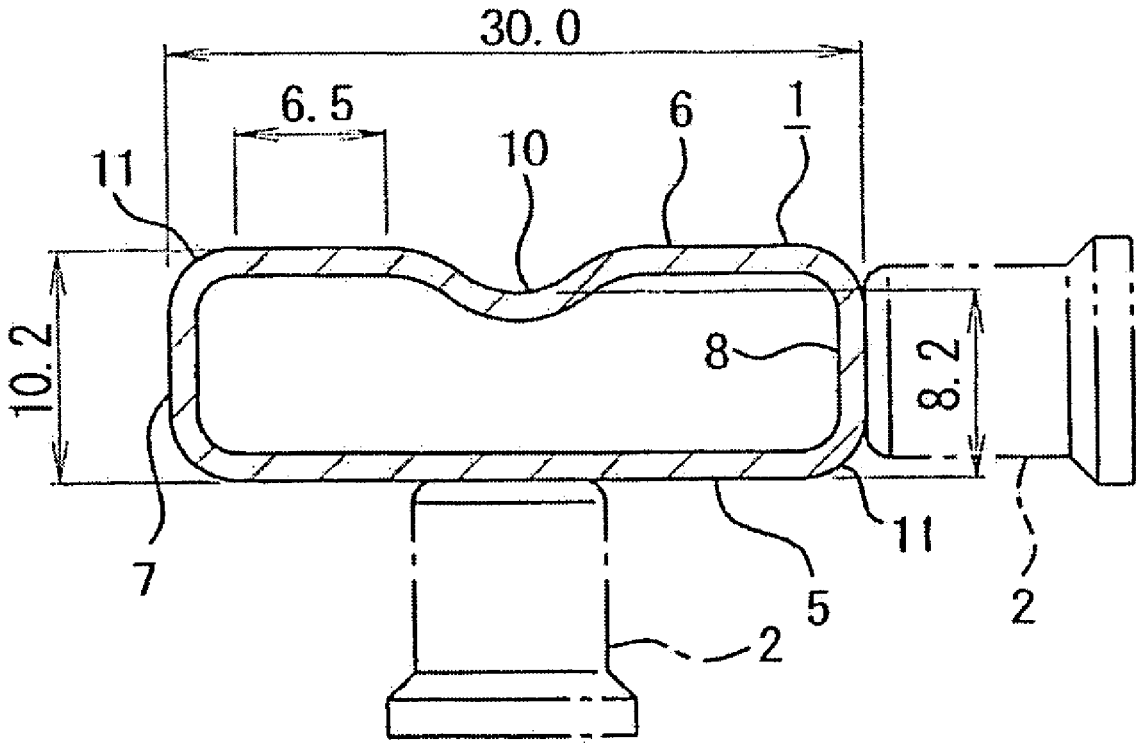

Hereinafter, FIG. 7 to FIG. 13 show the fifth embodiment to the eleventh embodiment, all of which are the fuel delivery bodies 1 in the double side concaved shape. It is to be noted that the ninth embodiment shown in FIG. 11 is in the double side concaved shape, wherein center portions of the wall surfaces at the long sides are in an arc shape while the fifth embodiment to the eighth embodiment, the tenth embodiment, and the eleventh embodiment shown in FIG. 7 to FIG. 10, FIG. 12, and FIG. 13 are in the same double side concaved shape like the substantially hand drum shape as the first embodiment, wherein the flat straight sides are formed at the centers of the wall surfaces at the long sides. Each of the drawings shows the cross section shape and the dimension of the outer diameter, while a thickness, a cross sectional area A, the internal volume V, and a pipe length thereof are as shown in the table 1. As shown in each of the drawings, the fifth embodiment to the eleventh embodiment are arranged to be in the horizontally long shape, wherein the absorbing wall surfaces 10 are arranged to the upper wall 6 and the lower wall 5 while, as the chain-dashed line shows, the upper wall 6 is formed as equipped with the socket 2 for the injection nozzle, and measurement of the sonic speed or the like shown in table 1 is done. However, it is also possible to use the fuel delivery body 1 arranged as shaped in the vertically long shape in both upward and downward directions, in which, as the chain double-dashed lines indicate, the sockets 2 are formed to either the right side wall 8 or the left side wall 7 and the wall having the sockets 2 is exposed to the lower side.

Figure 18:
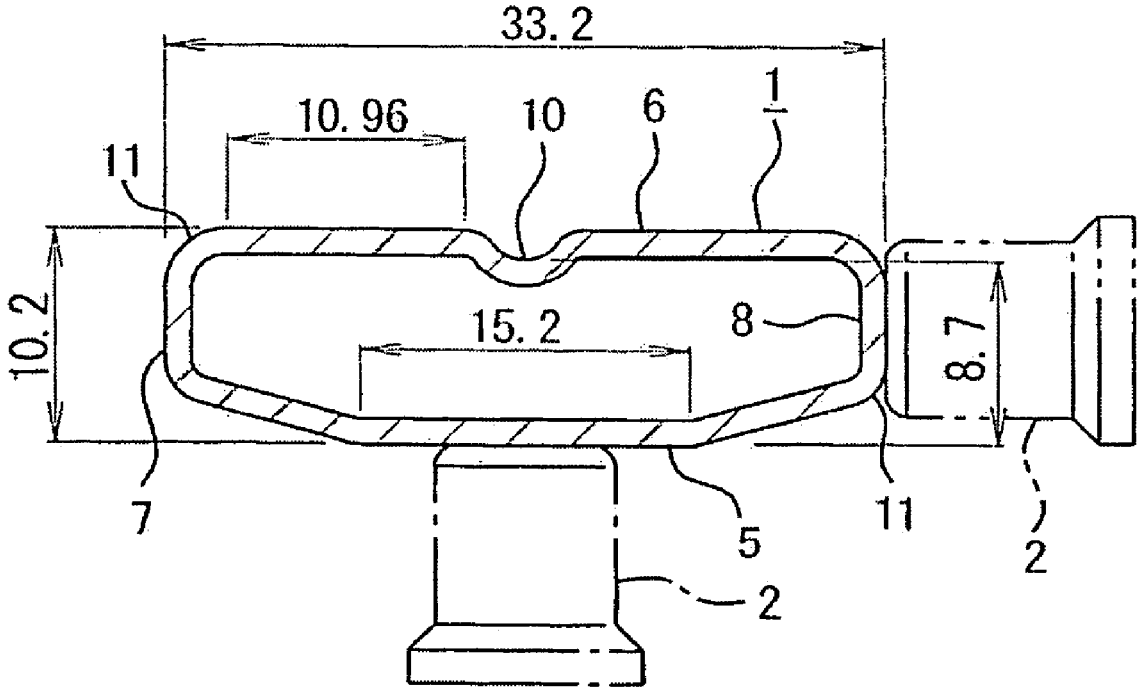
Figure 19:
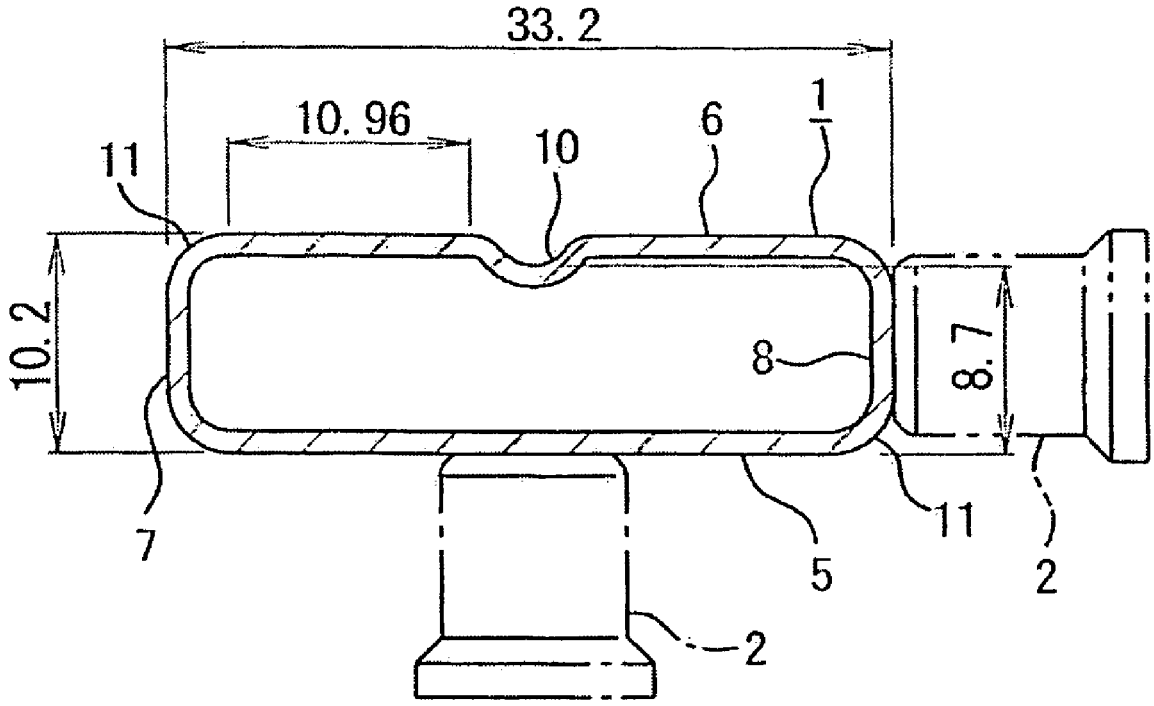
Figure 20:
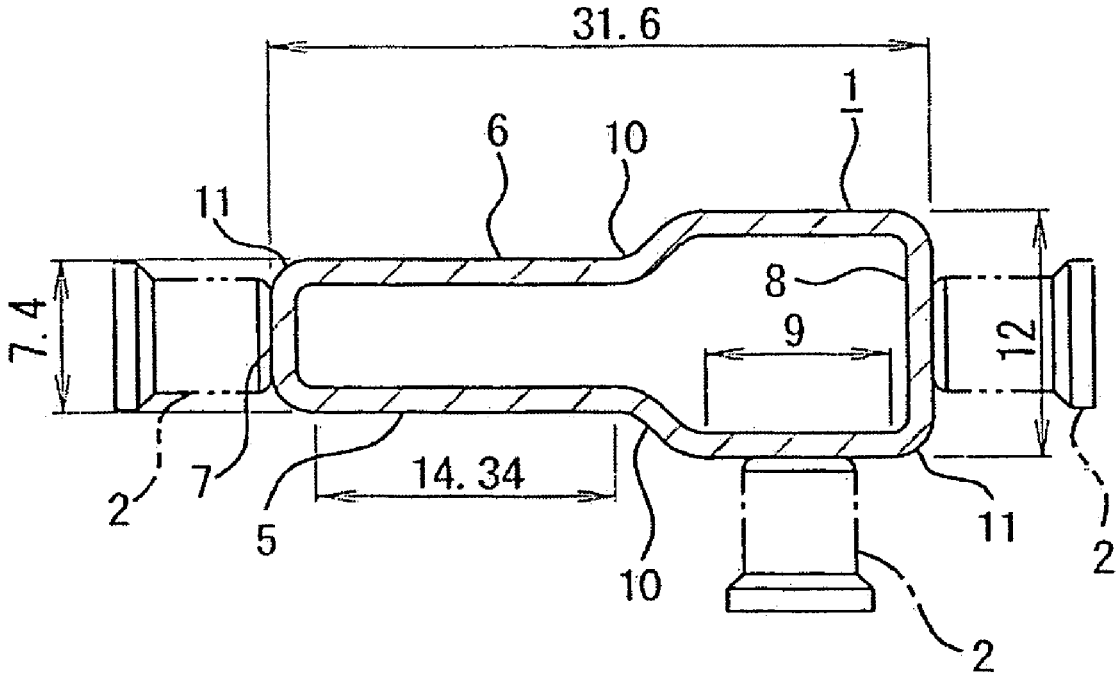
FIG. 20 to FIG. 23 are essential cross-sectional views of a fuel delivery body in the key shape according to the eighteenth embodiment to the twenty-first embodiment.
Figure 21:
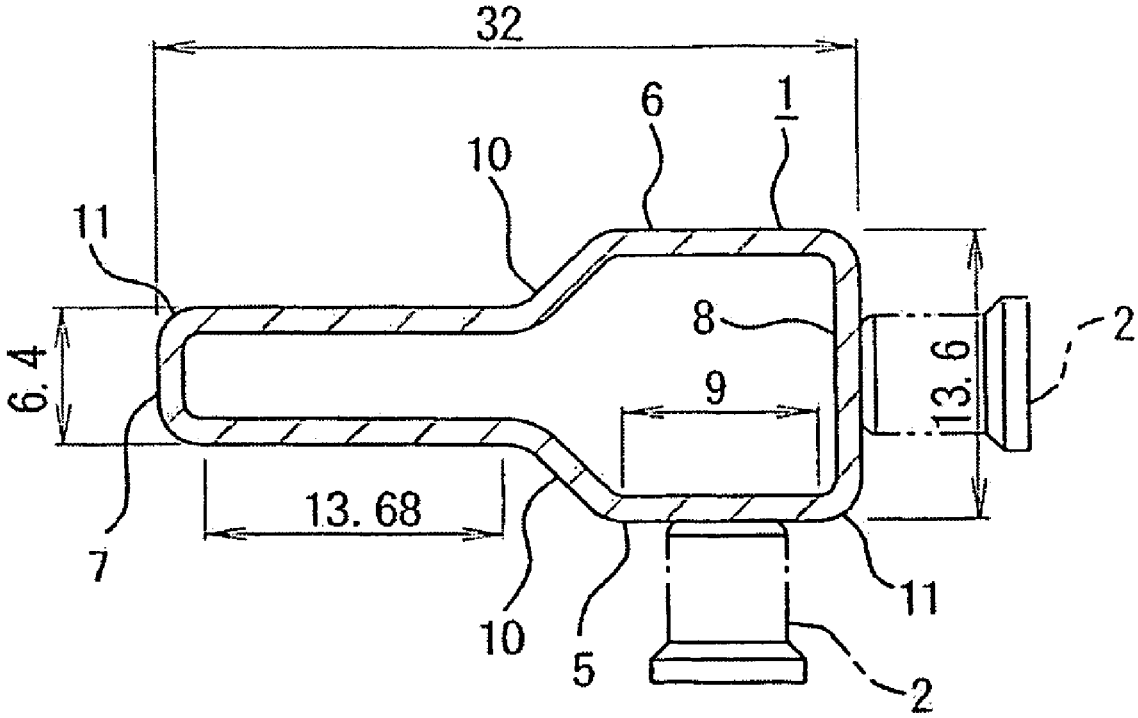
Figure 22:
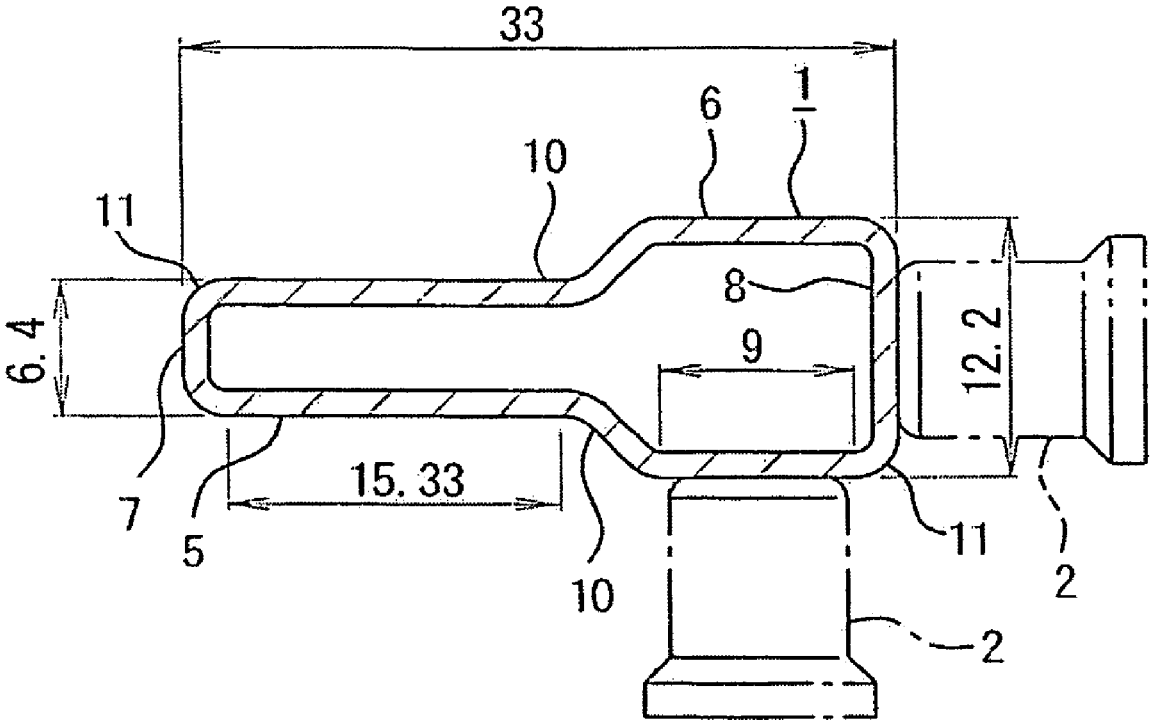
Figure 23:
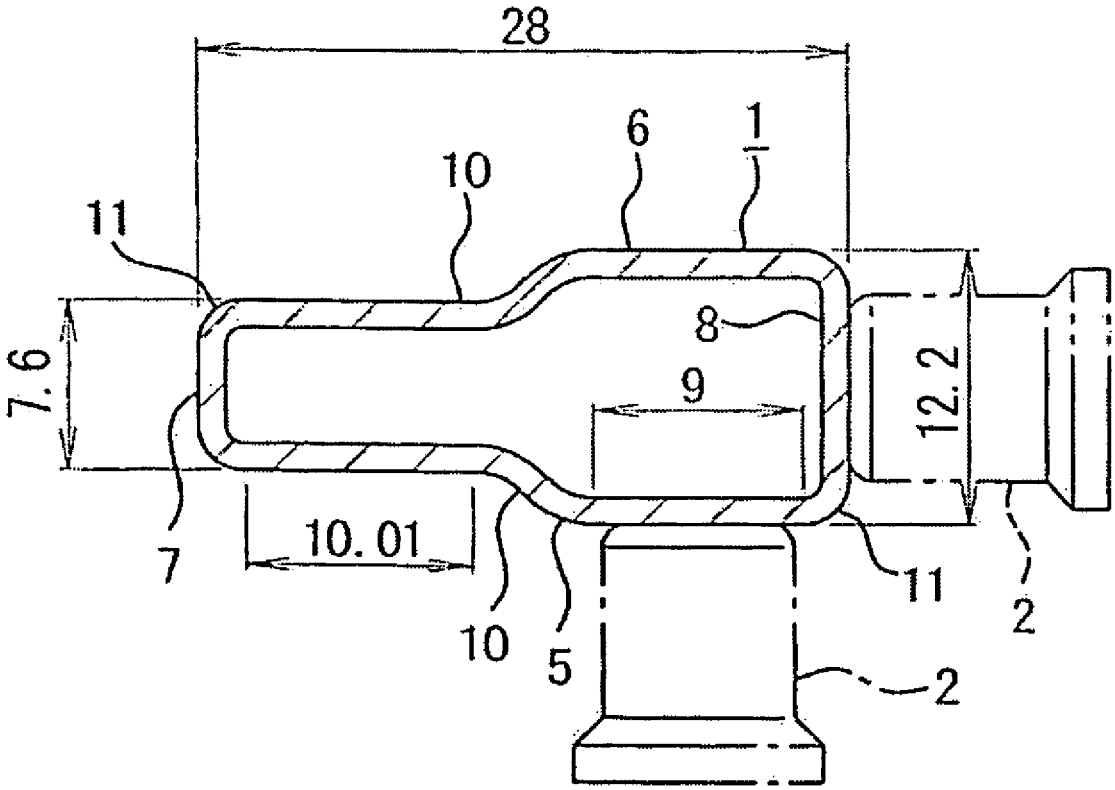

The twelfth embodiment to the seventeenth embodiment shown in FIG. 14 to FIG. 19 are in the rectangular shape comprising two wall surfaces at the long sides and two wall surfaces at the short sides, in which the center portion of the upper wall 6 as the one side of two wall surfaces at the long sides is formed as curved inwardly to form the concaved shape, thereby forming the absorbing wall surface 10, whereas the cross section of the fuel delivery body 1 is set to be in a goggles shape. Each of the drawings shows the cross section shape and the dimension of the outer diameter, while a thickness, a cross sectional area A, the internal volume V, and a pipe length thereof are as shown in the table 1. Herein, the dimension of the outer diameter of seventeenth embodiment shown in FIG. 19 is same as that of the thirteenth embodiment but, as shown in the table 1, a thickness, a cross sectional area A, and the internal volume V of the thirteenth embodiment are respectively set to 1.2 mm, 234 $mm^2$, and 78993 $mm^3$ while a thickness of the seventeenth embodiment is set to 1.0 mm to set a cross sectional area V and the internal volume V thereof to 250 $mm^2$ and 84567 $mm^3$. With each of the embodiments, as shown in the drawings, the socket 2 for the injection nozzle is formed, as the chain dashed line indicates, to the lower wall 5 on the side opposite to the upper wall 6 having the curved side in a concaved shape. In a case of the fuel delivery body 1 in the goggles shape, in like manner, the fuel delivery body 1 may also be used in a state of being arranged in the vertically long shape in both upward and downward directions, in which the sockets 2 for the injection nozzles may also be formed, as the chain double-dashed lines indicate, to either the right side wall 8 or to the left side wall 7 and the wall having the sockets is exposed to the lower side.

With the fuel delivery body 1 as the sixteenth embodiment shown in FIG. 18, the lower wall 5 as the one side of the wall surfaces at the long sides is formed as outwardly extending though with the fuel delivery bodies 1 in the goggles shape shown in FIG. 14 to FIG. 17 and FIG. 19, the upper wall 6 and the lower wall 5 as the wall surfaces at the long sides are formed in parallel with each other.

Figure 24:
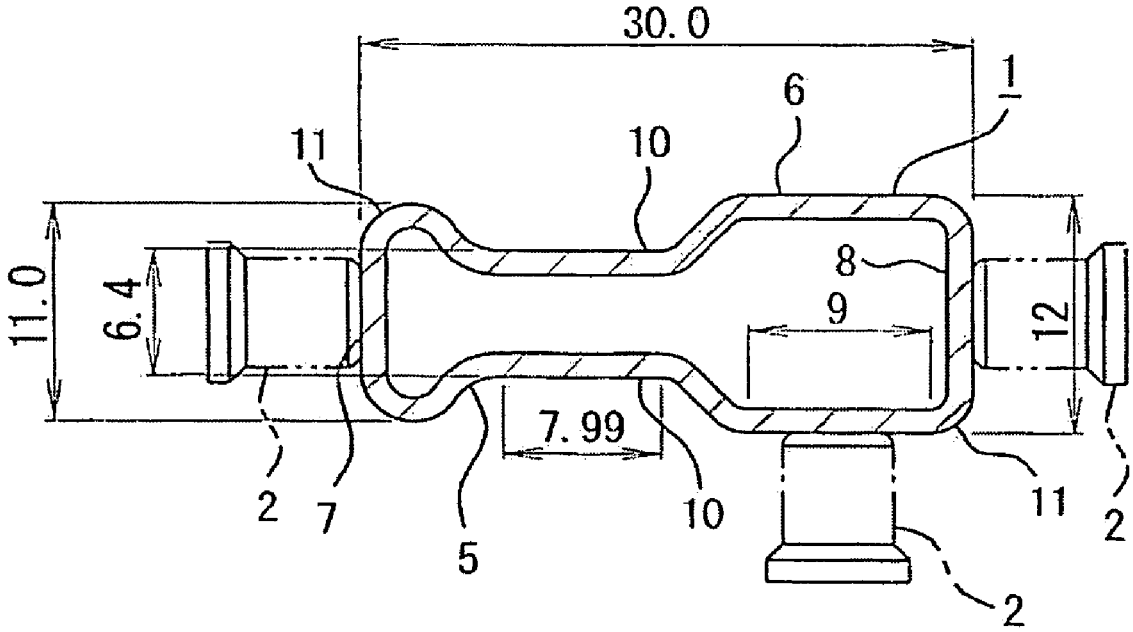
FIG. 24 is an essential cross-sectional view of a fuel delivery body in the double side concaved shape according to the twenty-second embodiment.
Figure 25:
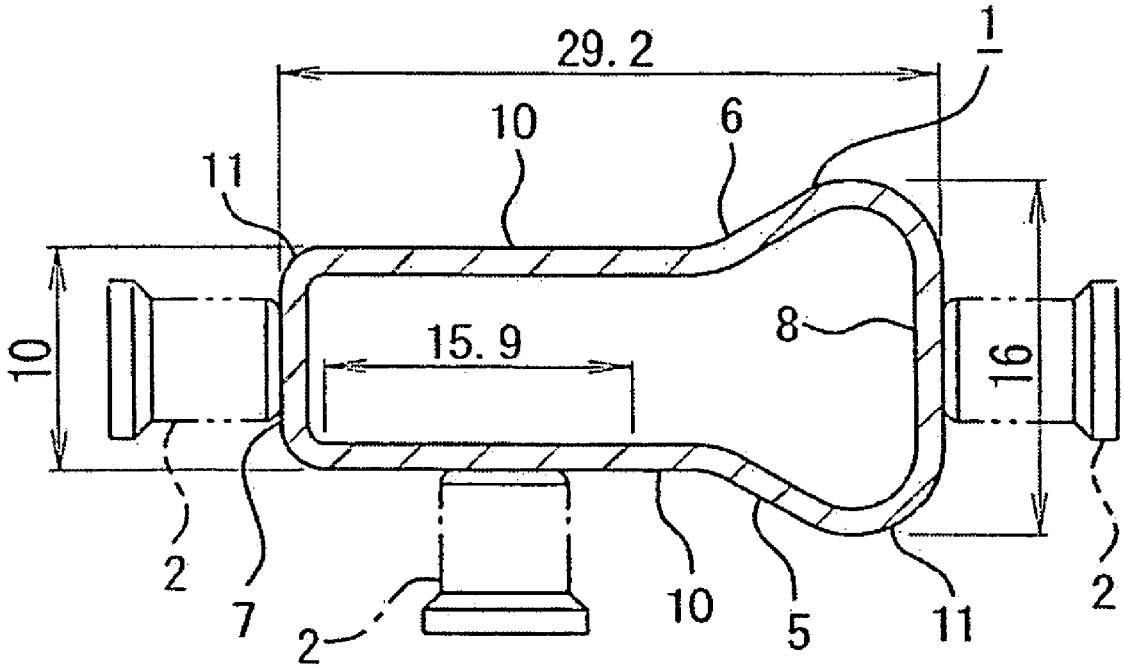
FIG. 25 to FIG. 27 are essential cross-sectional views of a fuel delivery pipe in the flask shape according to the twenty-third embodiment to the twenty-fifth embodiment.
Figure 26:
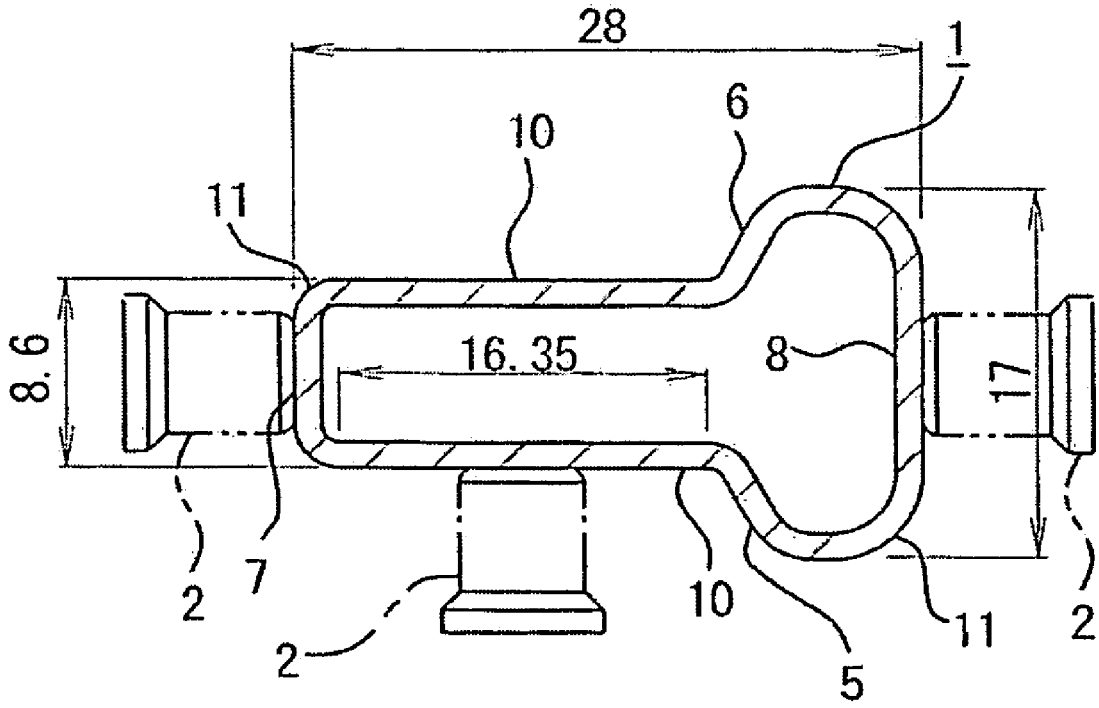
Figure 27:
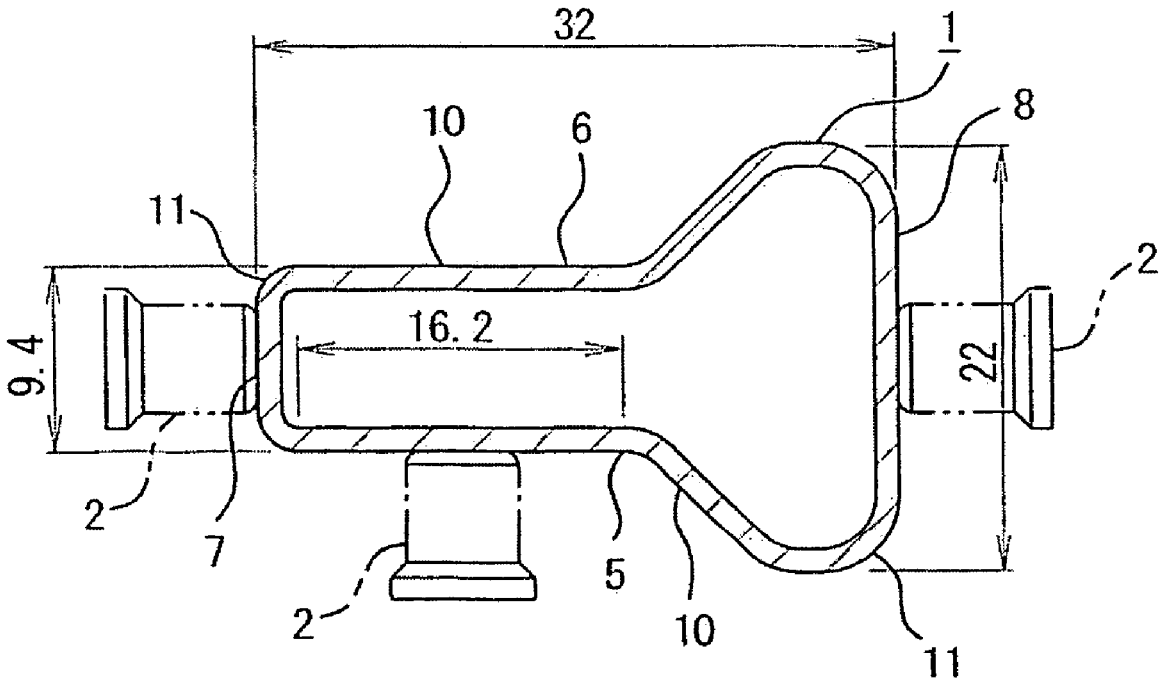

Furthermore, the eighteenth embodiment to the twenty-first embodiment shown is FIG. 20 to FIG. 23 are the fuel delivery bodies 1 in the key shape; the twenty-second embodiment shown in FIG. 24 is the fuel delivery body 1 in the double side concaved shape; and the twenty-third to the twenty-five embodiment shown in FIG. 25 to FIG. 27 are the fuel delivery bodies 1 in the flask shape, and each of the drawings shows the cross section shape the dimension of the outer diameter while the table 1 shows a thickness, a cross sectional area A, the internal volume V, and a pipe length. Regarding to the eighteenth embodiment to the twenty-fifth embodiment, in like manner, the table shows the data in a case where the fuel delivery body 1 is arranged as horizontally long shaped, in which the socket 2 is formed to the position indicated by the chain-dashed line. However, the above fuel delivery body 1 may be arranged as vertically long shaped in both upward and downward directions, and in that case, the fuel delivery body 1 is used in a state where the sockets 2 are formed, as the chain double-dashed line indicates, to the right side wall 8 exposed to the lower side. Furthermore, where the fuel delivery body 1 has comparatively long left side wall 7, e.g., the eighteenth embodiment, the twenty-second embodiment, the twenty-third embodiment, the twenty-fourth embodiment, and the twenty-fifth embodiment, the fuel delivery body 1 can be used in state where the sockets 2 are formed to the left side wall 7 which is arranged as exposed to the lower side.

It is possible to determine, based on the FEM analysis with use of the above described expressions, the sonic speed $\alpha_L$, shown in the table 1, of the fuel flowing through the interior of the fuel delivery body 1 as the first embodiment to the twenty-fifth embodiment and the first conventional example to the sixth conventional example.

Figure 34:
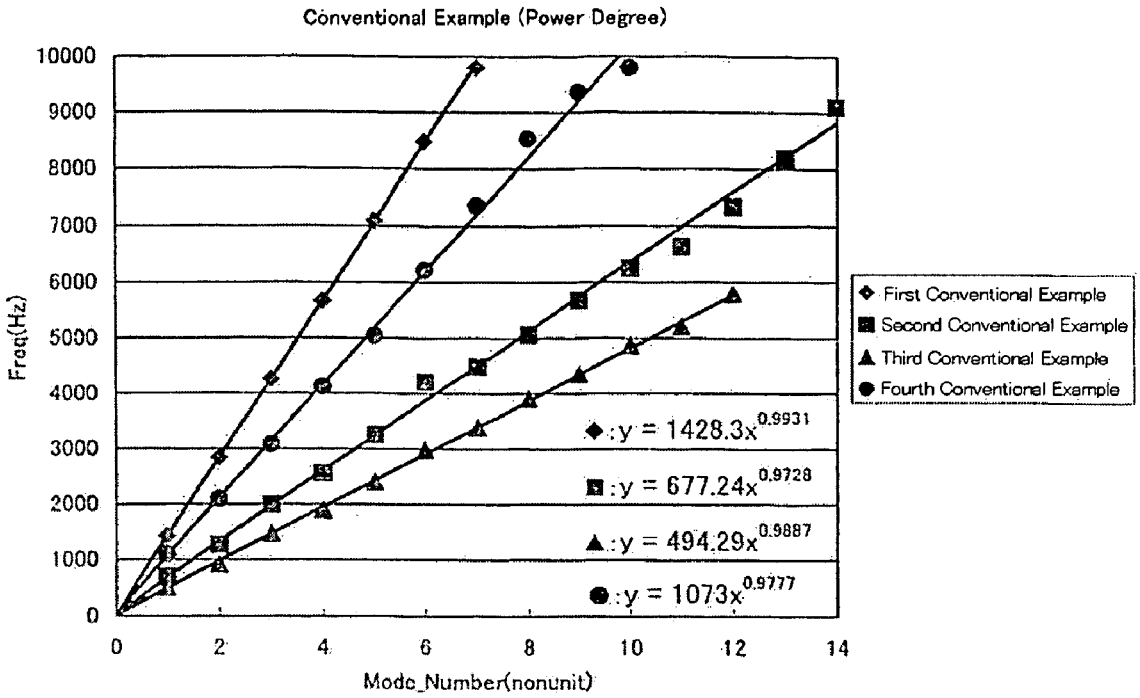
FIG. 34 is a correlation graph of the number of modes of an air column vibration in a high frequency area and the frequency thereof at fuel delivery pipes according to the first conventional example to the fourth conventional example and the fist embodiment to the fourth embodiment.
Figure 34:
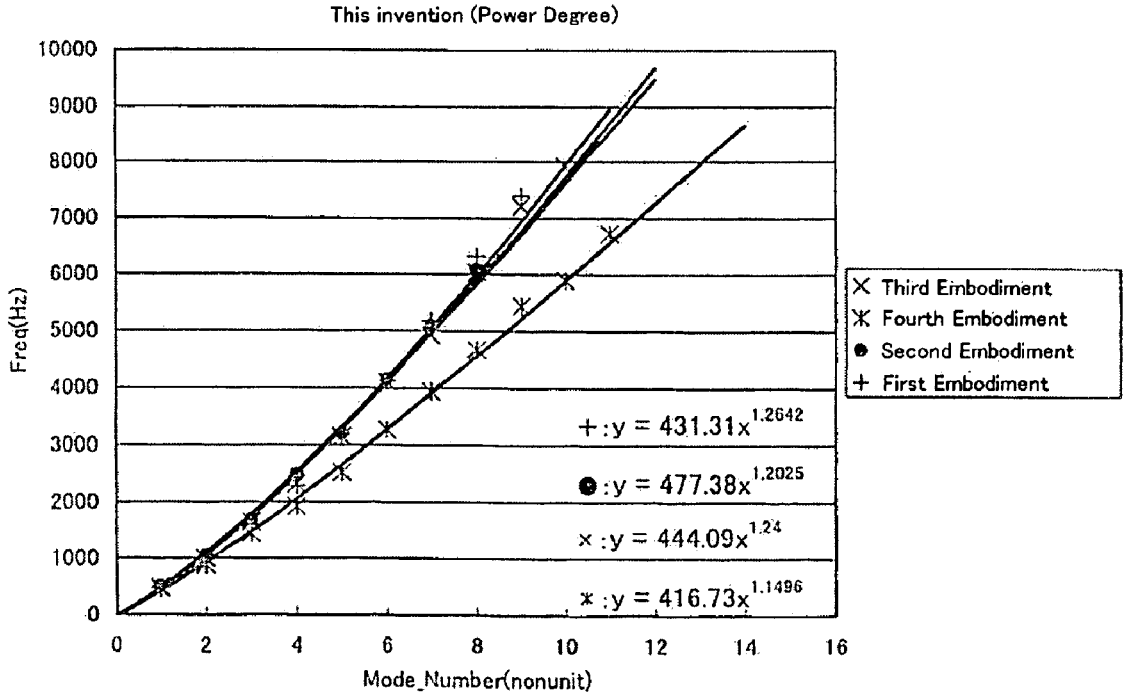
Figure 35:
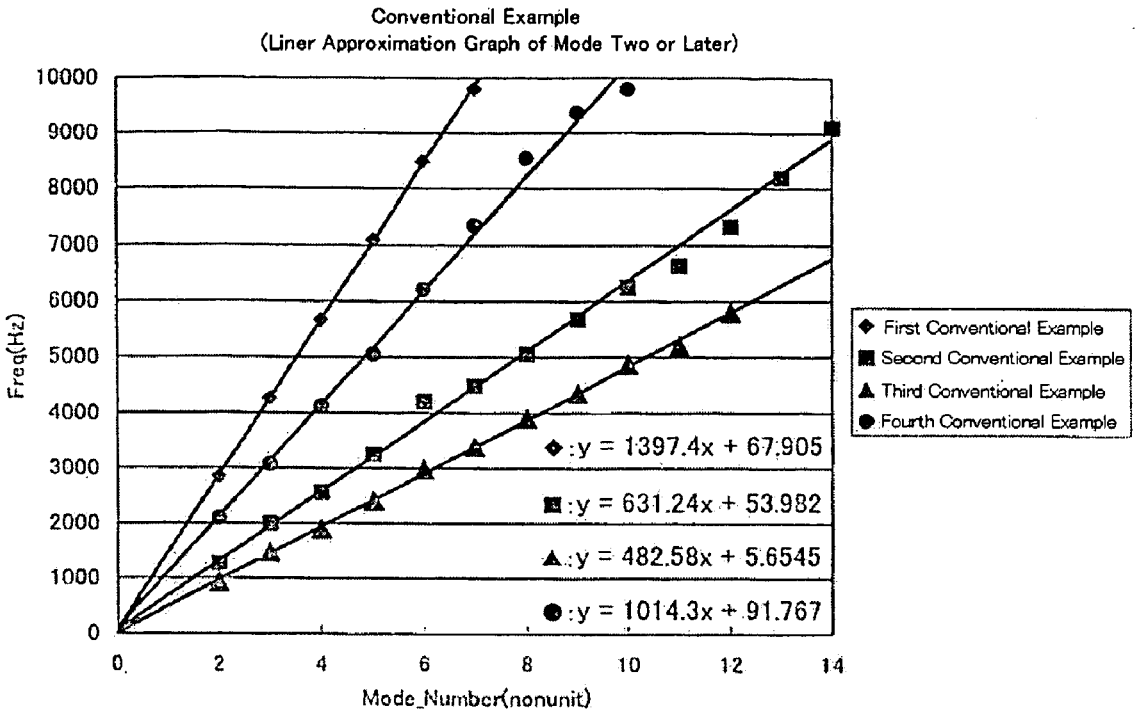
FIG. 35 is a linear approximation graph of the mode two or later at the fuel delivery pipes according to the first conventional example to the fourth conventional example and the first embodiment to the fourth embodiment.
Figure 35:
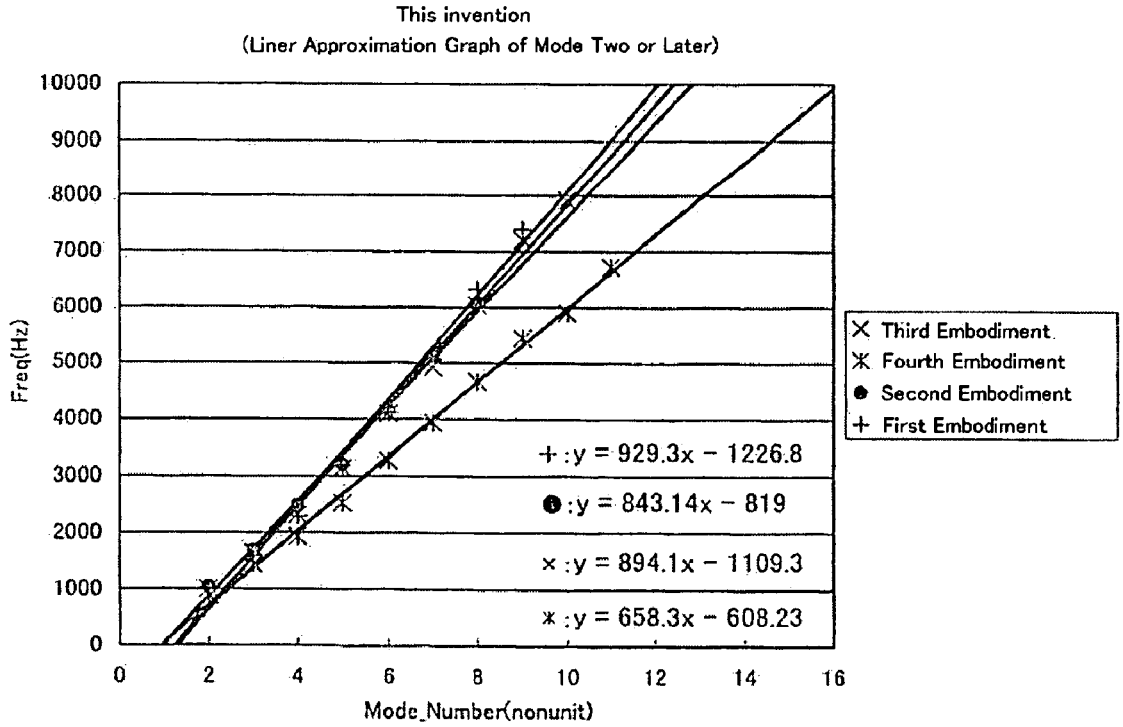

Furthermore, a modal analysis is made, in which the fuel in the fuel delivery body 1 and the fuel delivery body 1 are coupled to each other, and the mode of the air column vibration inside the fuel delivery body 1, of more than several kHz as the problem with respect to the radiant sound, is extracted, thereby determining the equivalent sonic speed $\alpha_H$ in a high frequency area. FIG. 34 shows a correlation graph of a cumulative coefficient of the number of the modes of air column vibration and the frequency regarding to the first embodiment to the fourth embodiment and the first conventional example to the fourth conventional example. Based on the graph of FIG. 34, FIG. 35 shows a liner graph of a degree of a mode two or higher regarding to the first embodiment to the fourth embodiment and the first conventional example to the fourth conventional example. Tilt (f/n) is determined based on the above graph, and multiplied, with use of the aforementioned expression 5, by double rail length of each of the fuel delivery bodies 1, so that the equivalent sonic speed $\alpha_H$ in the high frequency area can be determined.

In FIG. 34 and FIG. 35, the cumulative coefficient of the number of modes of the conventional example is approximately equal to one, and where the number of modes of a degree of a mode two or higher and the frequency are linearized, a line nearly passes through an origin. More specifically, the sonic speed $\alpha_L$ of the fuel and equivalent sonic speed $\alpha_H$ in the high frequency area are approximately the same.

In contrast, the cumulative coefficient of the number of modes of the embodiments is approximately greater than one, and where the number of modes on and after a degree of a mode two and the frequency are linearized, an intersection point with a X-axis shifts greatly toward a plus side, so the line does not pass through the origin. More specifically, the sonic speed $\acute{a}_L$ of the fuel and equivalent sonic speed $\alpha_H$ in the high frequency area becomes greater than the sonic speed $\alpha_L$ of the fuel, so that $\alpha_L/\alpha_H \leqq 0.7$ is satisfied.

Hereinafter, actions of the pulsation absorption and reduction of the radiant sound of the fuel delivery pipe according to this invention will be described with reference to the first embodiment. When the pressure pulsation occurs in association with the fuel injection via the injection nozzles, the internal volume of the fuel delivery body 1 increases as the flexible absorbing wall surface 10 of the fuel delivery body 1 yields outwardly and deforms. FIG. 3 shows a schematic view of an increased state of this internal volume analyzed with the FEM analysis, wherein the dashed line indicates an inner wall surface of the fuel delivery body 1 before the increase of the internal volume, while a full line indicates the inner wall surface thereof at the time of the increase of the internal volume. As shown in FIG. 3, each flexible absorbing wall surface 10 flexes outwardly for a distance A and deforms as a straight line because of a rise of the internal pressure, and thus, as indicated by B in FIG. 3, the distance between the end points of each of the flexible absorbing wall surfaces 10, i.e., the distance between an upper wall 6 and a lower wall 5 becomes longer.

Therefore, the great increase of the internal volume (about 1.1%) of the fuel delivery body 1 becomes possible, and as shown in the table 1, so the sonic speed $\alpha_L$ of fuel can reduce by several hundreds Hz, and inevitably, $\alpha_L/\sqrt{V}$ can reduce to be equal to $\leqq 45\times10^3(m^{-0.5}\cdot sec^{-1})$, so the superior absorption effect for the pressure pulsation can be obtained. As a result, it is possible to suppress effectively the transmission or the propagation of the pressure pulsation or noises to the underfloor pipe arrangement or the like.

On the other hand, with the fuel delivery pipes according to the conventional arts in the case of the equivalent sonic speed $\alpha_H$ in the high frequency area of more than several kHz considered as the problem with respect to the radiant sound, e.g., a clicking noise occurring when a spool of the injection nozzle is seated on a valve seat or the like, where the fuel delivery pip is made to flex easily so the sonic speed $\alpha_L$ of the fuel reduces, the flexure in the high frequency area also greatens inevitably while the number of modes increases as shown in FIG. 3. Therefore, as shown in the table 1, the equivalent sonic speed $\alpha_H$ in the high frequency area reduces, and it became difficult to suppress the radiant sound.

Figure 31:
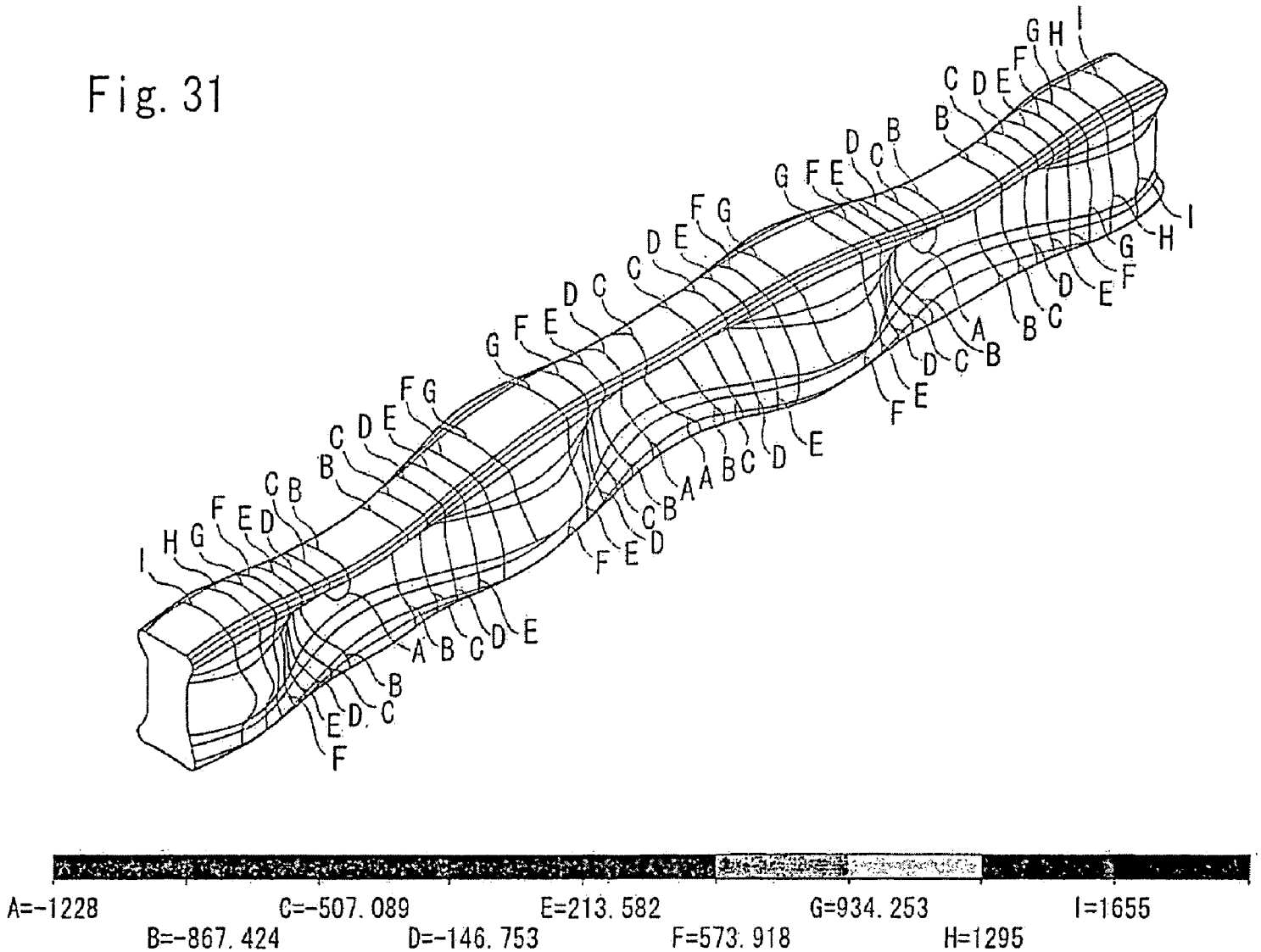
FIG. 31 is a conceptual diagram showing a state of nodes and loops at a mode of an air column vibration, based on an FEM analysis, in a frequency of around four kHz of the fuel delivery body in a double side concaved shape according to the first embodiment and the second embodiment.
Figure 32:
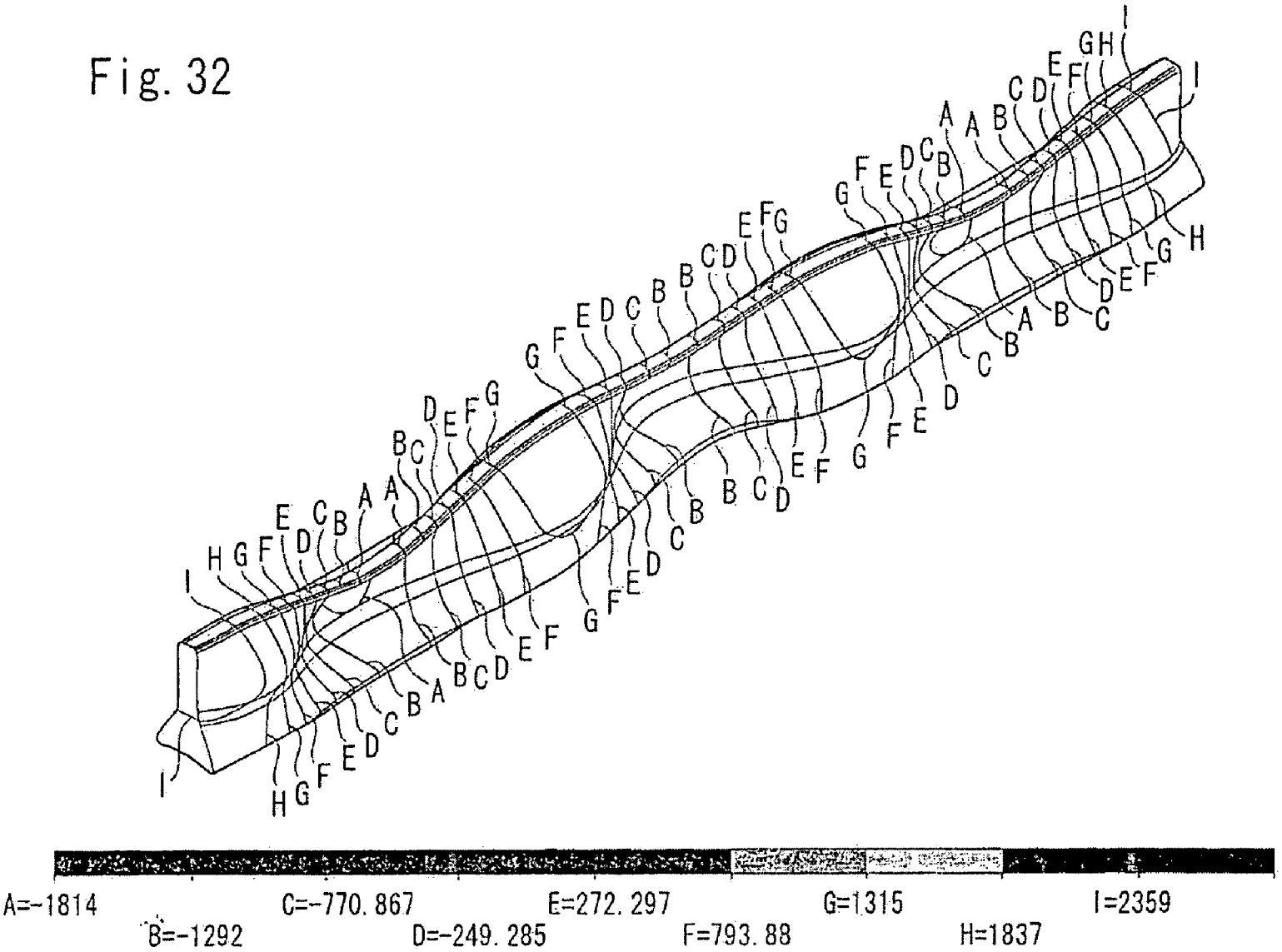
FIG. 32 is a conceptual diagram showing nodes and loops at the mode of the air column vibration, based on a FEM analysis, in the frequency of around four kHz of the fuel delivery body in the flask shape according to the third embodiment.
Figure 33:
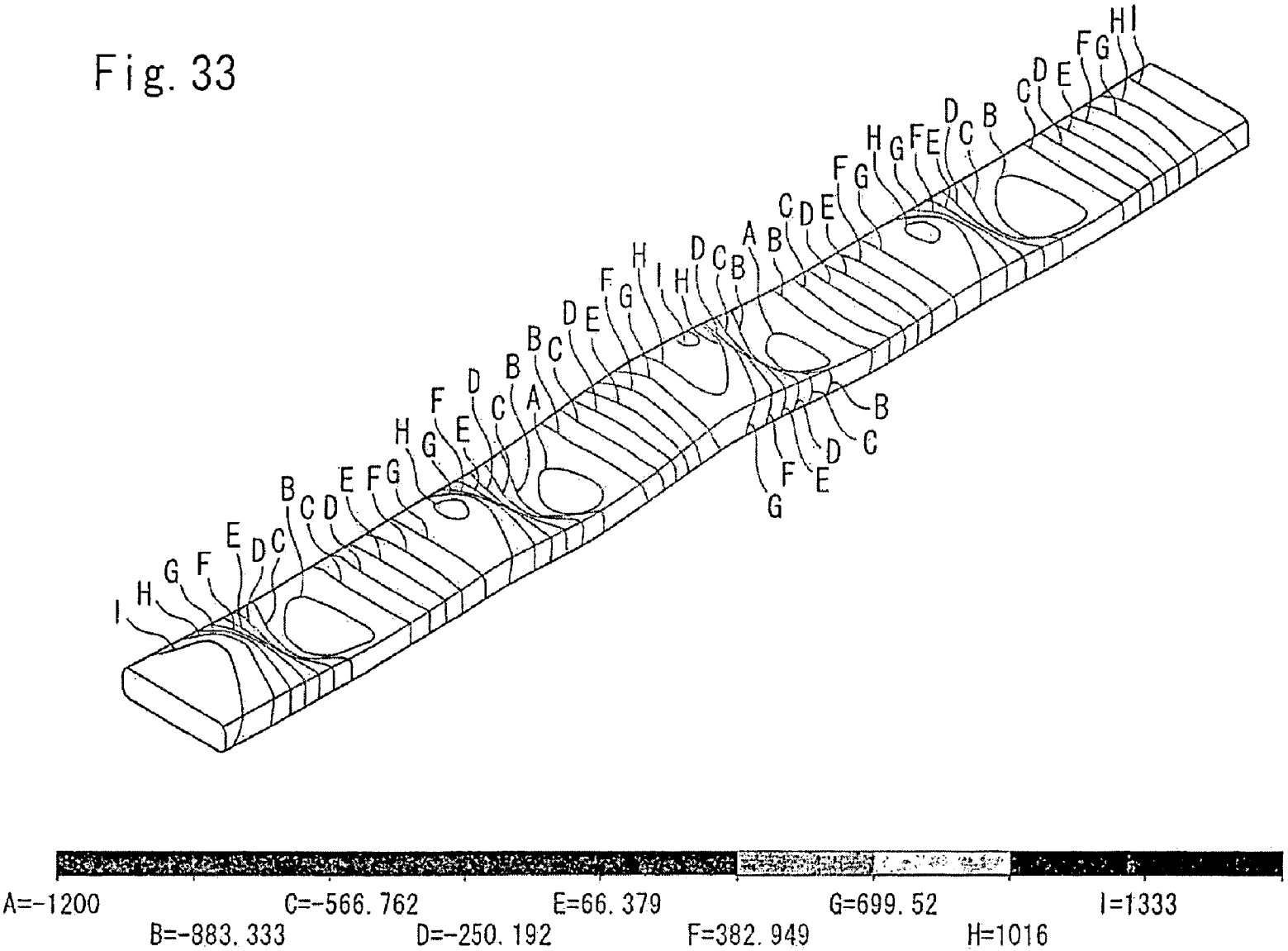
FIG. 33 is a conceptual diagram showing nodes and loops at the mode of the air column vibration in the frequency of around four kHz of the fuel delivery body in a flat shape according to the second conventional example to the sixth conventional example, wherein A to I in the FIG. 31 to FIG. 33 shows a change of an internal pressure in a certain phase of the fuel delivery body.

However, the fuel delivery pipe according to the first embodiment, as shown in FIG. 31, the absorbing wall surface 10 forms into a mode shape having a number of loops and nodes, which is a not readily bent shape, so that the flexure of the absorbing wall surface 10 in the high frequency is reduced. Therefore, while the sonic speed $\alpha_L$ of the fuel is 287 m/s, the equivalent sonic speed $\alpha_H$ in the high frequency area is 663 m/s, thereby not being reduced, so that it is possible to keep the radiant sound small in comparison with the conventional arts.

Figure 36:
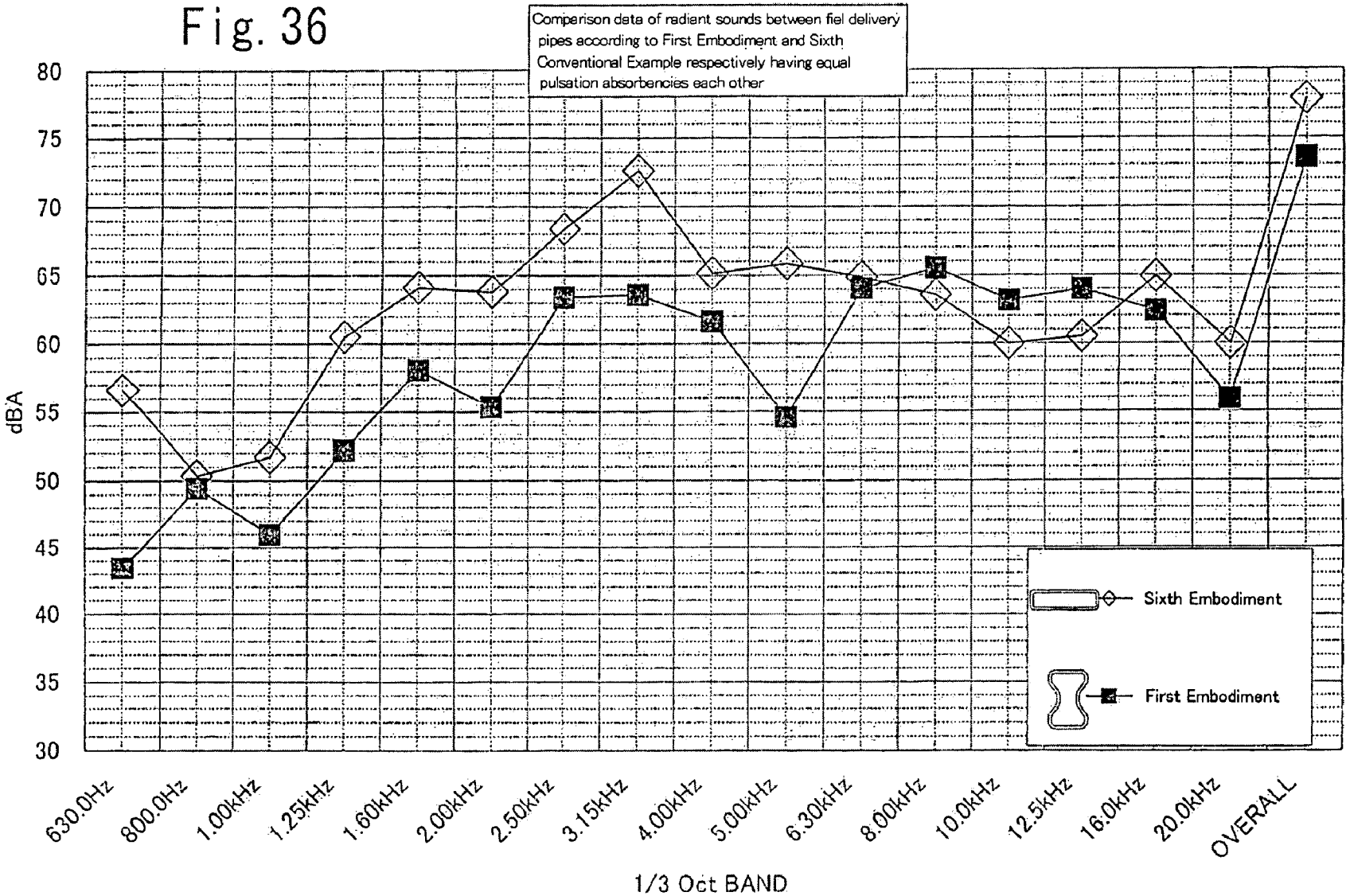
FIG. 36 is a graph showing a comparison of radiant sounds between the fuel delivery pipes according to the fist embodiment and the sixth conventional example respectively having equal pulsation absorbencies each other.

In the FIG. 36 shows a graph showing a comparison of the fuel delivery pipes between the first embodiment and the sixth conventional example both having close $\alpha_L/\sqrt{V}$ and the equal absorptiveness for the pulsation. As can be seen from this graph, the fuel delivery pipe in the first embodiment according to the present invention has a higher suppression effect for the radiant sound in comparison with the sixth conventional example.

Figure 28:
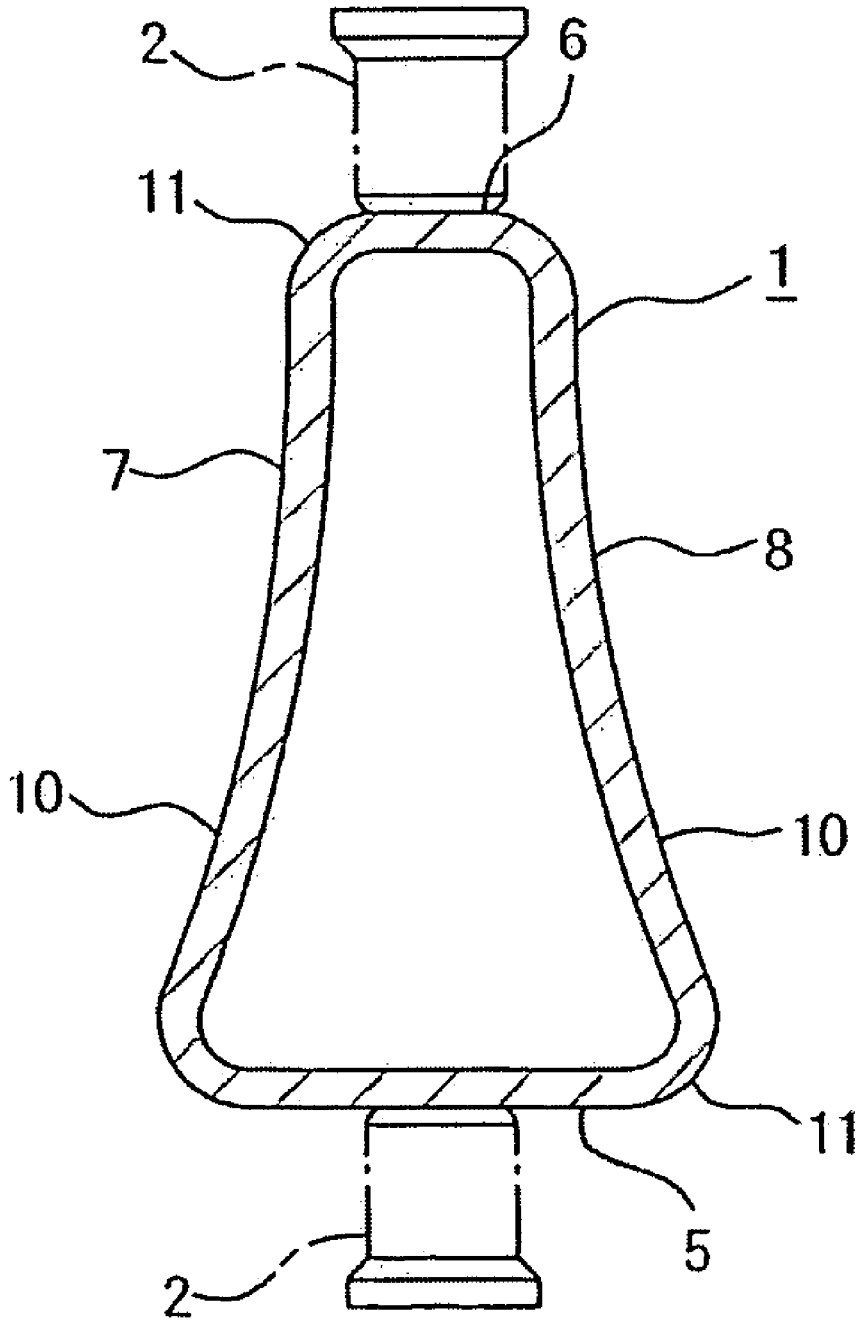
FIG. 28 is an essential cross-sectional view of a fuel delivery pipe in a trapezoid shape according to the twenty-sixth embodiment.

The fuel delivery body 1, furthermore, may be formed in different shapes from the first embodiment to the different twenty-fifth embodiment, wherein the side of the upper wall 6 with a narrower width, the side of the lower wall 5 with a wider width, and the left side wall 7 and the right side wall 8 inwardly curved in a gently arc shape may be arranged to form the fuel delivery body 1 which cross section shape may be in the substantially trapezoid shape, like the twenty-sixth embodiment as shown in FIG. 28, which is different from others. Furthermore, as the chain-dashed line indicates, the fuel delivery pipe 1 in the substantially trapezoid shape may be used in a state that the socket 2 is formed to the lower wall 5, or to the upper wall 6, wherein the upper wall 6 having the socket 2 is exposed to the lower side to shape the fuel delivery pipe 1 in a reverted trapezoid shape.

Figure 29:
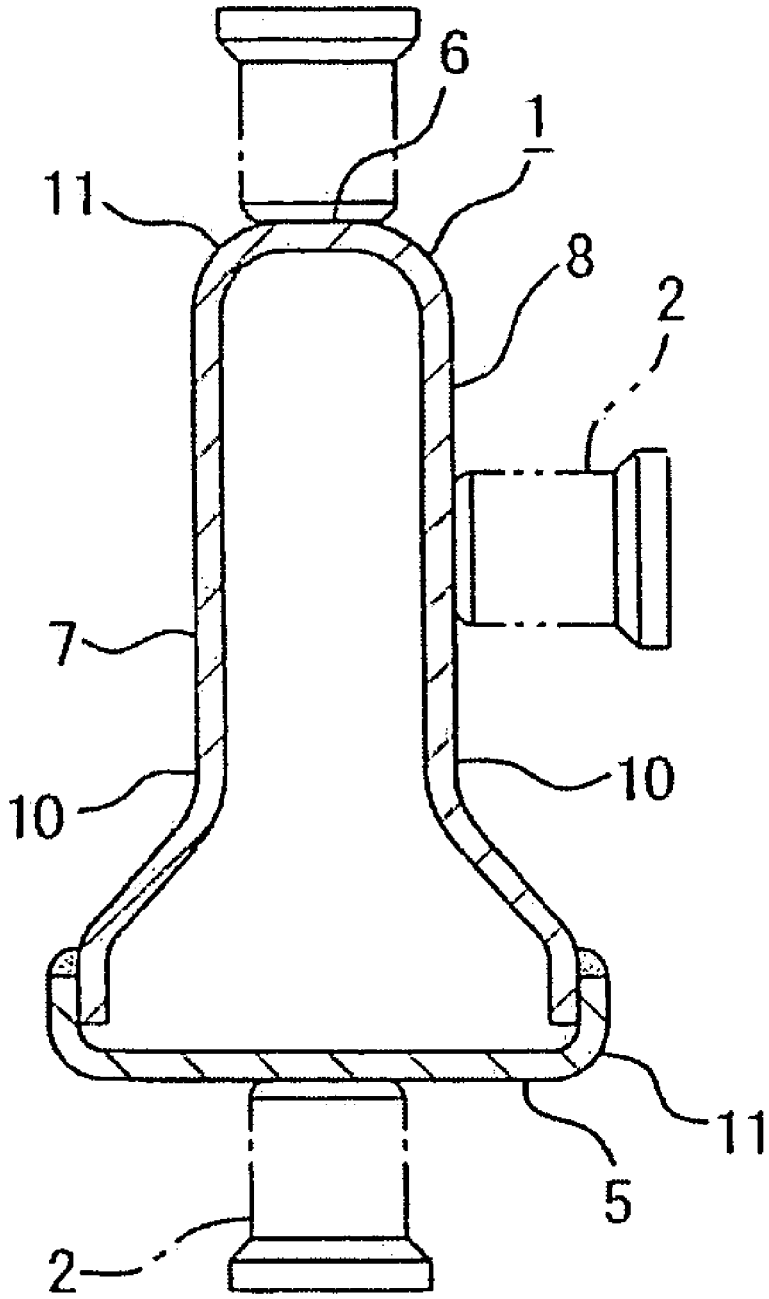
FIG. 29 is an essential cross-sectional view of a fuel delivery body in the flask shape formed by combining a plurality of shaped plate materials according to the twenty-seventh embodiment.
Figure 30:
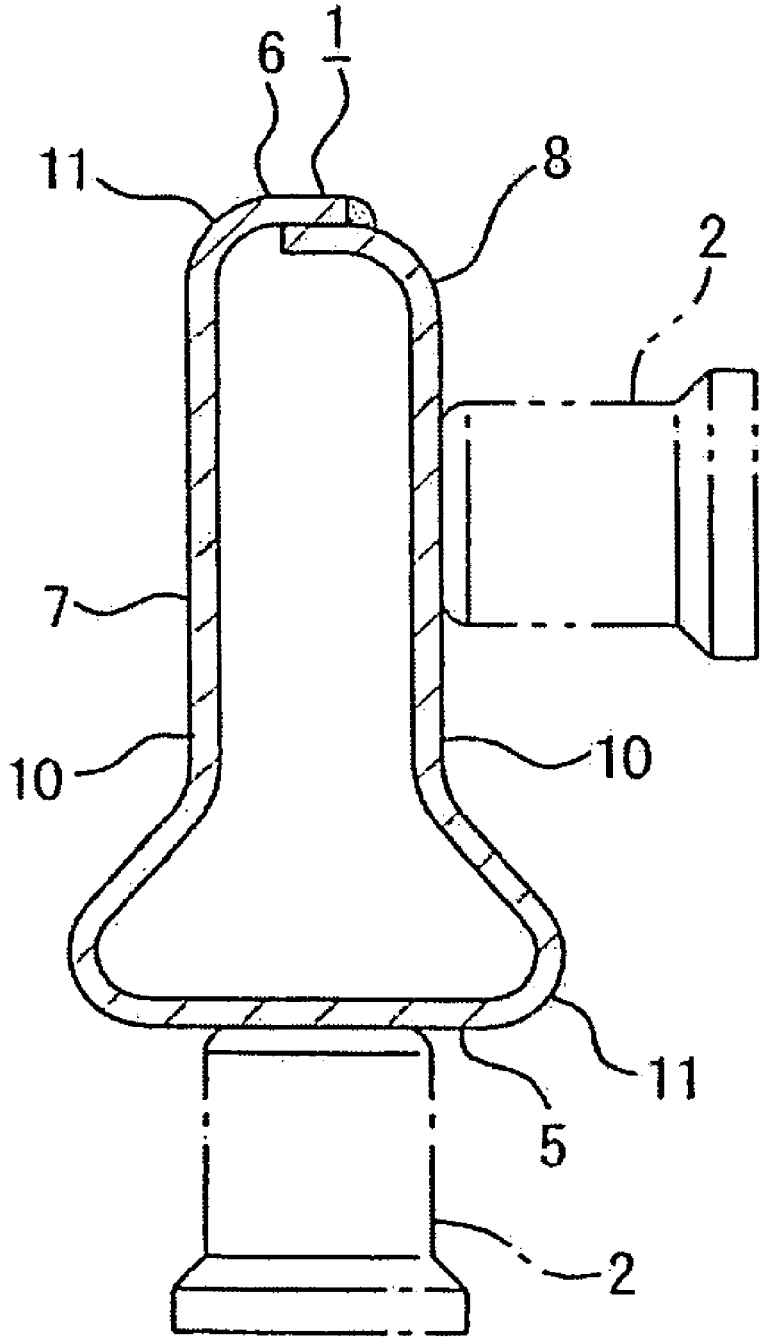
FIG. 30 is an essential cross-sectional view of a fuel delivery body in the flask shape formed by superimposing parts of plate materials one another by means of a press working according to the twenty-eighth embodiment.

Furthermore, the above described fuel delivery body 1 according to the first embodiment to the twenty-sixth embodiment can be formed easily by means of the above described roll forming process. Furthermore, the fuel delivery body 1 may be formed, e.g., the twenty-seventh embodiment as shown in FIG. 29, by combining and brazing or welding two shaped plate materials after forming respectively and separately an upper half portion and a lower half portion. The fuel delivery body 1, furthermore, may be formed, e.g., the twenty-eight embodiment as shown in FIG. 29, by fixing to bond both ends by brazing or welding after superimposing both ends of the press formed board materials. In these cases, the fuel delivery pipe 1 is arranged to shape in the vertically long flask shape or in the reverted flask shape, and the fuel delivery pipe 1 may be used in a state that the socket 2 is, as the chain-dashed line indicates, formed to the lower wall 5 or to the upper wall 6 with exposing the wall surface having the socket 2 to the lower side, or the fuel delivery pipe 1 may be used in a state that the socket 2 is, as the chain double-dashed line indicates, formed to the right side wall 8 with arranging the fuel delivery pipe 1 in a horizontally long flask shape.

Figure 37:
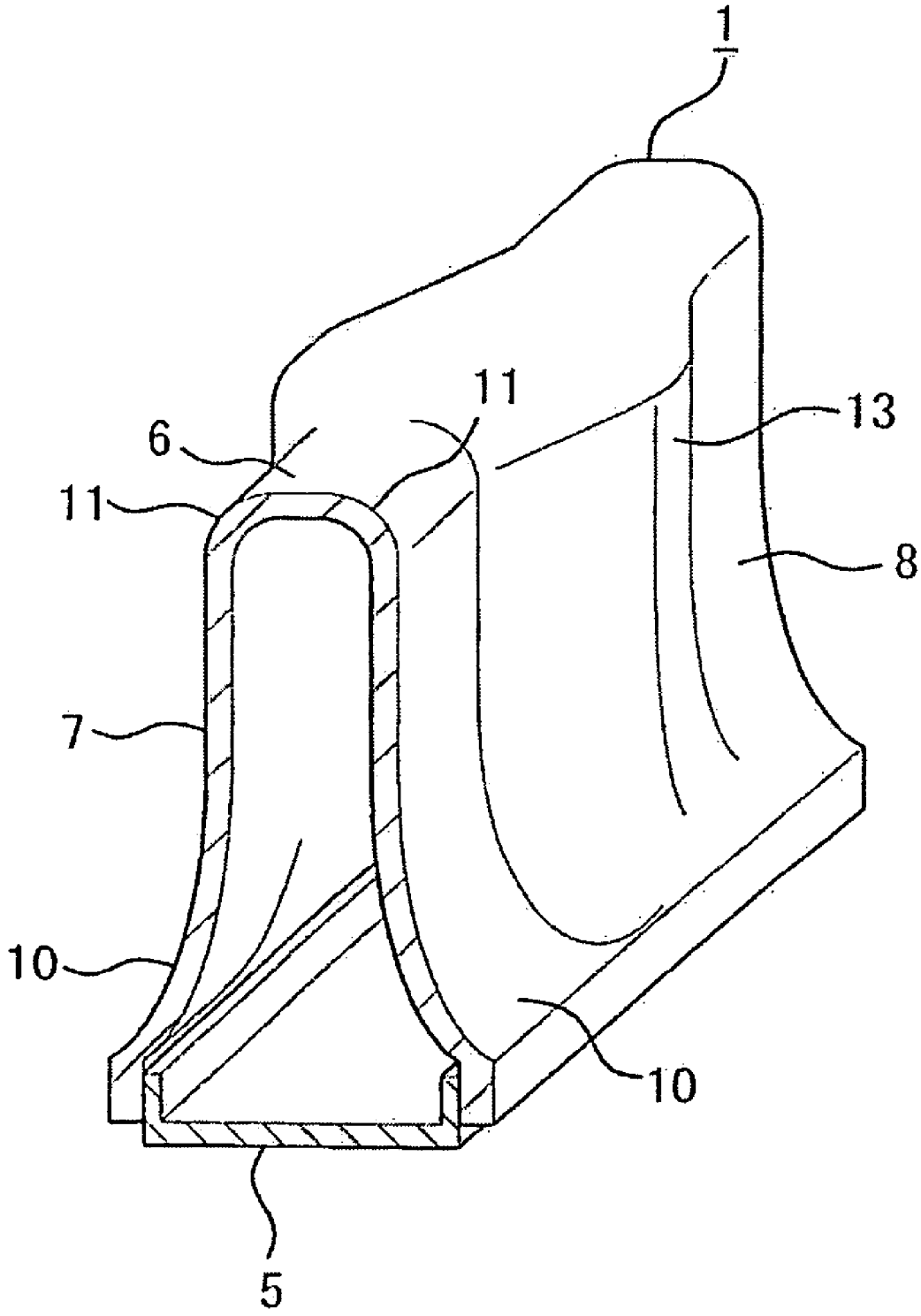
FIG. 37 is a cross-sectional perspective view of the twenty-ninth embodiment, wherein an evaginated portion is formed at a middle of a fuel delivery body in a trapezoid shape.

The cross sectional views shown in FIG. 2 and FIG. 4 to FIG. 30 show the main cross sections of the fuel delivery body 1 according to the embodiments respectively, and the cross section shape does not have to necessarily be identical from one end to the other end in a direction of a length of the fuel delivery body 1, so the cross section of the fuel delivery body 1 may be partially in a different shape from the main cross section shape according to installation space or the like. For example, like the twenty-ninth embodiment as shown in FIG. 37, an extending portion 13 may be formed, according to need, to a middle of the fuel delivery body 1 to regulate a flow volume of the fuel, or the middle may be narrowed to prevent an interference with other components, which is not shown in drawings though. Furthermore, with each of the above described embodiment, four corners have the arc shape curve portions 11 but do not have to necessarily be curved in the arc shape, so, like, e.g., the twenty-ninth embodiment shown in FIG. 27, some corners may be formed in a rectangular shape to facilitate the formation thereof. However, when the corner is curved in the arc shape, adaptability thereof to the deformation of the absorbing wall surface 10 for the change of the internal pressure at the time of the fuel injection via the injection nozzles, is improved.

Figure 38:
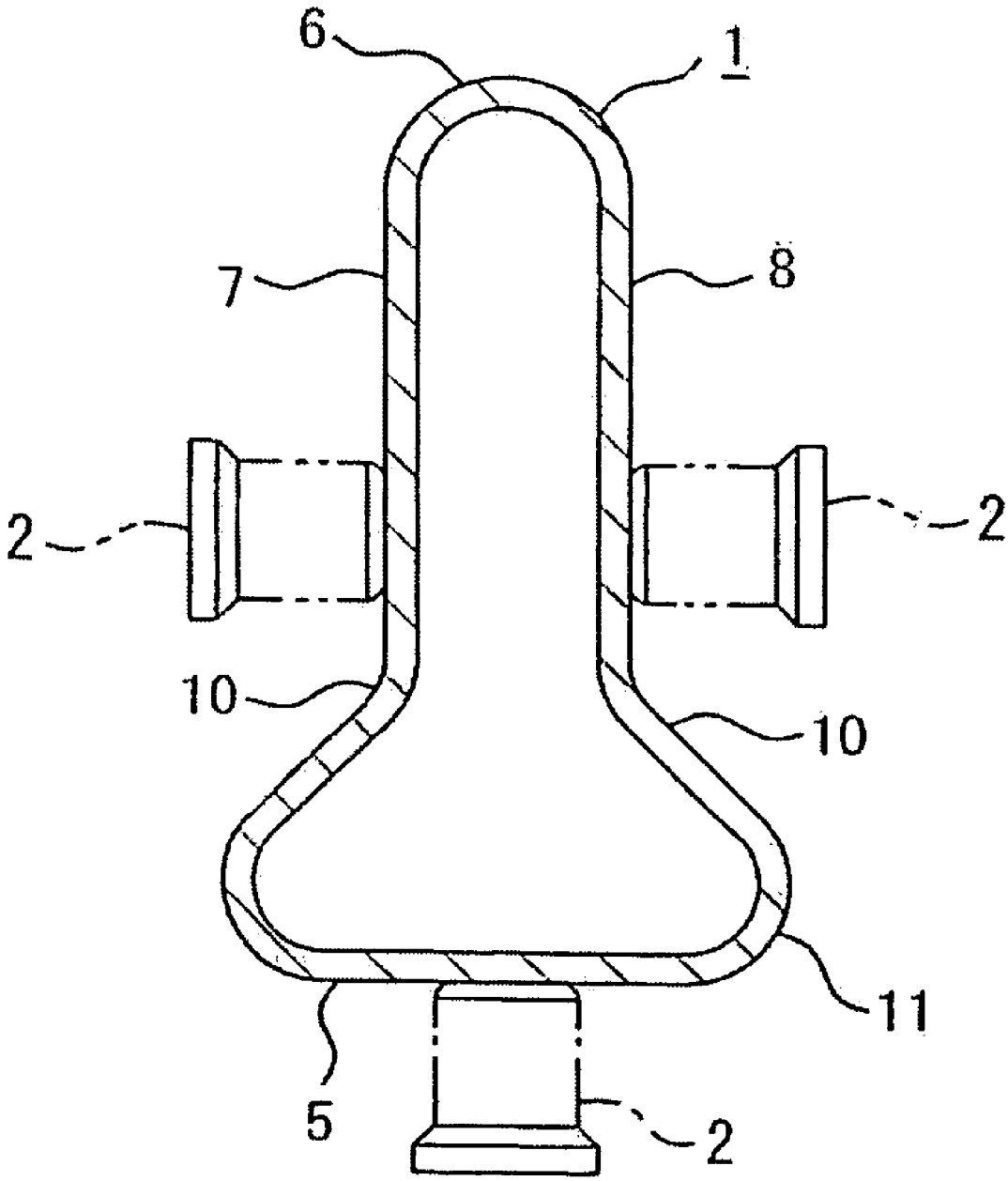
FIG. 38 is an essential cross-sectional view of a fuel delivery body having a cross section in a shape of a substantially flask with a doom roof according to the thirtieth embodiment.
Figure 39:
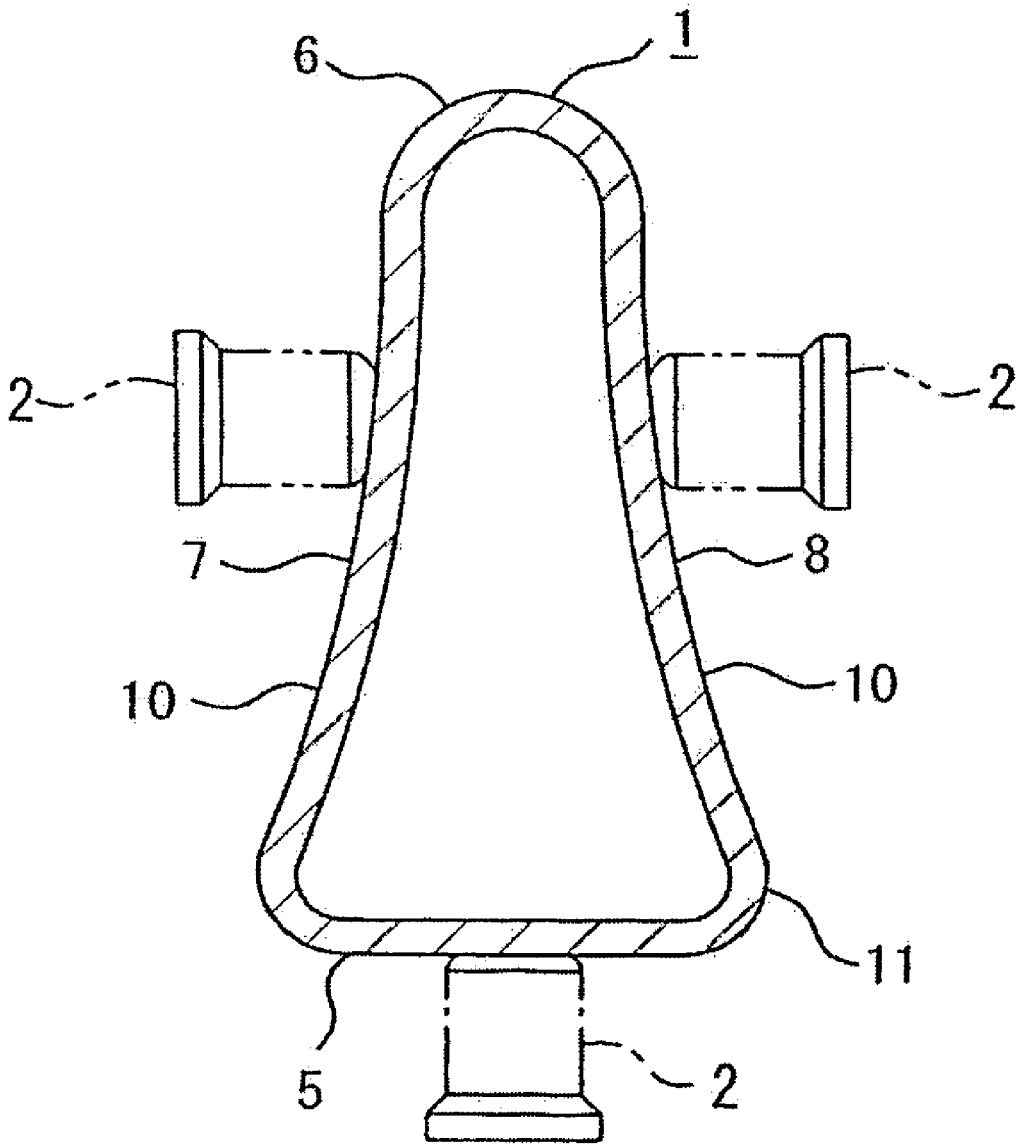
FIG. 39 is an essential cross-sectional view of a fuel delivery body having the cross section in a shape of a substantially trapezoid with the doom roof according to the thirty-first embodiment.
Figure 40:
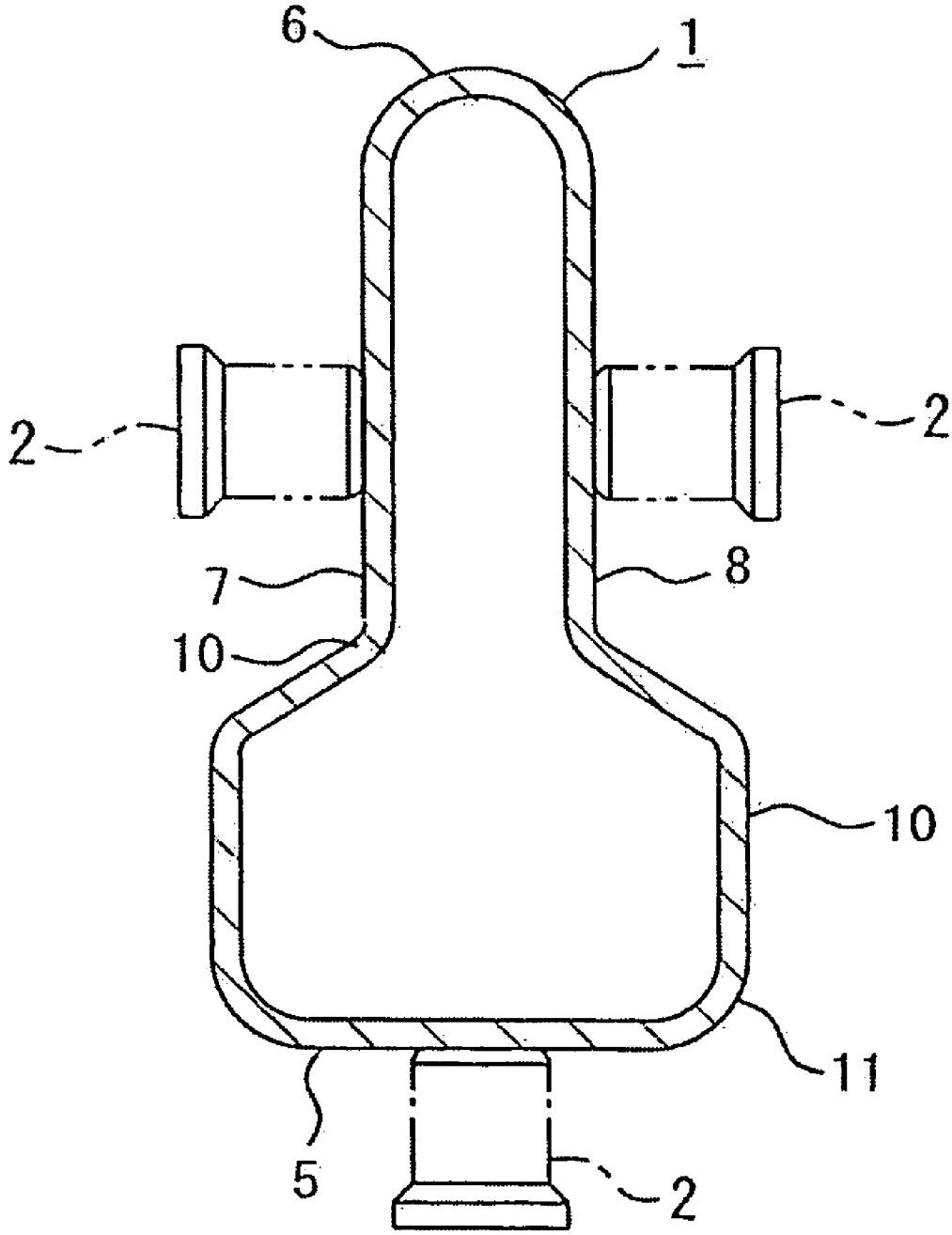
FIG. 40 is an essential cross-sectional view of a fuel delivery body having the cross section in a shape of a substantially key with the doom roof according to the thirty-second embodiment.

FIG. 38 shows the fuel delivery body 1 according to the thirtieth embodiment, which cross section is the shape of the substantially flask shape with the doom roof as the deformation of the substantially flask shape, in which the upper wall 6 is formed in the arc shape. Furthermore, FIG. 39 shows the fuel delivery body 1 according to the thirty-first embodiment, which cross section is the shape of the substantially trapezoid shape with the doom roof as the deformation of the substantially trapezoid shape, in which the upper wall 6 is formed in the arc shape. FIG. 40 shows the fuel delivery body 1 according to the thirty-second embodiment, which cross section is the shape of the substantially key shape with the doom roof as the deformation of the substantially key shape, in which the upper wall 6 is formed in the arc shape.

With these cases of the thirty embodiments, the thirty-first embodiment, and the thirty-second embodiment, the fuel delivery body 1 may be arranged in the vertically long shape in both upward and downward directions, wherein the socket 2 may be formed, as the chain-dashed lines indicate, to the flat upper wall 5 while the fuel delivery body 1 may be arranged in the horizontally long shape, wherein the socket 2 may be formed to, as the chain double-dashed lines indicate, either of the left wall 7 or the right wall 8 as the bottom surface.

Figure 41:
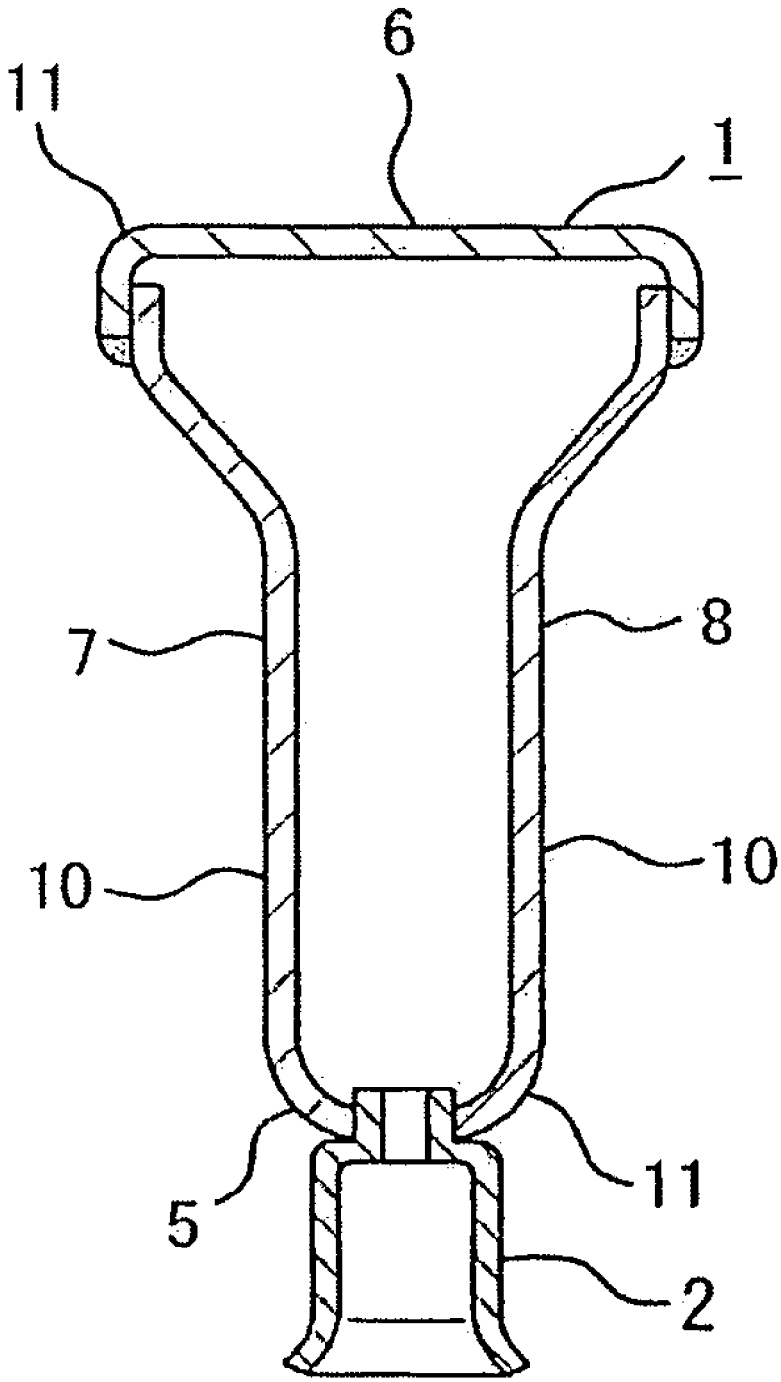
FIG. 41 is an essential cross-sectional view of a fuel delivery body in a reverted flask shape according to the thirty-third embodiment and FIG. 42 is an essential cross-sectional view of a fuel delivery body in a reverted trapezoid shape according to the thirty-fourth embodiment, wherein both fuel delivery bodies in FIG. 41 and FIG. 42 are formed by combining a plurality of shaped plate materials.

With the thirty-third embodiment as shown in FIG. 41, where the fuel delivery body 1 in the reverted flask shape is formed, after forming separately the upper wall 6 in a flat plate shape and a bent material in a cup shape including the lower wall 5, the left side wall 7, and the right side wall 8, by bonding both the upper wall 6 and the bent material by means of the brazing or the welding in a state that the ends of the both thereof are superimposed mutually.

Figure 42:
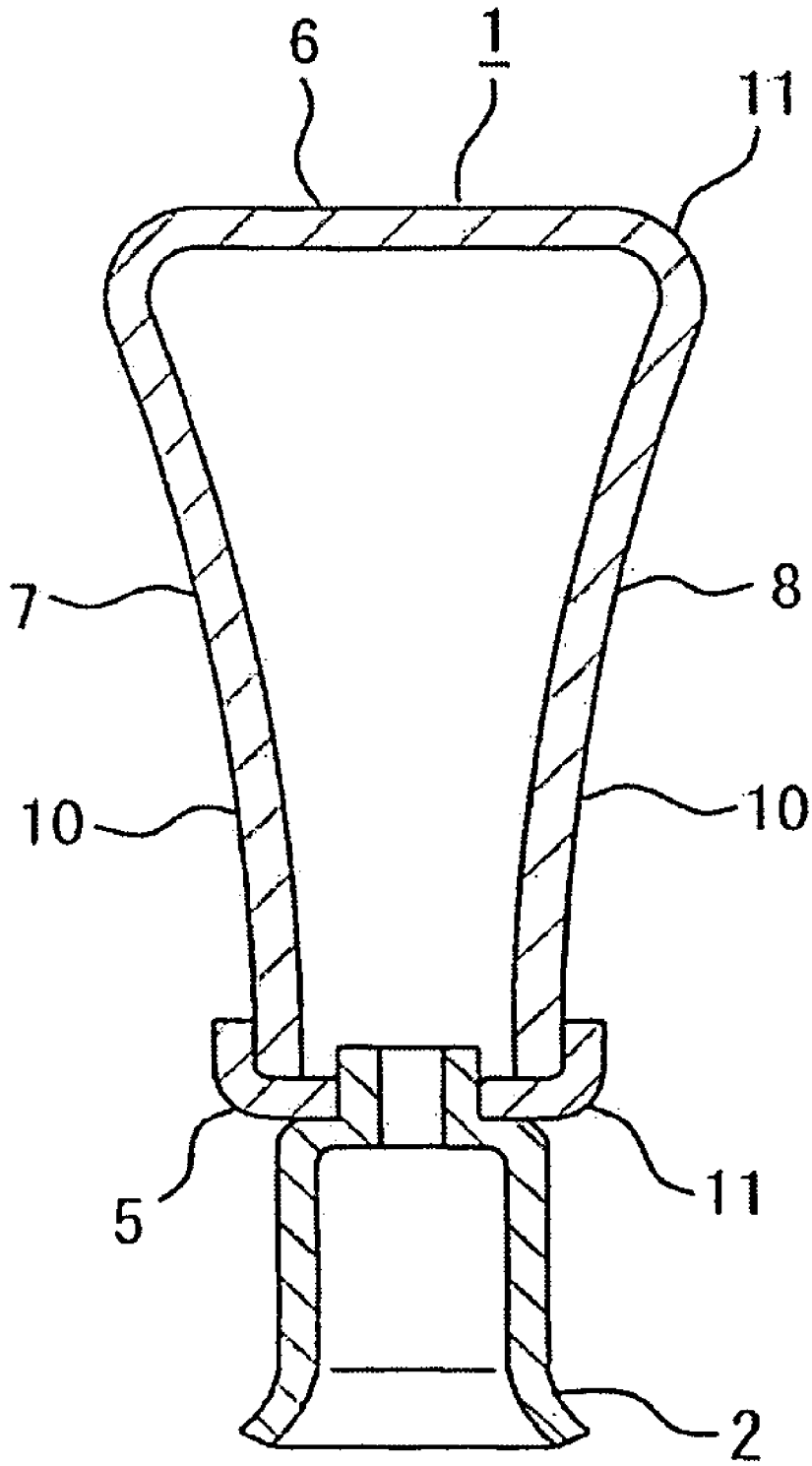

With the thirty-fourth embodiment as shown in FIG. 42, the fuel delivery body 1 in the substantially trapezoid shape is formed, after forming separately the flat lower wall 5 in the plate shape and the bent material comprising the upper wall 5, the left side wall 7, and the right side wall 8, by bonding both the lower wall 5 and the bent material by means of the brazing or the welding in a state that the ends of the both thereof are overlapped mutually.

Figure 43:
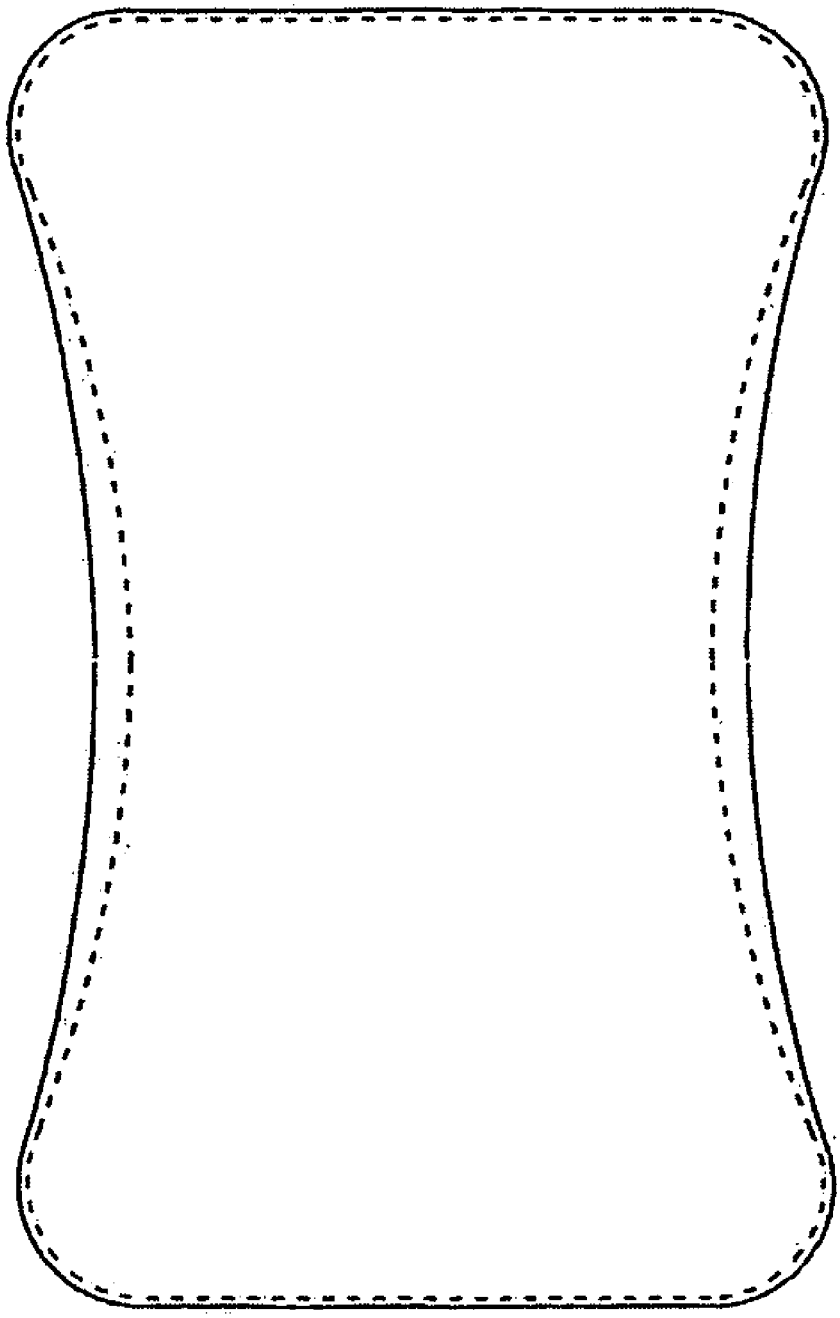
FIG. 43 is a conceptual diagram showing a state where internal volume of a fuel delivery body in a double side concaved shape with center portions of long side wall surfaces thereof in a smooth arc shape, not having flat portions, changes upon receiving internal pressure.

FIG. 43 shows the result of the FEM analysis of the transformation in a case where the internal pressure is applied to the fuel delivery body 1 in the double side concaved shape, wherein the centers of the wall surfaces at the long sides do not have the flat portions, thereby being formed as the smooth arc shaped. As shown in FIG. 43, the inner wall surface of the fuel delivery body 1 expands from the dashed line to the full line in a horizontal direction, but the large amount of movement e in the horizontal direction results in the amount of deformation remaining very slight with the view to the top and the bottom, and thus it is understood that the increasing rate of the internal volume is about 1.1%. Therefore, in the case of the fuel delivery pipe 1 in the substantially double side concaved shape as shown in FIG. 43, the same operational effect as the first embodiment in FIG. 3 can be also exercised.

Figure 44:
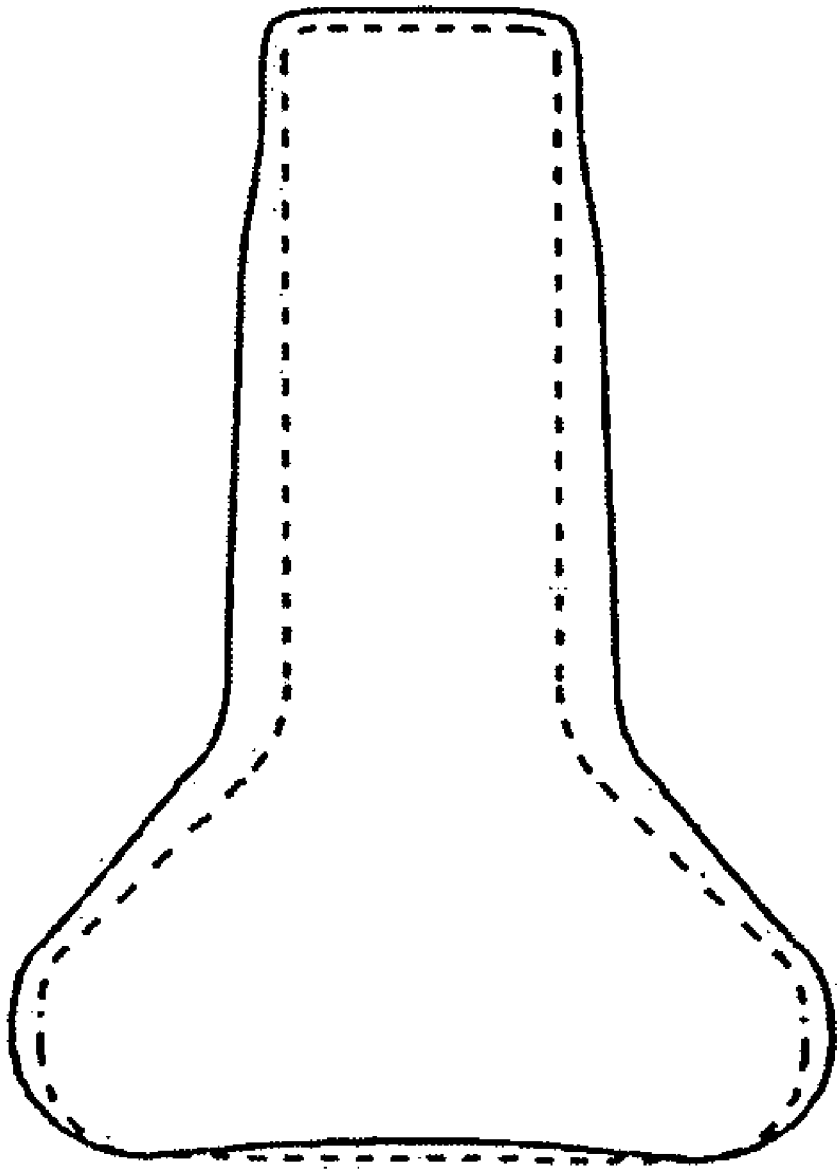
FIG. 44 is a conceptual diagram showing a state where the internal volume of a fuel delivery body in the substantially flask shape changes upon receiving the internal pressure.
Figure 45:
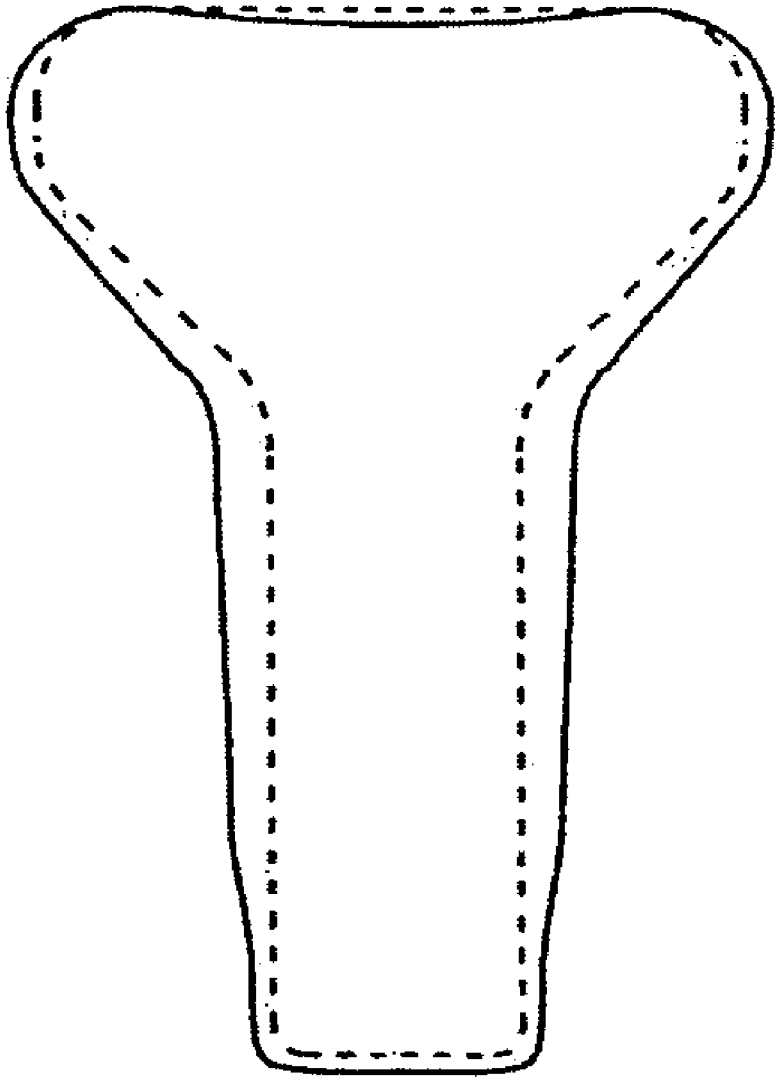
FIG. 45 is a conceptual diagram showing a state where the internal volume of a fuel delivery body in the reverted flask shape changes upon receiving the internal pressure.
Figure 46:
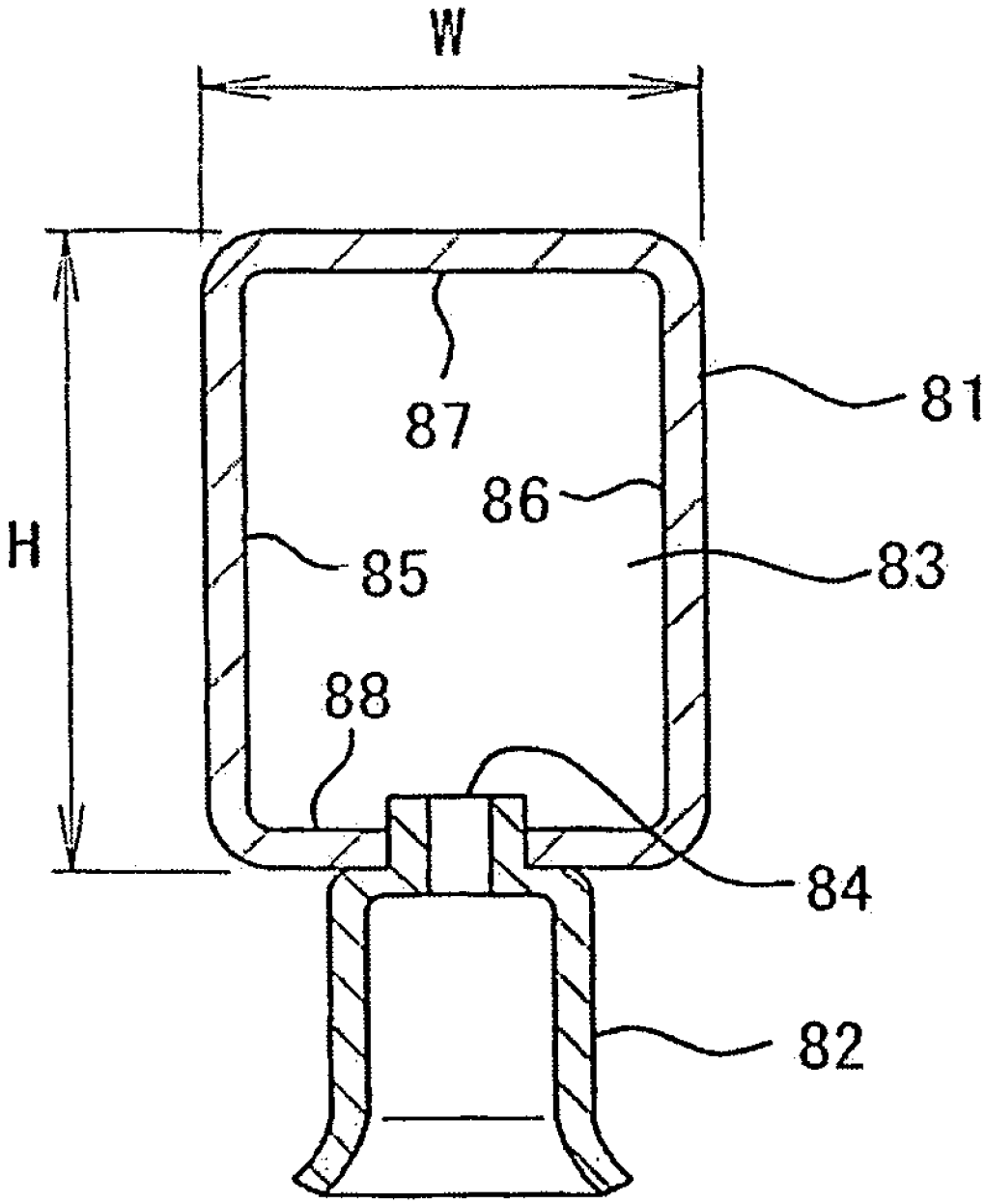
FIG. 46 is a sectional view of a fuel delivery body and a socket of a conventional fuel delivery pipe.
Figure 47:
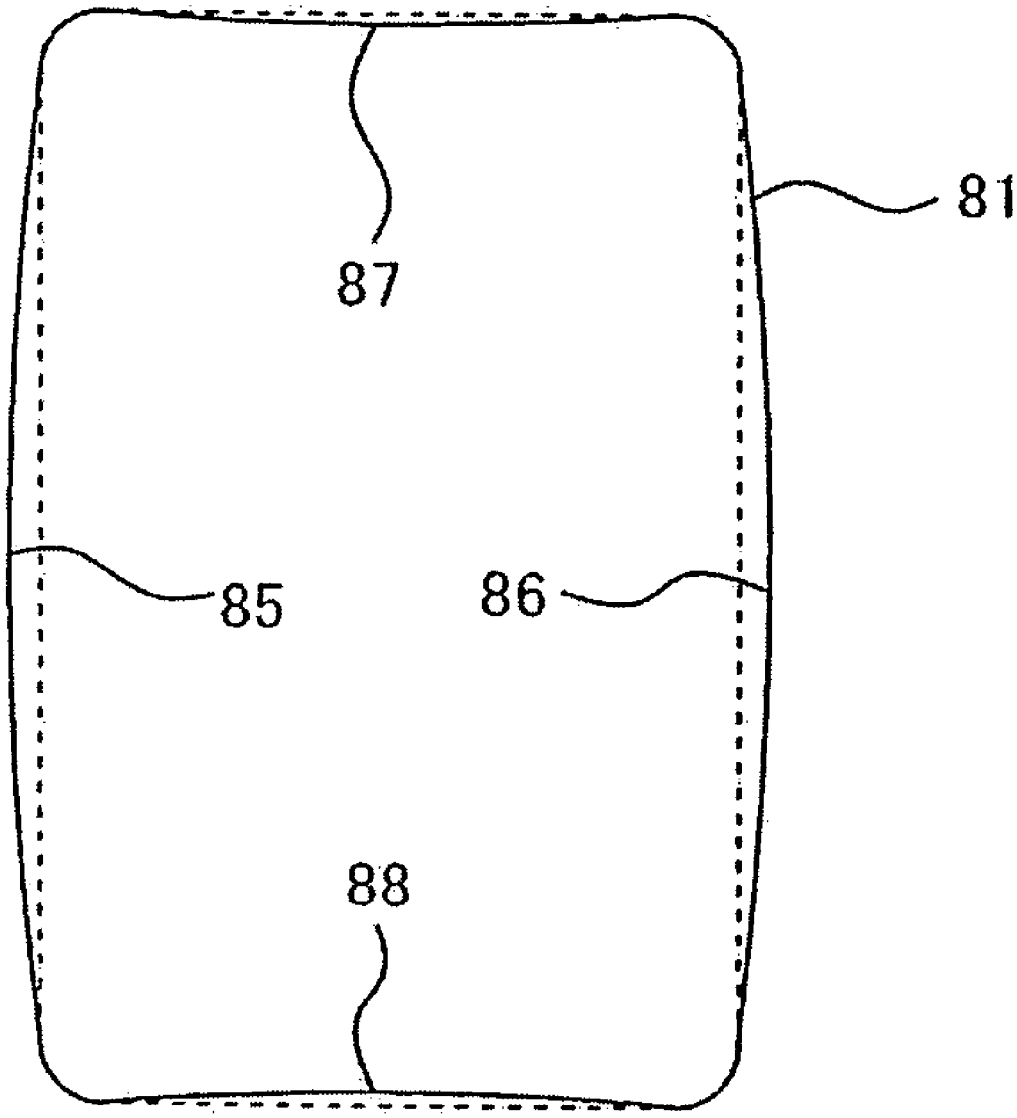
FIG. 47 is a conceptual diagram showing a deformation state of a conventional fuel delivery body.

FIG. 44 shows the result of the FEM analysis of the transformation in a case where the internal pressure is applied to the fuel delivery pipe 1 in the substantially flask shape while FIG. 45 shows the result of the FEM analysis of the transformation in a case where the internal pressure is applied to the fuel delivery pipe 1 in the reverted flask shape. In these cases, the same operational effect as the first embodiment in FIG. 3 can be also exercised.

INDUSTRIAL APPLICABILITY

A fuel delivery body according to the present invention is structured like the above, wherein by forming a cross section shape in a perpendicular direction to an axis in a double side concaved shape, a flask shape, a trapezoid shape, a key shape a goggle shape or the like, an internal volume changing rate in a case of a receipt of the same pressure as before increases sharply, and an absorption effect for a pulsation by a flexible absorbing wall surface is enhanced, so that transmission, propagation, and radiation of an abnormal noise, e.g., a radiant sound is prevented. Since it is almost unnecessary to enlarge an outside dimension of the fuel delivery body, the fuel delivery body can be installed in a limited space inside engine room even where made to replace existing fuel delivery pipes, so a technical effect thereof is significantly prominent in which, e.g., the fuel delivery pipe can maintain interchangeability as a component.

Furthermore, by setting $\alpha_L/\sqrt{V}$ determined by sonic speed $\alpha_L$ of fuel flowing through an interior of the fuel delivery body and the internal volume V of the fuel delivery body as $20\times10^3$ to $85\times10^3(m^{-0.5}\cdot sec^{-1})$ while by forming the fuel delivery pipe so a ratio of the sonic speed $\alpha_L$ of the fuel and equivalent sonic speed $\alpha_H$ in a high frequency area is set as $\alpha_L/\alpha_H \leqq 0.7$, it is possible, because of a deformation for flexure, to greatly increase the internal volume of the fuel delivery body according to a change of an internal pressure, so that the absorption effect for a pressure pulsation at the time of a fuel injection is to be high. Therefore, mechanical vibration in a low frequency area is hardly propagated to an underfloor pipe arrangement or the like, so that an occurrence of noises can be prevented. The fuel delivery pipe hardly flexes because of the pulsation in a high frequency area, so the equivalent sonic speed $\alpha_H$ does not reduce, and therefore, it becomes possible to prevent effectively the noise in the high frequency area, e.g., a clicking noise occurring when a spool of the injection nozzle is seated on a valve seat or the like, from radiating outwardly. As described above, it becomes possible to prevent the occurrence of the noises from the low frequently area to the high frequently area, so that production cost can be reduced since it is unnecessary to use pulsation dumpers or clips for absorbing the vibration.

The invention claimed is:

1. A fuel delivery pipe, in which a fuel inlet pipe connected to a fuel delivery body as a returnless type having an injection nozzle but not having a return circuit connecting to a fuel tank is coupled to the fuel tank through an underfloor pipe arrangement, wherein:

a cross section shape of said fuel delivery body in a perpendicular direction to an axis of the fuel delivery pipe is formed in a substantially rectangular shape;

first two wall surfaces at long sides of the substantially rectangular shape are respectively bent inwardly as formed in a double side concave shape;

second two wall surfaces at short sides of the substantially rectangular shape are respectively flat;

a socket for connecting each injection nozzle is secured to either of said first two wall surfaces or either of said second two wall surfaces; and flexible absorbing wall surfaces are furnished by said first two wall surfaces to absorb pulsation by deformation upon receiving pressure in association with fuel injection.

2. The fuel delivery pipe according to claim 1, wherein flat portions are respectively formed around centers of said first two wall surfaces.

3. The fuel delivery pipe according to claim 1, wherein at least one of four corners of the cross section shape of the fuel delivery body is formed in an arc shape.

4. A fuel delivery pipe, wherein a fuel inlet pipe is connected to a fuel delivery body as a returnless type having an injection nozzle and no return circuit to a fuel tank, and the fuel inlet pipe is coupled to the fuel tank through an underfloor pipe arrangement, wherein:

a flexible absorbing wall surface is formed on a wall surface of the fuel delivery body, wherein the absorbing wall yields to a change of internal pressure to render internal volume of the fuel delivery body increasable while $\alpha_L/\sqrt{V}$ determined by sonic speed $\alpha_L$ of fuel flowing through the fuel delivery body and the internal volume V of the fuel delivery body is set as $20\times10^3$ $(m^{-0.5}\cdot sec^{-1})\leqq\alpha_L/\sqrt{V}\leqq85\times10^3(m^{-0.5}\ sec^{-1})$; and a ratio $\alpha_L/\alpha_H$ of equivalent sonic speed $\alpha_H$ in a high frequency area of the fuel flowing through an interior of the fuel delivery body to the sonic speed $\alpha_L$ of the fuel is set as $\alpha_L/\alpha_H\leqq0.7$.

5. The fuel delivery pipe according to claim 4, wherein $\alpha_L/\sqrt{V}$ is equal to $35\times10^3(m^{-0.5}\ sec^{-1})\leqq\alpha_L/\sqrt{V}\leqq85\times10^3$ $(m^{-0.5}\ sec^{-1})$ while $\alpha_L/\alpha_H$ is equal to $\alpha_L/\alpha_H\leqq0.7$.

6. The fuel delivery pipe according to claim 4, wherein $\alpha_L/\sqrt{V}$ is equal to $20\times10^3(m^{-0.5}\ sec^{-1})\leqq\alpha_L/\sqrt{V}\leqq35\times10^3$ $(m^{-0.5}\ sec^{-1})$ while $\alpha_L/\alpha_H$ is equal to $0.35\leqq\alpha_L/\alpha_H\leqq0.7$.

7. The fuel delivery pipe according to claim 1, 2, or 4, wherein bent portions of fuel delivery body surfaces yield outwardly to a change of internal pressure so as to increase an internal volume of the fuel delivery body.

8. The fuel delivery pipe according to claim 3, wherein bent portions of fuel delivery body surfaces yield outwardly to a change of internal pressure so as to increase an internal volume of the fuel delivery body.

9. The fuel delivery pipe according to claim 1, wherein said socket for connecting each injection nozzle is secured to either of said two second wall surfaces.

10. The fuel delivery pipe according to claim 1, wherein said two second wall surfaces are substantially parallel to one another.

11. The fuel delivery pipe according to claim 1, wherein said cross-section shape comprises two pairs of opposing, substantially parallel surfaces.

* * * * *